US008154462B2

(12) United States Patent
Puente Baliarda et al.

(10) Patent No.: US 8,154,462 B2
(45) **Date of Patent: *Apr. 10, 2012**

(54) MULTILEVEL ANTENNAE

(75) Inventors: Carles Puente Baliarda, Barcelona (ES); Carmen Borja Borau, Barcelona (ES); Jaume Anguera Pros, Vinaros (ES); Jordi Soler Castany, Mataro (ES)

(73) Assignee: Fractus, S.A., Barcelona (ES)

( * ) Notice: Subject to any disclaimer, the term of this patent is extended or adjusted under 35 U.S.C. 154(b) by 0 days.

This patent is subject to a terminal disclaimer.

(21) Appl. No.: 13/036,819

(22) Filed: Feb. 28, 2011

(65) Prior Publication Data

US 2011/0175777 A1 Jul. 21, 2011

Related U.S. Application Data

(63) Continuation of application No. 12/400,888, filed on Mar. 10, 2009, now Pat. No. 8,009,111, which is a continuation of application No. 11/780,932, filed on Jul. 20, 2007, now Pat. No. 7,528,782, which is a continuation of application No. 11/179,257, filed on Jul. 12, 2005, now Pat. No. 7,397,431, which is a continuation of application No. 11/102,390, filed on Apr. 8, 2005, now Pat. No. 7,123,208, which is a continuation of application No. 10/963,080, filed on Oct. 12, 2004, now Pat. No. 7,015,868, which is a continuation of application No. 10/102,568, filed on Mar. 18, 2002, now abandoned, which is a continuation of application No. PCT/ES99/00296, filed on Sep. 20, 1999.

(51) Int. Cl.
*H01Q 1/24* (2006.01)

(52) U.S. Cl. ..... 343/702; 343/700 MS

(58) Field of Classification Search ..... 343/700 MS, 343/702, 829, 846
See application file for complete search history.

(56) References Cited

U.S. PATENT DOCUMENTS 1,621,455 A 3/1899 Hess et al.
2,646,850 A 4/1900 Lindemeyr
(Continued)

FOREIGN PATENT DOCUMENTS

AU 2438199 9/1999
(Continued)

OTHER PUBLICATIONS

Heberling, D. ; Geissler, M. Trends on handset antennas, 29th European Microwave Conference, 1999.

(Continued)

*Primary Examiner* — David G Phan
(74) *Attorney, Agent, or Firm* — Howison & Arnott, L.L.P.

(57) ABSTRACT

An apparatus including a wireless communications device has an internal antenna system located within the wireless communications device. The internal antenna system includes a passive antenna set comprising at least one antenna element having at least one multilevel structure, a feeding point to the at least one antenna element and a ground plane. The feeding point and a point on the ground plane define an input/output port for said passive antenna set. The passive antenna set provides a similar impedance level and radiation pattern at two or more frequency bands such that the passive antenna set is capable of both transmitting and receiving wireless signals on selected channels. The selected channels are selectable from a plurality of channels throughout an entire frequency range within each of said two or more frequency bands.

24 Claims, 14 Drawing Sheets

U.S. PATENT DOCUMENTS

| | | | | |
|---|---|---|---|---|
| 2,759,183 | A | | 8/1958 | Woodward, Jr. |
| 3,079,602 | A | | 2/1963 | Hamel et al. |
| 3,521,284 | A | | 7/1970 | Shelton, Jr. et al. |
| 3,599,214 | A | | 8/1971 | Altmayer |
| 3,605,102 | A | | 9/1971 | Frye |
| 3,622,890 | A | | 11/1971 | Fujimoto et al. |
| 3,680,135 | A | | 7/1972 | Boyer |
| 3,683,376 | A | | 8/1972 | Pronovost |
| 3,689,929 | A | | 9/1972 | Moody |
| 3,818,490 | A | | 6/1974 | Leahy |
| 3,858,221 | A | * | 12/1974 | Harrison et al. ..... 343/815 |
| 3,967,276 | A | | 6/1976 | Goubau |
| 3,969,730 | A | | 7/1976 | Fuchser |
| 4,021,810 | A | | 5/1977 | Urpo et al. |
| 4,024,542 | A | | 5/1977 | Ikawa et al. |
| 4,038,662 | A | | 7/1977 | Turner |
| 4,131,893 | A | | 12/1978 | Munson et al. |
| 4,141,014 | A | | 2/1979 | Sletten |
| 4,141,016 | A | | 2/1979 | Nelson |
| 4,157,548 | A | | 6/1979 | Kaloi |
| 4,218,682 | A | | 8/1980 | Yu et al. |
| 4,243,990 | A | | 1/1981 | Nemit et al. |
| 4,290,071 | A | | 9/1981 | Fenwick |
| 4,318,109 | A | | 3/1982 | Weathers |
| 4,356,492 | A | | 10/1982 | Kaloi |
| 4,398,199 | A | | 8/1983 | Makimoto et al. |
| 4,424,500 | A | | 1/1984 | Viola et al. |
| 4,471,358 | A | | 9/1984 | Glasser |
| 4,471,493 | A | | 9/1984 | Schober |
| 4,504,834 | A | | 3/1985 | Garay et al. |
| 4,509,056 | A | | 4/1985 | Ploussios |
| 4,517,572 | A | | 5/1985 | Dixon |
| 4,518,968 | A | | 5/1985 | Hately |
| 4,521,784 | A | | 6/1985 | Nemet |
| 4,527,164 | A | | 7/1985 | Cestaro et al. |
| 4,531,130 | A | | 7/1985 | Powers et al. |
| 4,536,725 | A | | 8/1985 | Hubler |
| 4,543,581 | A | | 9/1985 | Nemet |
| 4,553,146 | A | | 11/1985 | Butler |
| 4,571,595 | A | | 2/1986 | Phillips et al. |
| 4,584,709 | A | | 4/1986 | Kneisel et al. |
| 4,590,614 | A | | 5/1986 | Erat |
| 4,608,572 | A | | 8/1986 | Blakney |
| 4,623,894 | A | | 11/1986 | Lee et al. |
| 4,656,642 | A | | 4/1987 | Apostolos et al. |
| 4,673,948 | A | | 6/1987 | Kuo |
| 4,709,239 | A | | 11/1987 | Herrick |
| 4,723,305 | A | | 2/1988 | Phillips et al. |
| 4,730,195 | A | | 3/1988 | Phillips et al. |
| 4,792,809 | A | | 12/1988 | Gilbert et al. |
| 4,794,396 | A | | 12/1988 | Pothier |
| 4,799,156 | A | | 1/1989 | Shavit et al. |
| 4,827,271 | A | | 5/1989 | Berneking |
| 4,839,660 | A | | 6/1989 | Hadzoglou |
| 4,843,468 | A | | 6/1989 | Drewery |
| 4,847,629 | A | | 7/1989 | Shimazaki |
| 4,849,766 | A | | 7/1989 | Inaba et al. |
| 4,857,939 | A | | 8/1989 | Shimazaki |
| 4,860,019 | A | | 8/1989 | Jiang |
| 4,890,114 | A | | 12/1989 | Egashira |
| 4,894,663 | A | | 1/1990 | Urbish et al. |
| 4,907,011 | A | | 3/1990 | Kuo |
| 4,912,481 | A | | 3/1990 | Mace et al. |
| 4,975,711 | A | | 12/1990 | Lee |
| 5,014,346 | A | | 5/1991 | Phillips |
| 5,030,963 | A | | 7/1991 | Tadama |
| 5,033,385 | A | | 7/1991 | Zeren |
| 5,046,080 | A | | 9/1991 | Lee et al. |
| 5,061,944 | A | | 10/1991 | Powers et al. |
| 5,074,214 | A | | 12/1991 | Zeren |
| 5,075,691 | A | | 12/1991 | Garay |
| 5,138,328 | A | | 8/1992 | Zibrik et al. |
| 5,164,980 | A | | 11/1992 | Bush et al. |
| 5,168,472 | A | | 12/1992 | Lockwood |
| 5,172,084 | A | | 12/1992 | Fiedziuszko et al. |
| 5,197,140 | A | | 3/1993 | Balmer |
| 5,200,756 | A | | 4/1993 | Feller |
| 5,210,542 | A | | 5/1993 | Pett et al. |
| 5,212,742 | A | | 5/1993 | Normile et al. |
| 5,212,777 | A | | 5/1993 | Gove et al. |
| 5,214,434 | A | | 5/1993 | Hau |
| 5,218,370 | A | | 6/1993 | Blaese |
| 5,227,804 | A | | 7/1993 | Oda |
| 5,227,808 | A | | 7/1993 | Davis |
| 5,245,350 | A | | 9/1993 | Sroka |
| 5,248,988 | A | | 9/1993 | Makino |
| 5,255,002 | A | | 10/1993 | Day |
| 5,257,032 | A | | 10/1993 | Diamond et al. |
| 5,258,765 | A | | 11/1993 | Dorrie et al. |
| 5,262,791 | A | | 11/1993 | Tsuda et al. |
| 5,300,936 | A | | 4/1994 | Izadian |
| 5,307,075 | A | | 4/1994 | Huynh |
| 5,337,063 | A | | 8/1994 | Takahira |
| 5,337,065 | A | | 8/1994 | Bonnet et al. |
| 5,347,291 | A | | 9/1994 | Moore |
| 5,355,114 | A | | 10/1994 | Sutterlin et al. |
| 5,355,144 | A | | 10/1994 | Walton |
| 5,355,318 | A | | 10/1994 | Dionnet et al. |
| 5,361,061 | A | | 11/1994 | Mays |
| 5,363,114 | A | | 11/1994 | Shoemaker |
| 5,373,300 | A | | 12/1994 | Jenness et al. |
| 5,394,163 | A | | 2/1995 | Bullen et al. |
| 5,402,134 | A | | 3/1995 | Miller et al. |
| 5,410,322 | A | | 4/1995 | Sonoda |
| 5,420,599 | A | | 5/1995 | Erkocevic |
| 5,422,651 | A | | 6/1995 | Chang |
| 5,438,357 | A | | 8/1995 | McNelley |
| 5,451,965 | A | | 9/1995 | Matsumoto |
| 5,451,968 | A | | 9/1995 | Emery |
| 5,453,751 | A | | 9/1995 | Tsukamoto et al. |
| 5,453,752 | A | | 9/1995 | Wang |
| 5,457,469 | A | | 10/1995 | Diamond et al. |
| 5,471,224 | A | | 11/1995 | Barkeshli |
| 5,493,702 | A | | 2/1996 | Crowley et al. |
| 5,495,261 | A | | 2/1996 | Baker et al. |
| 5,508,709 | A | | 4/1996 | Krenz et al. |
| 5,534,877 | A | | 7/1996 | Sorbello et al. |
| 5,537,367 | A | | 7/1996 | Lockwood et al. |
| 5,557,293 | A | | 9/1996 | McCoy |
| 5,559,524 | A | | 9/1996 | Takei et al. |
| 5,563,882 | A | | 10/1996 | Bruno et al. |
| 5,569,879 | A | | 10/1996 | Gloton et al. |
| 5,572,223 | A | | 11/1996 | Phillips |
| H1631 | H | | 2/1997 | Montgomery et al. |
| 5,600,844 | A | | 2/1997 | Shaw et al. |
| 5,608,417 | A | | 3/1997 | De Vall |
| 5,619,205 | A | | 4/1997 | Johnson |
| 5,621,913 | A | | 4/1997 | Tuttle et al. |
| 5,627,550 | A | | 5/1997 | Sanad |
| 5,646,635 | A | | 7/1997 | Cockson et al. |
| 5,646,637 | A | | 7/1997 | Miller |
| 5,657,028 | A | | 8/1997 | Sanad |
| 5,672,345 | A | | 9/1997 | Curtiss, III |
| 5,680,144 | A | | 10/1997 | Sanad |
| 5,684,672 | A | | 11/1997 | Karidis et al. |
| 5,703,600 | A | | 12/1997 | Burrell et al. |
| 5,710,458 | A | | 1/1998 | Iwasaki |
| 5,712,640 | A | | 1/1998 | Andou et al. |
| 5,734,352 | A | | 3/1998 | Seward et al. |
| 5,742,258 | A | | 4/1998 | Kumpfbeck et al. |
| 5,764,190 | A | | 6/1998 | Murch et al. |
| 5,767,811 | A | | 6/1998 | Mandai et al. |
| 5,767,814 | A | | 6/1998 | Conroy et al. |
| 5,790,080 | A | | 8/1998 | Apostolos |
| 5,798,688 | A | | 8/1998 | Schofield |
| 5,805,113 | A | | 9/1998 | Ogino et al. |
| 5,808,586 | A | | 9/1998 | Phillips et al. |
| 5,809,433 | A | | 9/1998 | Thompson |
| 5,821,907 | A | | 10/1998 | Zhu et al. |
| 5,841,403 | A | | 11/1998 | West |
| 5,861,845 | A | | 1/1999 | Lee et al. |
| 5,870,066 | A | | 2/1999 | Asakura et al. |
| 5,872,546 | A | | 2/1999 | Ihara et al. |
| 5,898,404 | A | | 4/1999 | Jou |
| 5,903,240 | A | | 5/1999 | Kawahata et al. |
| 5,913,174 | A | | 6/1999 | Casarez et al. |
| 5,918,183 | A | | 6/1999 | Janky |

5,926,139 A 7/1999 Korisch
5,926,141 A 7/1999 Lindenmeier et al.
5,926,208 A 7/1999 Noonen et al.
5,929,822 A 7/1999 Kumpfbeck et al.
5,929,825 A 7/1999 Niu
5,936,583 A 8/1999 Sekine et al.
5,936,587 A 8/1999 Gudilev
5,943,020 A 8/1999 Liebendoerfer et al.
5,945,954 A 8/1999 Johnson
5,963,871 A 10/1999 Zhinong et al.
5,966,097 A 10/1999 Fukasawa et al.
5,966,098 A 10/1999 Qi et al.
5,969,689 A 10/1999 Martek
5,973,648 A 10/1999 Lindenmeier et al.
5,973,651 A 10/1999 Suesada et al.
5,982,337 A 11/1999 Newman et al.
5,986,609 A 11/1999 Spall
5,986,610 A 11/1999 Miron
5,986,615 A 11/1999 Westfall et al.
5,990,838 A 11/1999 Burns et al.
5,995,052 A 11/1999 Sadler
6,002,367 A 12/1999 Engblom et al.
6,005,524 A 12/1999 Hayes et al.
6,008,764 A 12/1999 Ollikainen et al.
6,008,774 A 12/1999 Wu
6,011,518 A 1/2000 Yamagishi et al.
6,011,699 A 1/2000 Murray
6,014,114 A 1/2000 Westfall et al.
6,018,319 A 1/2000 Lindmark
6,028,568 A 2/2000 Asakura et al.
6,031,495 A 2/2000 Simmons et al.
6,031,499 A 2/2000 Dichter
6,031,505 A 2/2000 Qi et al.
6,034,645 A 3/2000 Legay et al.
6,037,902 A 3/2000 Pinhas et al.
6,037,907 A 3/2000 Ha
6,039,583 A 3/2000 Korsunsky et al.
6,040,803 A 3/2000 Spall
6,043,783 A 3/2000 Endo et al.
6,049,314 A 4/2000 Munson et al.
6,054,953 A 4/2000 Lindmark
6,057,801 A 5/2000 Desclos et al.
6,069,592 A 5/2000 Wass
6,072,434 A 6/2000 Papatheodorou
6,075,485 A 6/2000 Lilly et al.
6,075,494 A 6/2000 Milroy
6,075,500 A 6/2000 Kurz et al.
6,078,294 A 6/2000 Mitarai
6,081,237 A 6/2000 Sato et al.
6,087,990 A 7/2000 Thill et al.
6,091,365 A 7/2000 Derneryd et al.
6,094,179 A 7/2000 Davidson
6,097,339 A 8/2000 Filipovic
6,097,345 A 8/2000 Walton
6,100,855 A 8/2000 Vinson et al.
6,104,347 A 8/2000 Snygg et al.
6,104,349 A 8/2000 Cohen
6,107,920 A 8/2000 Eberhardt et al.
6,111,545 A 8/2000 Saari
6,112,102 A 8/2000 Zhinong
6,114,674 A 9/2000 Baugh et al.
6,122,533 A 9/2000 Zhang et al.
6,124,830 A 9/2000 Yuanzhu
6,127,977 A 10/2000 Cohen
6,130,651 A 10/2000 Yanagisawa
6,131,042 A 10/2000 Lee et al.
6,133,883 A 10/2000 Munson et al.
6,140,966 A 10/2000 Pankinaho
6,140,969 A 10/2000 Lindenmeier et al.
6,140,975 A 10/2000 Cohen
6,141,540 A 10/2000 Richards
6,147,652 A 11/2000 Sekine
6,147,655 A 11/2000 Roesner
6,154,180 A 11/2000 Padrick
6,157,348 A 12/2000 Openlander
6,160,513 A 12/2000 Davidson et al.
6,166,694 A 12/2000 Ying
6,172,618 B1 1/2001 Hakozaki et al.
6,175,333 B1 1/2001 Smith et al.
6,181,281 B1 1/2001 Desclos et al.
6,195,048 B1 2/2001 Chiba et al.
6,198,442 B1 3/2001 Rutkowski
6,198,943 B1 * 3/2001 Sadler et al. ..... 455/553.1
6,201,501 B1 3/2001 Arkko
6,204,826 B1 3/2001 Rutkowski et al.
6,211,824 B1 4/2001 Holden et al.
6,211,826 B1 4/2001 Aoki
6,211,834 B1 4/2001 Durham et al.
6,211,889 B1 4/2001 Stoutamire
6,215,447 B1 4/2001 Johnson
6,215,474 B1 4/2001 Shah
6,218,989 B1 4/2001 Schneider et al.
6,218,991 B1 4/2001 Sanad
6,218,992 B1 4/2001 Sadler et al.
6,222,497 B1 4/2001 Hu et al.
6,236,366 B1 5/2001 Yamamoto
6,236,372 B1 5/2001 Lindenmeier et al.
6,239,752 B1 5/2001 Blanchard
6,239,765 B1 5/2001 Johnson
6,243,592 B1 6/2001 Nakada
6,255,994 B1 7/2001 Saito
6,255,995 B1 7/2001 Asano et al.
6,259,407 B1 7/2001 Tran
6,260,088 B1 7/2001 Gove et al.
6,266,023 B1 7/2001 Nagy et al.
6,266,538 B1 7/2001 Waldron
6,268,836 B1 7/2001 Faulkner et al.
6,271,794 B1 8/2001 Geeraert
6,281,846 B1 8/2001 Puente Baliarda et al.
6,285,326 B1 9/2001 Diximus et al.
6,285,342 B1 9/2001 Brady et al.
6,288,680 B1 9/2001 Tsuru
6,292,154 B1 9/2001 Deguchi et al.
6,297,711 B1 10/2001 Seward et al.
6,300,910 B1 10/2001 Kim
6,300,914 B1 10/2001 Yang
6,304,220 B1 10/2001 Herve et al.
6,304,222 B1 10/2001 Smith et al.
6,307,511 B1 10/2001 Ying et al.
6,307,512 B1 10/2001 Geeraert
6,310,578 B1 10/2001 Ying
6,317,083 B1 11/2001 Johnson et al.
6,320,543 B1 11/2001 Ohata et al.
6,323,811 B1 11/2001 Tsubaki et al.
6,326,919 B1 12/2001 Diximus et al.
6,326,927 B1 12/2001 Johnson et al.
6,327,485 B1 12/2001 Waldron
6,329,951 B1 12/2001 Wen et al.
6,329,954 B1 12/2001 Fuchs et al.
6,329,962 B2 12/2001 Ying
6,333,716 B1 12/2001 Pontoppidan
6,333,720 B1 12/2001 Gottl et al.
6,342,861 B1 1/2002 Packard
6,343,208 B1 1/2002 Ying
6,346,914 B1 2/2002 Annamaa
6,348,892 B1 2/2002 Annamaa et al.
6,351,241 B1 2/2002 Wass
6,352,434 B1 3/2002 Emmert
6,353,443 B1 3/2002 Ying
6,360,105 B2 3/2002 Nakada et al.
6,362,790 B1 3/2002 Proctor, Jr. et al.
6,366,243 B1 4/2002 Isohatala
6,367,939 B1 4/2002 Carter et al.
6,373,447 B1 4/2002 Rostoker et al.
6,377,217 B1 4/2002 Zhu et al.
6,380,895 B1 4/2002 Moren et al.
6,380,902 B2 4/2002 Duroux
6,381,471 B1 4/2002 Dvorkin
6,384,790 B2 5/2002 Dishart
6,384,793 B2 5/2002 Scordilis
6,388,626 B1 5/2002 Gamalielsson et al.
6,396,444 B1 5/2002 Goward
6,400,339 B1 6/2002 Edvardsson et al.
6,407,710 B2 6/2002 Keilen et al.
6,408,190 B1 6/2002 Ying
6,417,810 B1 7/2002 Huels et al.
6,417,816 B2 7/2002 Sadler et al.
6,421,014 B1 7/2002 Sanad

| | | | | |
|---|---|---|---|---|
| 6,421,024 | B1 | 7/2002 | Stolle | |
| 6,424,315 | B1 | 7/2002 | Glenn et al. | |
| 6,429,818 | B1 | 8/2002 | Johnson et al. | |
| 6,431,712 | B1 | 8/2002 | Turnbull | |
| 6,445,352 | B1 | 9/2002 | Cohen | |
| 6,452,549 | B1 | 9/2002 | Lo | |
| 6,452,553 | B1 | 9/2002 | Cohen | |
| 6,456,249 | B1 | 9/2002 | Johnson et al. | |
| 6,470,174 | B1 | 10/2002 | Schefte et al. | |
| 6,476,766 | B1 | 11/2002 | Cohen | |
| 6,480,158 | B2 | 11/2002 | Apostolos | |
| 6,483,462 | B2 | 11/2002 | Weinberger | |
| 6,489,925 | B2 | 12/2002 | Thursby et al. | |
| 6,492,952 | B1 | 12/2002 | Hu | |
| 6,496,154 | B2 | 12/2002 | Gyenes | |
| 6,498,586 | B2 | 12/2002 | Pankinaho | |
| 6,498,588 | B1 | 12/2002 | Callaghan | |
| 6,525,691 | B2 | 2/2003 | Varadan et al. | |
| 6,538,604 | B1 | 3/2003 | Isohatala et al. | |
| 6,539,608 | B2 | 4/2003 | McKinnon et al. | |
| 6,545,640 | B1 | 4/2003 | Herve et al. | |
| 6,552,690 | B2 | 4/2003 | Veerasamy | |
| 6,570,538 | B2 | 5/2003 | Vaisanen | |
| 6,603,434 | B2 | 8/2003 | Lindenmeier et al. | |
| 6,628,784 | B1 | 9/2003 | Montane Condemines | |
| 6,639,560 | B1 | 10/2003 | Kadambi et al. | |
| 6,650,294 | B2 | 11/2003 | Ying et al. | |
| 6,693,603 | B1 | 2/2004 | Smith et al. | |
| 6,697,024 | B2 | 2/2004 | Fuerst et al. | |
| 6,707,428 | B2 | 3/2004 | Gram | |
| 6,741,210 | B2 | 5/2004 | Brachat et al. | |
| 6,756,944 | B2 | 6/2004 | Tessier et al. | |
| 6,812,893 | B2 | 11/2004 | Waterman | |
| 6,831,606 | B2 | 12/2004 | Sajadinia | |
| 6,897,830 | B2 | 5/2005 | Bae et al. | |
| 6,937,191 | B2 | 8/2005 | Puente Baliarda | |
| 6,937,196 | B2 * | 8/2005 | Korva | 343/702 |
| 6,943,730 | B2 | 9/2005 | Poilasne | |
| 6,977,808 | B2 | 12/2005 | Lam | |
| 6,980,158 | B2 | 12/2005 | Iguchi et al. | |
| 6,995,720 | B2 | 2/2006 | Shikata | |
| 7,015,868 | B2 | 3/2006 | Puente et al. | |
| 7,047,040 | B2 | 5/2006 | Kim | |
| 7,072,698 | B2 | 7/2006 | Underbrink et al. | |
| 7,091,911 | B2 | 8/2006 | Qi et al. | |
| 7,095,372 | B2 | 8/2006 | Soler Castany et al. | |
| 7,116,273 | B2 | 10/2006 | Morikawa et al. | |
| 7,119,748 | B2 * | 10/2006 | Autti | 343/702 |
| 7,123,208 | B2 | 10/2006 | Puente Baliarda et al. | |
| 7,126,537 | B2 | 10/2006 | Cohen | |
| 7,202,818 | B2 | 4/2007 | Anguera | |
| 7,256,743 | B2 | 8/2007 | Korva | |
| 7,256,751 | B2 | 8/2007 | Cohen | |
| 7,312,762 | B2 | 12/2007 | Puente Ballarda | |
| 7,342,553 | B2 | 3/2008 | Soler Castany et al. | |
| 7,388,549 | B2 * | 6/2008 | Chiang | 343/713 |
| 7,394,432 | B2 | 7/2008 | Baliarda et al. | |
| 7,397,431 | B2 | 7/2008 | Baliarda et al. | |
| 7,403,159 | B2 * | 7/2008 | Gooshchin | 343/700 MS |
| 7,528,782 | B2 | 5/2009 | Baliarda et al. | |
| 7,903,034 | B2 | 3/2011 | Anguera et al. | |
| 7,911,014 | B2 | 3/2011 | Doan | |
| 2001/0011964 | A1 | 8/2001 | Sadler | |
| 2001/0018793 | A1 | 9/2001 | McKinnon | |
| 2001/0050635 | A1 | 12/2001 | Weinberger | |
| 2001/0050636 | A1 | 12/2001 | Weinberger | |
| 2001/0050638 | A1 | 12/2001 | Ishitobi et al. | |
| 2002/0000940 | A1 | 1/2002 | Moren et al. | |
| 2002/0000942 | A1 | 1/2002 | Duroux | |
| 2002/0025839 | A1 | 2/2002 | Usui | |
| 2002/0036594 | A1 | 3/2002 | Gyenes | |
| 2002/0058539 | A1 | 5/2002 | Underbrink | |
| 2002/0105468 | A1 | 8/2002 | Tessier et al. | |
| 2002/0109633 | A1 | 8/2002 | Ow et al. | |
| 2002/0126054 | A1 | 9/2002 | Fuerst | |
| 2002/0126055 | A1 | 9/2002 | Lindenmeier | |
| 2002/0140615 | A1 | 10/2002 | Carles et al. | |
| 2002/0171601 | A1 | 11/2002 | Puente | |
| 2002/0175866 | A1 | 11/2002 | Gram | |
| 2002/0190904 | A1 | 12/2002 | Cohen | |
| 2003/0160723 | A1 | 8/2003 | Cohen | |
| 2003/0201942 | A1 | 10/2003 | Poilasne | |
| 2004/0145529 | A1 | 7/2004 | Iguchi | |
| 2006/0001576 | A1 * | 1/2006 | Contopanagos | 343/702 |
| 2006/0033664 | A1 | 2/2006 | Soler | |
| 2006/0077101 | A1 | 4/2006 | Puente | |
| 2008/0252536 | A1 | 10/2008 | Anguera | |

FOREIGN PATENT DOCUMENTS

| | | |
|---|---|---|
| CA | 2 416 437 | 1/2002 |
| CN | 2224466 | 4/1996 |
| CN | 1559093 | 12/2004 |
| DE | 333 37 941 | 5/1985 |
| DE | 4313397 | 11/1994 |
| DE | 195 11 300 | 10/1996 |
| DE | 199 29 689 | 1/2001 |
| DE | 102 06 426 | 11/2002 |
| DE | 101 38 265 | 7/2003 |
| DE | 102 04 079 | 8/2003 |
| EP | 0 096 847 | 12/1983 |
| EP | 0 297 813 | 6/1988 |
| EP | 0 358 090 | 8/1989 |
| EP | 0 431 764 | 6/1991 |
| EP | 0 543 645 | 5/1993 |
| EP | 0 571 124 | 11/1993 |
| EP | 0 688 040 | 12/1995 |
| EP | 1515392 | 8/1996 |
| EP | 0 740 176 | 12/1996 |
| EP | 0 753 897 | 1/1997 |
| EP | 0 765 001 | 3/1997 |
| EP | 0 814 536 | 12/1997 |
| EP | 0590671 B1 | 12/1997 |
| EP | 0 843 905 | 5/1998 |
| EP | 0 856 907 | 8/1998 |
| EP | 0871 238 | 10/1998 |
| EP | 0 892 459 | 1/1999 |
| EP | 0 902 472 | 3/1999 |
| EP | 0 929 121 | 7/1999 |
| EP | 0 932 219 | 7/1999 |
| EP | 0938158 | 8/1999 |
| EP | 0 942 488 | 9/1999 |
| EP | 0 969 375 | 1/2000 |
| EP | 0 986 130 | 3/2000 |
| EP | 0 993 070 | 4/2000 |
| EP | 0 997 974 | 5/2000 |
| EP | 0997972 | 5/2000 |
| EP | 1 018 777 | 7/2000 |
| EP | 1 018 779 | 7/2000 |
| EP | 1 024 552 | 8/2000 |
| EP | 1 026 774 | 8/2000 |
| EP | 1 063 721 | 12/2000 |
| EP | 1 067 627 | 1/2001 |
| EP | 1 071 161 | 1/2001 |
| EP | 1 077 508 | 2/2001 |
| EP | 1 079 462 | 2/2001 |
| EP | 1 083 624 | 3/2001 |
| EP | 1 094 545 | 4/2001 |
| EP | 1 096 602 | 5/2001 |
| EP | 1 148 581 | 10/2001 |
| EP | 1 198 027 | 4/2002 |
| EP | 1 237 224 | 9/2002 |
| EP | 1258054 | 11/2002 |
| EP | 1 267 438 | 12/2002 |
| EP | 1 317 018 | 6/2003 |
| EP | 1 326 302 | 7/2003 |
| EP | 1 378 961 | 1/2004 |
| EP | 1 396 906 | 3/2004 |
| EP | 1 401 050 | 3/2004 |
| EP | 1 414 106 | 4/2004 |
| EP | 1 424 747 | 6/2004 |
| EP | 1 443 595 | 8/2004 |
| EP | 1 453 140 | 9/2004 |
| EP | 1 465 291 | 10/2004 |
| EP | 1148581 | 10/2004 |
| EP | 1593083 | 11/2005 |
| ES | 2 112 163 | 3/1998 |
| ES | 2 142 280 | 5/1998 |
| ES | ESP 009902216 | 7/2001 |

| | | | |
|---|---|---|---|
| FR | 2 543 744 | | 10/1984 |
| FR | 2 704 359 | | 10/1994 |
| FR | 2 837 339 | | 9/2003 |
| GB | 2 112 579 | | 7/1983 |
| GB | 2 161 026 | | 1/1986 |
| GB | 2 215 136 | | 9/1989 |
| GB | 2 280 163 | | 9/1989 |
| GB | 2317994 | A1 | 4/1998 |
| GB | 2 330 951 | | 5/1999 |
| GB | 2 355 116 | | 4/2001 |
| GB | 2 361 584 | | 10/2001 |
| JP | 53009451 | | 1/1978 |
| JP | 55123203 | | 9/1980 |
| JP | 55-147806 | | 11/1980 |
| JP | 5-7109 | | 1/1983 |
| JP | 5-129816 | | 5/1983 |
| JP | 5-267916 | | 10/1983 |
| JP | 03156847 | | 1/1993 |
| JP | 5308223 | | 11/1993 |
| JP | 5-347507 | | 12/1993 |
| JP | 06037531 | | 2/1994 |
| JP | 6085530 | | 3/1994 |
| JP | 6-204908 | | 7/1994 |
| JP | H6-252629 | | 9/1994 |
| JP | 9-252214 | | 9/1997 |
| JP | 9246852 | | 9/1997 |
| JP | 10-93332 | | 4/1998 |
| JP | H10-163748 | | 6/1998 |
| JP | 10-209774 | | 8/1998 |
| JP | 10303637 | | 11/1998 |
| JP | 1127042 | | 1/1999 |
| JP | 11004113 | | 1/1999 |
| JP | 11-88032 | | 3/1999 |
| JP | 11220319 | | 8/1999 |
| JP | 11-317610 | | 11/1999 |
| JP | 2002-158529 | | 5/2002 |
| JP | 3449484 | | 9/2003 |
| JP | 20003 28 3230 | | 10/2003 |
| JP | 11136015 | | 4/2005 |
| NZ | 508835 | | 4/2001 |
| RU | 2 170 478 | | 7/2001 |
| SE | 518 988 | | 12/2002 |
| TW | 5 545 71 | | 9/2003 |
| WO | 93/12559 | | 6/1993 |
| WO | 02/096166 | | 10/1994 |
| WO | 94/24723 | | 10/1994 |
| WO | 94/24772 | | 10/1994 |
| WO | 95/05012 | | 2/1995 |
| WO | 95/11530 | | 4/1995 |
| WO | 96/03783 | | 2/1996 |
| WO | 96/04691 | | 2/1996 |
| WO | 96/10276 | | 4/1996 |
| WO | 96/27219 | | 9/1996 |
| WO | 96/29755 | | 9/1996 |
| WO | 96/38881 | | 12/1996 |
| WO | 97/06578 | | 2/1997 |
| WO | 97/11507 | | 3/1997 |
| WO | 97/32355 | | 9/1997 |
| WO | 97/33338 | | 9/1997 |
| WO | 97/35360 | | 9/1997 |
| WO | 97/47054 | | 12/1997 |
| WO | 98/05088 | | 2/1998 |
| WO | 98/12771 | | 3/1998 |
| WO | 98/20578 | | 5/1998 |
| WO | 98/33234 | | 7/1998 |
| WO | 9831067 | | 7/1998 |
| WO | 98/36469 | | 8/1998 |
| WO | 98/39814 | | 9/1998 |
| WO | 88/09065 | | 11/1998 |
| WO | 99-03166 | | 1/1999 |
| WO | 99/03167 | | 1/1999 |
| WO | 99/03168 | | 1/1999 |
| WO | 9956347 | | 4/1999 |
| WO | 99/25042 | | 5/1999 |
| WO | 99/25044 | | 5/1999 |
| WO | 9922420 | | 5/1999 |
| WO | 99/27607 | | 6/1999 |
| WO | 99/27608 | | 6/1999 |
| WO | 9931757 | | 6/1999 |
| WO | 99/35691 | | 7/1999 |
| WO | 99/43048 | | 8/1999 |
| WO | 99/56345 | | 11/1999 |
| WO | 99/57785 | | 11/1999 |
| WO | 99/60665 | | 11/1999 |
| WO | 99/62139 | | 12/1999 |
| WO | 99/65102 | | 12/1999 |
| WO | 00/01028 | | 1/2000 |
| WO | 00/03451 | | 1/2000 |
| WO | 00/03453 | | 1/2000 |
| WO | 00/22695 | | 4/2000 |
| WO | 00/30267 | | 5/2000 |
| WO | 00/31825 | | 6/2000 |
| WO | 00/36700 | | 6/2000 |
| WO | 00/49680 | | 8/2000 |
| WO | 00/52784 | | 9/2000 |
| WO | 00/52787 | | 9/2000 |
| WO | 00/57511 | | 9/2000 |
| WO | 0055939 | | 9/2000 |
| WO | 0067342 | A1 | 11/2000 |
| WO | 00/08712 | | 12/2000 |
| WO | 00/74172 | | 12/2000 |
| WO | 00/77884 | | 12/2000 |
| WO | 01/03238 | | 1/2001 |
| WO | 01/05048 | | 1/2001 |
| WO | 01/06594 | | 1/2001 |
| WO | 01/08255 | | 2/2001 |
| WO | 01/08257 | | 2/2001 |
| WO | 01/08260 | | 2/2001 |
| WO | 01/09976 | | 2/2001 |
| WO | 01/11721 | | 2/2001 |
| WO | 01/13464 | | 2/2001 |
| WO | 01/15270 | | 3/2001 |
| WO | 01/15271 | | 3/2001 |
| WO | 01/17061 | | 3/2001 |
| WO | 01/17063 | | 3/2001 |
| WO | 01/17064 | | 3/2001 |
| WO | 01/18904 | | 3/2001 |
| WO | 01/18909 | | 3/2001 |
| WO | 01/20714 | | 3/2001 |
| WO | 01/20927 | | 3/2001 |
| WO | 01/22528 | | 3/2001 |
| WO | 01/24316 | | 4/2001 |
| WO | 01/26182 | | 4/2001 |
| WO | 01/28035 | | 4/2001 |
| WO | 01/29927 | | 4/2001 |
| WO | W0/0124314 | | 4/2001 |
| WO | 01/31739 | | 5/2001 |
| WO | 01/33665 | | 5/2001 |
| WO | 01/35491 | | 5/2001 |
| WO | 01/37369 | | 5/2001 |
| WO | 01/37370 | | 5/2001 |
| WO | 01/39321 | | 5/2001 |
| WO | 01/41252 | | 6/2001 |
| WO | 01/48861 | | 7/2001 |
| WO | 01/54225 | | 7/2001 |
| WO | 01/65636 | | 9/2001 |
| WO | 01/73890 | | 10/2001 |
| WO | 01/78192 | | 10/2001 |
| WO | 01/82410 | | 11/2001 |
| WO | 01/86753 | | 11/2001 |
| WO | 01/89031 | | 11/2001 |
| WO | 02/01668 | | 1/2002 |
| WO | 02/35646 | | 5/2002 |
| WO | 02/35652 | | 5/2002 |
| WO | 02/054538 | | 7/2002 |
| WO | 02/065583 | | 8/2002 |
| WO | O94/24722 | | 8/2002 |
| WO | 02/071535 | | 9/2002 |
| WO | 02/078123 | | 10/2002 |
| WO | 02/078124 | | 10/2002 |
| WO | 02/080306 | | 10/2002 |
| WO | 02/087014 | | 10/2002 |
| WO | 02/089254 | | 11/2002 |
| WO | 02/091518 | | 11/2002 |
| WO | 02/096116 | | 11/2002 |
| WO | 02/103843 | | 12/2002 |
| WO | 03/003503 | | 2/2003 |

| | | |
|---|---|---|
| WO | 03/017421 | 3/2003 |
| WO | 03/023900 | 3/2003 |
| WO | 03/026064 | 3/2003 |

OTHER PUBLICATIONS

Mitra, Raj. Course Small antennas design for molbile handset, UWB, sensors, RFID, tags and other applications and their performance enhancement by using EBGs and metamaterials. EuCAP, 2010.
External photos Nokia mobile 8860 (FCC ID LJPNSW-6NX). FCC, Jul. 1999.
Internall photos Nokia mobile 8860 (FCC ID LJPNSW-6NX). FCC, Jul. 1999.
Infringement Chart—Samsung SCH-R600. Patent: 7528782. Fractus, 2009.
Infringement Chart—Samsung SCH-R800. Fractus, 2009.
Infringement Chart—Samsung SCH-R800. Patent: 7015868. Fractus, 2009.
Infringement Chart—Samsung SCH-R800. Patent: 7123208. Fractus, 2009.
Infringement Chart—Samsung SCH-R800. Patent: 7397431. Fractus, 2009.
Infringement Chart—Samsung SCH-R800. Patent: 7528782. Fractus, 2009.
Infringement Chart—Samsung SCH-U130. Patent: 7528782. Fractus, 2009.
Infringement Chart—Samsung SCH-U310. Fractus, 2009.
Infringement Chart—Samsung SCH-U310. Patent: 7015868. Fractus, 2009.
Infringement Chart—Samsung SCH-U310. Patent: 7123208. Fractus, 2009.
Infringement Chart—Samsung SCH-U310. Patent: 7397431. Fractus, 2009.
Infringement Chart—Samsung SCH-U430. Fractus, 2009.
Infringement Chart—Samsung SCH-U430. Patent: 7015868. Fractus, 2009.
Infringement Chart—Samsung SCH-U430. Patent: 7123208. Fractus, 2009.
Infringement Chart—Samsung SCH-U430. Patent: 7397431. Fractus, 2009.
Infringement Chart—Samsung SCH-U430. Patent: 7528782. Fractus, 2009.
Infringement Chart—Samsung SCH-U470. Fractus, 2009.
Infringement Chart—Samsung SCH-U470. Patent: 7397431. Fractus, 2009.
Infringement Chart—Samsung SCH-U470. Patent: 7015868. Fractus, 2009.
Infringement Chart—Samsung SCH-U470. Patent: 7123208. Fractus, 2009.
Infringement Chart—Samsung SCH-U470. Patent: 7528782. Fractus, 2009.
Infringement Chart—Samsung SCH-U520. Fractus, 2009.
Infringement Chart—Samsung SCH-U520. Patent: 7015868. Fractus, 2009.
Infringement Chart—Samsung SCH-U520. Patent: 7123208. Fractus, 2009.
Infringement Chart—Samsung SCH-U520. Patent: 7394432. Fractus, 2009.
Infringement Chart—Samsung SCH-U520. Patent: 7397431. Fractus, 2009.
Infringement Chart—Samsung SCH-U520. Patent: 7528782. Fractus, 2009.
Infringement Chart—Samsung SCH-U740. Fractus, 2009.
Infringement Chart—Samsung SCH-U740. Patent: 7015868. Fractus, 2009.
Infringement Chart—Samsung SCH-U740. Patent: 7123208. Fractus, 2009.
Infringement Chart—Samsung SCH-U740. Patent: 7397431. Fractus, 2009.
Infringement Chart—Samsung SCH-U740. Patent: 7528782. Fractus, 2009.
Infringement Chart—Samsung SCH-U750. Fractus, 2009.
Infringement Chart—Samsung SCH-U750. Patent: 7015868. Fractus, 2009.
Infringement Chart—Samsung SCH-U750. Patent: 7123208. Fractus, 2009.
Infringement Chart—Samsung SCH-U750. Patent: 7397431. Fractus, 2009.
Infringement Chart—Samsung SCH-U750. Patent: 7528782. Fractus, 2009.
Infringement Chart—Samsung SCH-U940. Fractus, 2009.
Infringement Chart—Samsung SCH-U940. Patent: 7015868. Fractus, 2009.
Infringement Chart—Samsung SCH-U940. Patent: 7123208. Fractus, 2009.
Infringement Chart—Samsung SCH-U940. Patent: 7397431. Fractus, 2009.
Infringement Chart—Samsung SCH-U940. Patent: 7528782. Fractus, 2009.
Infringement Chart—Samsung SCH A127. Fractus, 2009.
Infringement Chart—Samsung SCH U340. Fractus, 2009.
Infringement Chart—Samsung SCH U340. Patent: 7015868. Fractus, 2009.
Infringement Chart—Samsung SCH U340. Patent: 7123208 Fractus, 2009.
Infringement Chart—Samsung SCH U340. Patent: 7397431. Fractus, 2009.
Infringement Chart—Samsung SCH U340. Patent: 7528782. Fractus, 2009.
Infringement Chart—Samsung SCH U410. Patent: 7015868. Fractus, 2009.
Infringement Chart—Samsung SCH U410. Patent: 7123208. Fractus, 2009.
Request for inter partes reexamination of US patent No. 7123208 (U.S. Appl. No. 95/001,389) including exhibits CC-A-CC-C—Samsung Electronics Co. Ltd.
Request for inter partes reexamination of US patent No. 7015868 (U.S. Appl. No. 95/001,390) including exhibits CC-A-CC-G—Samsung Electronics Co. Ltd.
Request for inter partes reexamination of US patent No. 7394432 (U.S. Appl. No. 95/001,483) including exhibits CC-A-CC-L—Samsung Electronics Co. Ltd.
Request for inter partes reexamination of US patent No. 7397431 (U.S. Appl. No. 95/001,482) including exhibits CC-A-CC-L—Samsung Electronics Co. Ltd.
Request for inter partes reexamination of US patent No. 7528782 (U.S. Appl. No. 95/001,455) including exhibits CCA-CCN—Samsung Electronics Co. Ltd.
Request for inter partes reexamination of US patent No. 7015868 (U.S. Appl. No. 95/000,589) including exhibits CC1-CC5—Kyocera Communications Inc.
Request for inter partes reexamination of US patent No. 7123208 (U.S. Appl. No. 95/000,591) including exhibits CC1-CC4—Kyocera Communications Inc.
Request for inter partes reexamination of US patent No. 7528782 (U.S. Appl. No. 95/000,595) including exhibits CC1-CC4—Kyocera Communications Inc.
Request for inter partes reexamination of US patent No. 7394432 (U.S. Appl. No. 95/000,588) including exhibits CC1-CC6—Kyocera Communications Inc.
Request for inter partes reexamination of US patent No. 7397431 (U.S. Appl. No. 95/000,586) including exhibits CC1-CC6—Kyocera Communications Inc.
Request for inter partes reexamination of US patent No. 7015868 (U.S. Appl. No. 95/001,498) including exhibits C1-C6—HTC Corporation—HTC America Inc.
Request for inter partes reexamination of US patent No. 7397431 (U.S. Appl. No. 95/001,497) including exhibits C1-C5—HTC Corporation—HTC America Inc.
Request for inter partes reexamination of US patent No. 7123208 (U.S. Appl. No. 95/001,501) including exhibits C1-C7—HTC Corporation—HTC America Inc.
Request for inter partes reexamination of US patent No. 7528782 (U.S. Appl. No. 95/001,499) including exhibits C1-C6—HTC Corporation—HTC America Inc.

Request for inter partes reexamination of US patent No. 7394432 (U.S. Appl. No. 95/001,500) including exhibits C1-C5—HTC Corporation—HTC America Inc.
Response to Fractus Opposition to Defendants motion for summary judgement of invalidity in the case of *Fractus SA* v. *Samsung Electronics Co. Ltd. et al* Case No. 60:09cv203. Aug. 30, 2010.
Howe , M. Declaration of Micah Howe in support of Fractus SA opposition to defendants' motion for summary judgement of invalidity based on indefiniteness and lack of written description for certain terms. Heim, Payne and Chorus, Aug. 16, 2010.
Fractus's opposition to defendants' motion for summary judgement of invalidity based on indefiniteness and lack of written description for certain terms. Fractus, Aug. 16, 2010.
In the High Court of Justice Chancery Division Patents Court between HTC Corporation and Fractus SA: Claimant's notice to admit facts. Jan. 14, 2011.
Infringement Chart—Samsung Magnet (SGH-A257). Patent: 7123208. Fractus, 2009.
Infringement Chart—Samsung Messager. Fractus, 2009.
Infringement Chart—Samsung Messager. Patent: 7015868. Fractus, 2009.
Infringement Chart—Samsung Messager. Patent: 7123208. Fractus, 2009.
Infringement Chart—Samsung Messager. Patent: 7394432. Fractus, 2009.
Infringement Chart—Samsung Messager. Patent: 7397431. Fractus, 2009.
Infringement Chart—Samsung Messager. Patent: 7528782. Fractus, 2009.
Infringement Chart—Samsung Omnia SGH-I900. Fractus, 2009.
Infringement Chart—Samsung Omnia SGH-I900. Patent: 7015868. Fractus, 2009.
Infringement Chart—Samsung Omnia SGH-I900. Patent: 7123208. Fractus, 2009.
Infringement Chart—Samsung Omnia SGH-I900. Patent: 7394432. Fractus, 2009.
Infringement Chart—Samsung Omnia SGH-I900. Patent: 7397431. Fractus, 2009.
Infringement Chart—Samsung Omnia SGH-I900. Patent: 7528782. Fractus, 2009.
Infringement Chart—Samsung SCH-A630. Fractus, 2009.
Infringement Chart—Samsung SCH-A630. Patent: 7015868. Fractus, 2009.
Infringement Chart—Samsung SCH-A630. Patent: 7397431. Fractus, 2009.
Infringement Chart—Samsung SCH-A630. Patent: 7528782. Fractus, 2009.
Infringement Chart—Samsung SCH-A645. Fractus, 2009.
Infringement Chart—Samsung SCH-A645. Patent: 739432. Fractus, 2009.
Infringement Chart—Samsung SCH-A645. Patent: 7015868. Fractus, 2009.
Infringement Chart—Samsung SCH-A645. Patent: 7123208. Fractus, 2009.
Infringement Chart—Samsung SCH-A645. Patent: 7397431. Fractus, 2009.
Infringement Chart—Samsung SCH-A645. Patent: 7528782. Fractus, 2009.
Infringement Chart—Samsung SCH-A870. Fractus, 2009.
Infringement Chart—Samsung SCH-A870. Patent: 7015868. Fractus, 2009.
Infringement Chart—Samsung SCH-A870. Patent: 7123208. Fractus, 2009.
Infringement Chart—Samsung SCH-A870. Patent: 7397431. Fractus, 2009.
Infringement Chart—Samsung SCH-A870. Patent: 7528782. Fractus, 2009.
Infringement Chart—Samsung SCH-A887. Patent: 7394432. Fractus, 2009.
Infringement Chart—Samsung SCH-I910. Fractus, 2009.
Infringement Chart—Samsung SCH-I910. Patent: 7015868. Fractus, 2009.
Infringement Chart—Samsung SCH-I910. Patent: 7123208. Fractus, 2009.
Infringement Chart—Samsung SCH-I910. Patent: 7394432. Fractus, 2009.
Infringement Chart—Samsung SCH-I910. Patent: 7397431. Fractus, 2009.
Infringement Chart—Samsung SCH-I910. Patent: 7528782. Fractus, 2009.
Infringement Chart—Samsung SCH-R430. Fractus, 2009.
Infringement Chart—Samsung SCH-R430. Patent: 7015868. Fractus, 2009.
Infringement Chart—Samsung SCH-R430. Patent: 7123208. Fractus, 2009.
Infringement Chart—Samsung SCH-R430. Patent: 7394432. Fractus, 2009.
Infringement Chart—Samsung SCH-R430. Patent: 7397431. Fractus, 2009.
Infringement Chart—Samsung SCH-R430. Patent: 7528782. Fractus, 2009.
Infringement Chart—Samsung SCH-R500.. Fractus, 2009.
Infringement Chart—Samsung SCH-R500. Patent: 7015868. Fractus, 2009.
Infringement Chart—Samsung SCH-R500. Patent: 7123208. Fractus, 2009.
Infringement Chart—Samsung SCH-R500. Patent: 7397431. Fractus, 2009.
Infringement Chart—Samsung SCH-R500. Patent: 7528782. Fractus, 2009.
Infringement Chart—Samsung SCH-R600. Fractus, 2009.
Infringement Chart—Samsung SCH-R600. Patent: 7015868. Fractus, 2009.
Infringement Chart—Samsung SCH-R600. Patent: 7123208. Fractus, 2009.
Infringement Chart—Samsung SCH-R600. Patent: 7397431. Fractus, 2009.
Infringement Chart—Samsung SCH U410. Patent: 7397431. Fractus, 2009.
Infringement Chart—Samsung SCH U410. Patent: 7528782. Fractus, 2009.
Infringement Chart—Samsung SCH U700. Fractus, 2009.
Infringement Chart—Samsung SCH U700. Patent: 7015868. Fractus, 2009.
Infringement Chart—Samsung SCH Patent: 7123208. Fractus, 2009.
Infringement Chart—Samsung SCH U700. Patent: 7394432. Fractus, 2009.
Infringement Chart—Samsung SCH U700. Patent: 7397431. Fractus, 2009.
Infringement Chart—Samsung SCH U700. Patent: 7528782. Fractus, 2009.
Infringement Chart—Samsung SGH UA10. Fractus, 2009.
Infringement Chart—Samsung SGH-A237. Fractus, 2009.
Infringement Chart—Samsung SGH-A237. Patent: 7015868. Fractus, 2009.
Infringement Chart—Samsung SGH-A237. Patent: 7123208. Fractus, 2009.
Infringement Chart—Samsung SGH-A237. Patent: 7394432. Fractus, 2009.
Infringement Chart—Samsung SGH-A237. Patent: 7397431. Fractus, 2009.
Infringement Chart—Samsung SGH-A237. Patent: 7528782. Fractus, 2009.
Infringement Chart—Samsung SGH-A257. Fractus, 2009.
Infringement Chart—Samsung SGH-A257. Patent: 7394432. Fractus, 2009.
Infringement Chart—Samsung SGH-A257. Patent: 7397431 Fractus, 2009.
Infringement Chart—Samsung SGH-A257. Patent: 7528782. Fractus, 2009.
Infringement Chart—Samsung SGH-A630. Patent: 7123208. Fractus, 2009.
Infringement Chart—Samsung SGH-A837. Fractus, 2009.
Infringement Chart—Samsung SGH-A837. Patent: 7015868. Fractus, 2009.

Infringement Chart—Samsung SGH-A837. Patent: 7123208. Fractus, 2009.
Infringement Chart—Samsung SGH-A837. Patent: 7394432. Fractus, 2009.
Infringement Chart—Samsung SGH-A837. Patent: 7397431. Fractus, 2009.
Infringement Chart—Samsung SGH-A837. Patent: 7528782. Fractus, 2009.
Infringement Chart—Samsung SGH-A887. Fractus, 2009.
Infringement Chart—Samsung SGH-A887. Patent: 7123208. Fractus, 2009.
Infringement Chart—Samsung SGH-A887. Patent: 7397431. Fractus, 2009.
Infringement Chart—Samsung SGH-A887. Patent: 7528782. Fractus, 2009.
Infringement Chart—Samsung SGH-I907. Patent: 7015868. Fractus, 2009.
Infringement Chart—Samsung SGH-I907. Patent: 7123208. Fractus, 2009.
Infringement Chart—Samsung SGH-I907. Patent: 7394432. Fractus, 2009.
Infringement Chart—Samsung SGH-I907. Patent: 7397431. Fractus, 2009.
Infringement Chart—Samsung SGH-I907. Patent: 7528782 Fractus, 2009.
Infringement Chart—Samsung SGH-T219. Fractus, 2009.
Infringement Chart—Samsung SGH-T219. Patent: 7394432. Fractus, 2009.
Infringement Chart—Samsung SGH-T219. Patent: 7015868. Fractus, 2009.
Infringement Chart—Samsung SGH-T219. Patent: 7123208. Fractus, 2009.
Infringement Chart—Samsung SGH-T219. Patent: 7397431. Fractus, 2009.
Infringement Chart—Samsung SGH-T219. Patent: 7528782 Fractus, 2009.
Infringement Chart—Samsung SGH-T239. Fractus, 2009.
Infringement Chart—Samsung SGH-T239. Patent: 7123208. Fractus, 2009.
Infringement Chart—Samsung SGH-T239. Patent: 7015868. Fractus, 2009.
Infringement Chart—Samsung SGH-T239. Patent: 7397431. Fractus, 2009.
Infringement Chart—Samsung SGH-T239. Patent: 7528782. Fractus, 2009.
Infringement Chart—Samsung SGH-T559. Fractus, 2009.
Infringement Chart—Samsung SGH-T559. Patent: 7015868. Fractus, 2009.
Infringement Chart—Samsung SGH-T559. Patent: 7123208. Fractus, 2009.
Infringement Chart—Samsung SGH-T559. Patent: 7394432. Fractus, 2009.
Infringement Chart—Samsung SCH A867. Patent: 7394432. Fractus, 2009.
Infringement Chart—Samsung SCH A867. Patent: 7397431. Fractus, 2009.
Infringement Chart—Samsung SGH A867. Patent: 7528782. Fractus, 2009.
Infringement Chart—Samsung SGH T 919. Patent: 7397431. Fractus, 2009.
Infringement Chart—Samsung SGH T229. Fractus, 2009.
Infringement Chart—Samsung SGH T229. Patent: 7015868. Fractus, 2009.
Infringement Chart—Samsung SGH T229. Patent: 7123208. Fractus, 2009.
Infringement Chart—Samsung SGH T229. Patent: 7394432. Fractus, 2009.
Infringement Chart—Samsung SGH T229. Patent: 7397431. Fractus, 2009.
Infringement Chart—Samsung SGH T229. Patent: 7528782. Fractus, 2009.
Infringement Chart—Samsung SGH T439. Fractus, 2009.
Infringement Chart—Samsung SGH T439. Patent: 7015868. Fractus, 2009.
Infringement Chart—Samsung SGH T439. Patent: 7123208. Fractus, 2009.
Infringement Chart—Samsung SGH T439. Patent: 7394432. Fractus, 2009.
Infringement Chart—Samsung SGH T439. Patent: 7397431. Fractus, 2009.
Infringement Chart—Samsung SGH T439. Patent: 7528782. Fractus, 2009.
Infringement Chart—Samsung SGH 1459. Fractus, 2009.
Infringement Chart—Samsung SGH 1459. Patent: 7015868. Fractus, 2009.
Infringement Chart—Samsung SGH 1459. Patent: 7123208. Fractus, 2009.
Infringement Chart—Samsung SGH 1459. Patent: 7394432. Fractus, 2009.
Infringement Chart—Samsung SGH 1459. Patent: 7397431. Fractus, 2009.
Infringement Chart—Samsung SGH 1459. Patent: 7528782. Fractus, 2009.
Infringement Chart—Samsung SGH T919. Fractus, 2009.
Infringement Chart—Samsung SGH T919. Patent: 7015868. Fractus, 2009.
Infringement Chart—Samsung SGH T919. Patent: 7123208. Fractus, 2009.
Infringement Chart—Samsung SGH T919. Patent: 7394432. Fractus, 2009.
Infringement Chart—Samsung SGH T919. Patent: 7528782. Fractus, 2009.
Infringement Chart—Samsung Solstice (SGH-A887). Patent: 7015868. Fractus, 2009.
Infringement Chart—Samsung Spex R210a. Fractus, 2009.
Infringement Chart—Samsung Spex R210a. Patent: 7015868. Fractus, 2009.
Infringement Chart—Samsung Spex R210a. Patent: 7123208. Fractus, 2009.
Infringement Chart—Samsung Spex R210a. Patent: 7394432. Fractus, 2009.
Infringement Chart—Samsung Spex R210a. Patent: 7397431. Fractus, 2009.
Infringement Chart—Samsung Spex R210a. Patent: 7528782. Fractus, 2009.
Infringement Chart—Samsung SPH-A523. Fractus, 2009.
Infringement Chart—Samsung SPH-A523. Patent: 7015868. Fractus, 2009.
Infringement Chart—Samsung SPH-A523. Patent: 7123208. Fractus, 2009.
Infringement Chart—Samsung SPH-A523. Patent: 7394432. Fractus, 2009.
Infringement Chart—Samsung SPH-A532. Patent: 7528782. Fractus, 2009.
Infringement Chart—Samsung SPH-M550. Fractus, 2009.
Infringement Chart—Samsung SPH-M550. Patent: 7015868. Fractus, 2009.
Infringement Chart—Samsung SPH-M550. Patent: 7123208. Fractus, 2009.
Infringement Chart—Samsung SPH-M550. Patent: 7397431. Fractus, 2009.
Infringement Chart—Samsung SPH-M550. Patent: 7528782. Fractus, 2009.
Infringement Chart—Samsung SPH M520. Fractus, 2009.
Infringement Chart—Samsung SPH M520. Patent: 7528782. Fractus, 2009.
Infringement Chart—Samsung SPH M520. Patent: 7015868. Fractus, 2009.
Infringement Chart—Samsung SPH M520. Patent: 7123208. Fractus, 2009.
Infringement Chart—Samsung SPH M520. Patent: 7394432. Fractus, 2009.
Infringement Chart—Samsung SPH M520. Patent: 7397431. Fractus, 2009.

Infringement Chart—Sharp Sidekick LX 2009. Patent: 7528782. Fractus, 2009.
Infringement Chart—Sharp Sidekick LX Patent: 7123208. Fractus, 2009.
Infringement Chart—Sharp Sidekick LX Patent: 7148850. Fractus, 2009.
Infringement Chart—Sharp Sidekick LX Patent: 7394432. Fractus, 2009.
Infringement Chart—Sharp Sidekick LX Patent: 7397431. Fractus, 2009.
Infringement Chart—Sharp Sidekick LX Patent: 7528782. Fractus, 2009.
Infringement Chart—UTStarcom CDM7126. Fractus, 2009.
Infringement Chart—UTStarcom CDM7126. Patent: 7015868. Fractus, 2009.
Infringement Chart—UTStarcom CDM7126. Patent: 7123208. Fractus, 2009.
Infringement Chart—UTStarcom CDM7126. Patent: 7394432. Fractus, 2009.
Infringement Chart—UTStarcom CDM7126. Patent: 7397431. Fractus, 2009.
Infringement Chart—UTStarcom CDM7126. Patent: 7411556. Fractus, 2009.
Infringement Chart—UTStarcom CDM7126. Patent: 7528782. Fractus, 2009.
Infringement Chart—UTStarcom Quickfire GTX75. Fractus, 2009.
Infringement Chart—UTStarcom Quickfire GTX75. Patent: 7015868. Fractus, 2009.
Infringement Chart—UTStarcom Quickfire GTX75. Patent: 7123208 Fractus, 2009.
Infringement Chart—UTStarcom Quickfire GTX75. Patent: 7394432. Fractus, 2009.
Infringement Chart—UTStarcom Quickfire GTX75. Patent: 7397431. Fractus, 2009.
Infringement Chart—UTStarcom Quickfire GTX75. Patent: 7528782. Fractus, 2009.
Infringement Chart—Samsung SPH M540.. Fractus, 2009.
Infringement Chart—Samsung SPH M540. Patent: 7528782. Fractus, 2009.
Infringement Chart—Samsung SPH M540. Patent: 7015868. Fractus, 2009.
Infringement Chart—Samsung SPH M540. Patent: 7123208. Fractus, 2009.
Infringement Chart—Samsung SPH M540. Patent: 7397431. Fractus, 2009.
Infringement Chart—Samsung SPH-A523. Patent: 7397431. Fractus, 2009.
Infringement Chart—Samsung Sway SCH-U650. Fractus, 2009.
Infringement Chart—Samsung Sway SCH-U650. Patent: 7015868. Fractus, 2009.
Infringement Chart—Samsung Sway SCH-U650. Patent: 7123208. Fractus, 2009.
Infringement Chart—Samsung Sway SCH-U650. Patent: 7397431. Fractus, 2009.
Infringement Chart—Samsung Sway SCH-U650. Patent: 7528782. Fractus, 2009.
Infringement Chart—Sanyo Katana II. Fractus, 2009.
Infringement Chart—Sanyo Katana II. Patent: 7015868. Fractus, 2009.
Infringement Chart—Sanyo Katana II. Patent: 7123208. Fractus, 2009.
Infringement Chart—Sanyo Katana II. Patent: 7394432. Fractus, 2009.
Infringement Chart—Sanyo Katana II. Patent: 7397431. Fractus, 2009.
Infringement Chart—Sanyo Katana II. Patent: 7528782. Fractus, 2009.
Infringement Chart—Sanyo Katana LX. Fractus, 2009.
Infringement Chart—Sanyo Katana LX. Patent: 7015868. Fractus, 2009.
Infringement Chart—Sanyo Katana LX. Patent: 7123208. Fractus, 2009.
Infringement Chart—Sanyo Katana LX. Patent: 7397431. Fractus, 2009.
Infringement Chart—Sanyo Katana LX. Patent: 7528782. Fractus, 2009.
Infringement Chart—Sanyo S1. Fractus, 2009.
Infringement Chart—Sanyo S1. Patent: 7015868. Fractus, 2009.
Infringement Chart—Sanyo S1. Patent: 7123208. Fractus, 2009.
Infringement Chart—Sanyo S1. Patent: 7397431. Fractus, 2009.
Infringement Chart—Sanyo 51. Patent: 7528782. Fractus, 2009.
Infringement Chart—Sanyo SCP 2700.. Fractus, 2009.
Infringement Chart—Sanyo SCP 2700. Patent: 7015868. Fractus, 2009.
Infringement Chart—Sanyo SCP 2700. Patent: 7123208. Fractus, 2009.
Infringement Chart—Sanyo SCP 2700. Patent: 7397431. Fractus, 2009.
Infringement Chart—Sanyo SCP 2700. Patent: 7528782. Fractus, 2009.
Infringement Chart—Sharp Sidekick 3. Fractus, 2009.
Infringement Chart—Sharp Sidekick 3. Patent: 7015868. Fractus, 2009.
Infringement Chart—Sharp Sidekick 3. Patent: 7123208. Fractus, 2009.
Infringement Chart—Sharp Sidekick 3. Patent: 7394432. Fractus, 2009.
Infringement Chart—Sharp Sidekick 3. Patent: 7397431. Fractus, 2009.
Infringement Chart—Sharp Sidekick 3. Patent: 7528782. Fractus, 2009.
Infringement Chart—Sharp Sidekick 2008. Fractus, 2009.
Infringement Chart—Sharp Sidekick 2008. Patent: 7015868 Fractus, 2009.
Infringement Chart—Sharp Sidekick 2008. Patent: 7123208. Fractus, 2009.
Infringement Chart—Sharp Sidekick 2008. Patent: 7394432. Fractus, 2009.
Infringement Chart—Sharp Sidekick 2008. Patent: 7397431. Fractus, 2009.
Infringement Chart—Sharp Sidekick 2008. Patent: 7528782. Fractus, 2009.
Infringement Chart—Sharp Sidekick LX . Patent: 7015868. Fractus, 2009.
Infringement Chart—Sharp Sidekick LX 2009.. Fractus, 2009.
Infringement Chart—Sharp Sidekick LX 2009. Patent: 7015868. Fractus, 2009.
Infringement Chart—Sharp Sidekick LX 2009. Patent: 7123208. Fractus, 2009.
Infringement Chart—Sharp Sidekick LX 2009. Patent: 7394432. Fractus, 2009.
Infringement Chart—Sharp Sidekick LX 2009. Patent: 7397431. Fractus, 2009.
Fractus's Objections to Claim Construction Memorandum and Order, Fractus, Jan. 14, 2011.
Fanjul , J. International preliminary examination report for application No. PCT/ES99700296. European Patent Office, Dec. 2001.
Lauwerier , H. Fractals. Endlessly repeated geometrical figures. Princeton University Press. Chapters 1, 3, 5, 1991.
American Heritage College Dictionary, pp. 340 and 1016, Mifflin Company dated Jan. 1, 1997.
Caswell , W.E., Invisible errors in dimension calculations: geometric and systematic effects by W.E. Caswell and J.A. York, dated 1986 , J. Opt. Soc. Am. A 7, 1055-1073 (1990), J. Opt. Soc. Am. dated Jan. 1, 1986.
Fourountan-por , P., Advances in the Implementation of the Box-Counting Method of Fractal Dimension Estimation by K. Fourountan-por, P. Dutillel and D.L. Smith, dated 1999., El Servier dated Jan. 1, 1999.
Kyriacos , S, Kyriacos, S. Buczkowski, F. Nekka, and L. Cartilier, A Modified Box-Counting Method, Fractals 321-324 (1994)., dated Apr. 20, 1998.
Merriam-Webster's Collegiate Dictionary (1996), Merriam-Webster's dated Jan. 1, 1996.

Preliminary Amendment with Originally Filed Claims for U.S. Appl. No. 10/102,568 dated Mar. 18, 2002.
Patent Cooperation Treaty Application PCT/ES99/00296 Reply dated Nov. 26, 2001.
Sauer, J. M., Amendment in File History of U.S. Patent No. 7,015,868, Jones Day dated Dec. 10, 2004.
Defendants, Baxter , J., Declaration of Jeffrey Baxter in the case of *Fractus SA* v. *Samsung Electornics Co. Ltd. et al*. Case No. 6:09-cv-00203 (E.D. Tex.) dated Jul. 29, 2010.
Defendants, Baxter , J., Declaration of Jeffrey Baxter Exhibits in the case of *Fractus SA* v. *Samsung Electornics Co. Ltd. et al*. Case No. 6:09-cv-00203 (Ed. Tex.) dated Aug. 30, 2010.
Falconer, Kenneth , Fractal Geometry: Mathematical Foundations and Applications, pp. 38-41, Jonh Wiley & Sons 1st ed dated Jan. 1, 1990.
Feder, J. , Fractals , Plenum Press, pp. 10-11, 15-17, and 25, Plenum Press dated Jan. 1, 1988.
Fleishmann , M. ; Tildesley , DJ ; Balls , RC, Fractals in the natural sciences, Royal Society of London dated Jan. 1, 1990.
Jaggard , D. , Diffraction by Bandlimited Fractal Screens, Optical Soc'Y Am. A 1055 dated Jan. 1, 1987.
NA, IEEE Standard Dictionary of Electrical and Electronics Terms., IEEE Press, 6th ed. , pp. 359, 688, and 878 dated Jan. 1, 1993.
Nelson , Thomas R. ; Jaggard , Dwight L. , Fractals in the Imaging Sciences, 7, J. Optical Soc'Y Am. A 1052 dated Jan. 1, 1990.
Stutzman , W. ; Thiele , G., Antenna theory and design, John Wiley and Sons, pp. 18, 36 dated Jan. 1, 1981.
Fractus, Jaggard, Expert declaration by Dr. Jaggard including exhibits in the case of *Fractus SA* v. *Samsung Electornics Co. Ltd. et al*. Case No. 6:09-cv-00203 (E.D. Tex.) dated Aug. 16, 2010.
Defendants' invalidity contentions including appendix A and exhibits 1, 2, 3, 4, 5, 10, 11 referenced Multilevel Antenna patent. Feb. 24, 2010.
Fractus, Opposition to Defendants Motion for Summary Judment of Invalidity in the case of *Fractus SA* v. *Samsung Electornics Co. Ltd. et al*. Case No. 60:09cv203 (E.D. Tex.) dated Aug. 16, 2010.
Court Order, Provisional Claim Construction Ruling and Order, Magistrate Judge John D. Love in the case of *Fractus SA* v. *Samsung Electornics Co. Ltd. et al*. Case No. 6:09-cv-00203 (E.D. Tex.) dated Nov. 9, 2010.
Defendants, Claim Construction and Motion for Summary Judgment, Markman Hearing in the case of *Fractus SA* v. *Samsung Electornics Co. Ltd. et al*. Case No. 6:09-cv-00203 (E.D. Tex.) dated Sep. 22, 2010.
Fractus, Claim Construction Presentation, Markman Hearing in the case of *Fractus SA* v. *Samsung Electornics Co. Ltd*. Case No. 6:09-cv-00203 (Ed. Tex.) dated Sep. 2, 2010.
Lyon , J. ; Rassweiler , G. ; Chen , C., Ferrite-loading effects on helical and spiral antennas, 15th Annual Symposium on the USAF antenna reserach and development program dated Oct. 12, 1965.
McCormick , J., A Low-profile electrically small VHF antenna, 15th Annual Symposium on the USAF antenna reserach and development program dated Oct. 12, 1965.
Meier , K. ; Burkhard , M. ; Schmid , T. et al, Broadband calibration of E-field probes in Lossy Media, IEEE Transactions on Microwave Theory and Techniques dated Oct. 1, 1996.
NA, Letter to FCC—Application form 731 and Engineering Test Report by Nokia Mobile Phones for FCC ID: LJPNSW-6NX, M. Flom Associates dated Apr. 1, 1999.
NA, OET Exhibits list for FCC ID: LJPNSW-6NX, Federal Communications Commission—FCC dated Jul. 8, 1999.
Naik , A. ; Bathnagar , P. S., Experimental study on stacked ring coupled triangular microstrip antenna, Antenna Applications Symposium, 1994 dated Sep. 21, 1994.
Paschen , A ; Olson , S., A crossed-slot antenna with an infinite balun feed, Antenna Applications Symposium, 1995. dated Sep. 20, 1995.
Watson , T. ; Friesser , J., A phase shift direction finding technique, Annual Symposium on the USAF antenna research and development program dated Oct. 21, 1957.
Wikka , K., Letter to FCC that will authorize the appointment of Morton Flom Eng and/or Flomassociates Inc to act as their Agent in all FCC matters, Nokia Mobile Phones dated Aug. 5, 1999.
Defendants, Letters from Baker Botts to Kenyon & Kenyon LLP, Winstead PC and Howison & Arnott LLP including Exhibits in the case of *Fractus SA* v. *Samsung Electornics Co. Ltd. et al*. Case No. 6:09-cv-00203 (E.D. Tex.) dated Oct. 28, 2009.
Defendants, Letter from Baker Botts to Howison & Arnott LLP including Exhibits in the case of *Fractus SA* v. *Samsung Electornics Co. Ltd. et al*. Case No. 6:09-cv-00203 (E.D. Tex.) dated Aug. 5, 2010.
In the High Court of Justice Chancery Division Patents Court between HTC Corporation and Fractus SA: Grounds of Invalidity, Hogan Lovells International LLP dated Sep. 15, 2010.
In the High Court of Justice Chancery Division Patents Court between HTC Corporation and Fractus SA: Defence, Taylor Wessing LLP dated Nov. 10, 2010.
Sterne , R. G. Response to the Office Action for the U.S. Appl. No. 95/001,390 dated on Aug. 19, 2010.
Sterne , R. G. Response to the Office Action for U.S. Appl. No. 95/001,389 dated on Aug. 12, 2010.
Menefee , J. Office action for the U.S. Appl. No. 95/001,482 dated on Dec. 13, 2010.
Menefee , J. Office action for the U.S. Appl. No. 95/001,455 dated on Nov. 19, 2010.
Chen , S. Office action for the U.S. Appl. No. 11/796,368 dated on Jun. 25, 2010.
Chen , S. Office action for the U.S. Appl. No. 11/796,368 dated on Aug. 10, 2010.
Haapala, Helical antennas for multi-mode mobile phones, 26th European Microwave Conference dated Sep. 1, 1996.
Romeu et al., Moyano Report 1.2 English Translation, Dual Fractal Antennas for Cellular Telephony: Correction of Truncation Effect (C.E.T.), Electromagnetic and Photonic Engineering Group (EEF) Dept. of Signal Theory and Communications, Polytechnic University of Catalonia dated Nov. 20, 1997.
Romeu et al., Moyano Report 1.6 English Translation, Dual Fractal Antennas for Cellular Telephony: Adjustment of Input Impedance. P2/3sPK Dual Monopole, Electromagnetic and Photonic Engineering Group (EEF) Dept. of Signal Theory and Communications, Polytechnic University of Catalonia dated Apr. 2, 1998.
Romeu et al., Moyano Report 1.7 English Translation, Dual Fractal Antennas for Cellular Telephony: Dual Monopole Microcell Application Fractus II dated May 28, 1998.
Strugatsky, A. Multimode multiband antenna. Tactical Communications: Technology in Ttransition. Proceedings of the Tactical Communications Conference dated Jan. 1, 1992.
Infringement Chart—Samsung SGH-T559. Patent: 7397431. Fractus, 2009.
Infringement Chart—Samsung SGH-T559. Patent: 7528782. Fractus, 2009.
Infringement Chart—Samsung SGH-T639. Fractus, 2009.
Infringement Chart—Samsung SGH-T639. Patent: 7015868. Fractus, 2009.
Infringement Chart—Samsung SGH-T639. Patent: 7123208. Fractus, 2009.
Infringement Chart—Samsung SGH-T639. Patent: 7394432. Fractus, 2009.
Infringement Chart—Samsung SGH-T639. Patent: 7397431. Fractus, 2009.
Infringement Chart—Samsung SGH-T639. Patent: 7528782. Fractus, 2009.
Infringement Chart—Samsung SGH-T739. Fractus, 2009.
Infringement Chart—Samsung SGH-T739. Patent: 7015868. Fractus, 2009.
Infringement Chart—Samsung SGH-T739. Patent: 7123208. Fractus, 2009.
Infringement Chart—Samsung SGH-T739. Patent: 7394432. Fractus, 2009.
Infringement Chart—Samsung SGH-T739. Patent: 7397431. Fractus, 2009.
Infringement Chart—Samsung SGH-T739. Patent: 7528782. Fractus, 2009.
Infringement Chart—Samsung SGH-T819. Fractus, 2009.
Infringement Chart—Samsung SGH-T819. Patent: 7015868. Fractus, 2009.

Infringement Chart—Samsung SGH-T819. Patent: 7123208. Fractus, 2009.
Infringement Chart—Samsung SGH-T819. Patent: 7394432. Fractus, 2009.
Infringement Chart—Samsung SGH-T819. Patent: 7397431. Fractus, 2009.
Infringement Chart—Samsung SGH-T819. Patent: 7528782. Fractus, 2009.
Infringement Chart—Samsung SGH-T929. Fractus, 2009.
Infringement Chart—Samsung SGH-T929. Patent: 7015868. Fractus, 2009.
Infringement Chart—Samsung SGH-T929. Patent: 7123208. Fractus, 2009.
Infringement Chart—Samsung SGH-T929. Patent: 7394432. Fractus, 2009.
Infringement Chart—Samsung SGH-T929. Patent: 7397431. Fractus, 2009.
Infringement Chart—Samsung SGH-T929. Patent: 7528782. Fractus, 2009.
Infringement Char—Samsung SGH A 437. Patent: 7015868. Fractus, 2009.
Infringement Chart—Samsung SGH A 437. Patent: 7394432. Fractus, 2009.
Infringement Chart—Samsung SGH A117. Fractus, 2009.
Infringement Chart—Samsung SGH A117. Patent: 7015868. Fractus, 2009.
Infringement Chart—Samsung SGH A117. Patent: 7123208. Fractus, 2009.
Infringement Chart—Samsung SGH A117. Patent: 7397431. Fractus, 2009.
Infringement Chart—Samsung SGH A117. Patent: 7528782. Fractus, 2009.
Infringement Chart—Samsung SGH A127. Patent: 7123208. Fractus, 2009.
Infringement Chart—Samsung SGH A127. Patent: 7015868. Fractus, 2009.
Infringement Chart—Samsung SGH A127. Patent: 7397431. Fractus, 2009.
Infringement Chart—Samsung SGH A127. Patent: 7528782. Fractus, 2009.
Infringement Chart—Samsung SGH A437. Fractus, 2009.
Infringement Chart—Samsung SGH A437. Patent: 7123208. Fractus, 2009.
Infringement Chart—Samsung SGH A437. Patent: 7397431. Fractus, 2009.
Infringement Chart—Samsung SGH A437. Patent: 7528782. Fractus, 2009.
Infringement Chart—Samsung SGH A737. Fractus, 2009.
Infringement Chart—Samsung SGH A737. Patent: 7015868. Fractus, 2009.
Infringement Chart—Samsung SGH A737. Patent: 7123208. Fractus, 2009.
Infringement Chart—Samsung SGH A737. Patent: 7394432. Fractus, 2009.
Infringement Chart—Samsung SGH A737. Patent: 7397431. Fractus, 2009.
Infringement Chart—Samsung SGH A737. Patent: 7528782. Fractus, 2009.
Infringement Chart—Samsung SGH A867. Fractus, 2009.
Infringement Chart—Samsung SGH A867. Patent: 7015868. Fractus, 2009.
Infringement Chart—Samsung SGH A867. Patent: 7123208. Fractus, 2009.
NA. Research in motion receives FCC approval for the new Inter(at)ctive Pager 850. PR Newswire. Jul. 1999.
NA. User's Guide RIM 950 Wireless Handheld Version 1.7. 1997.
Response to Fractus Opposition to Defendants motion for summary judgement of invalidity in the case of *Fractus SA* v. *Samsung Electronics Co. Ltd. et al* Case No. 60:09cv203.
FCC—United States table of frequency allocations. Federal Communications Commission, 1999.
Response to Second OA of CN patent application No. 01823716.9 dated Sep. 21, 2007.
United States Table of Frequency allocations—The Radio Spectrum. United States Department of Commerce. Mar. 1996.
Barnsley , M. Fractals Eveywhere. Academic Press Professional. 1993.
Love , J. D. Memorandum opinion and order. Court. Jan. 20, 2011.
Defendant's notice of compliance regarding second amended invalidity contentions. Defendants. Jan. 21, 2011.
Declaration of Thomas E. Nelson. Defendants. Feb. 3, 2011.
Fractus' reply to defendant's motion for reconsideration of, and objections to, magistrate Judge Love's markman order. Feb. 4, 2011.
Report and recommendation of United States magistrate judge. Court. Feb. 8, 2011.
Order adopting report and recommendation of magistrate judge. Court. Feb. 11, 2011.
Infringement Chart—RIM Blackberry 9630. Fractus, 2009.
Infringement Chart—RIM Blackberry 9630. Patent: 7123208. Fractus, 2009.
Infringement Chart—RIM Blackberry 9630. Patent: 7394432. Fractus, 2009.
Infringement Chart—RIM Blackberry 9630. Patent: 7397431. Fractus, 2009.
Infringement Chart—RIM Blackberry Bold 9000.. Fractus, 2009.
Infringement Chart—RIM Blackberry Bold 9000. Patent: 7015868. Fractus, 2009.
Infringement Chart—RIM Blackberry Bold 9000. Patent: 7123208. Fractus, 2009.
Infringement Chart—RIM Blackberry Bold 9000. Patent: 7394432. Fractus, 2009.
Infringement Chart—RIM Blackberry Bold 9000. Patent: 7528782. Fractus, 2009.
Infringement Chart—RIM Blackberry Bold 9000. Patent: 7397431. Fractus, 2009.
Infringement Chart—RIM Blackberry Pearl 8100. Fractus, 2009.
Infringement Chart—RIM Blackberry Storm 9530. Fractus, 2009.
Infringement Chart—RIM Blackberry Storm 9530. Patent: 7015868. Fractus, 2009.
Infringement Chart—RIM Blackberry Storm 9530. Patent: 7123208. Fractus, 2009.
Infringement Chart—RIM Blackberry Storm 9530. Patent: 7394432. Fractus, 2009.
Infringement Chart—RIM Blackberry Storm 9530. Patent: 7397431. Fractus, 2009.
Infringement Chart—RIM Blackberry Storm 9530. Patent: 7528782. Fractus, 2009.
Infringement Chart—RIM Blackberry Tour 9630. Patent: 7528782. Fractus, 2009.
Infringement Chart—Samsung Blackjack II SGH-i617.. Fractus, 2009.
Infringement Chart—Samsung Blackjack II SGH-i617. Patent: 7015868. Fractus, 2009.
Infringement Chart—Samsung Blackjack II SGH-i617. Patent: 7123208. Fractus, 2009.
Infringement Chart—Samsung Blackjack II SGH-i617. Patent: 7394432. Fractus, 2009.
Infringement Chart—Samsung Blackjack II SGH-i617. Patent: 7528782. Fractus, 2009.
Infringement Chart—Samsung Blackjack II SGH-i617. Patent:7397431. Fractus, 2009.
Infringement Chart—Samsung Blast SGH-T729. Patent: 7015868. Fractus, 2009.
Infringement Chart—Samsung Blast SGH-T729. Patent: 7123208. Fractus, 2009.
Infringement Chart—Samsung Blast SGH-T729. Patent: 7394432. Fractus, 2009.
Infringement Chart—Samsung Blast SGH-T729. Patent: 7528782. Fractus, 2009.
Infringement Chart—Samsung Blast SGH-T729. T729. Fractus, 2009.
Infringement Chart—Samsung Blast SGH-T729. T729. Patent: 7397431. Fractus, 2009.
Infringement Chart—Samsung EPIX SGH-1907. Fractus, 2009.
Infringement Chart—Samsung FlipShot SCH-U900. Fractus, 2009.

Infringement Chart—Samsung FlipShot SCH-U900. Patent: 7123208. Fractus, 2009.
Infringement Chart—Samsung FLipShot SCH-U900. Patent: 7394432. Fractus, 2009.
Infringement Chart—Samsung FlipShot SCH-U900. Patent: 7397431. Fractus, 2009.
Infringement Chart—Samsung FlipShot SCH-U900. Patent: 7528782. Fractus, 2009.
Infringement Chart—Samsung Instinct M800. Fractus, 2009.
Infringement Chart—Samsung Instinct M800. Patent: 7015868. Fractus, 2009.
Infringement Chart—Samsung Instinct M800. Patent: 7123208. Fractus, 2009.
Infringement Chart—Samsung Instinct M800. Patent: 7394432. Fractus, 2009.
Infringement Chart—Samsung Instinct M800. Patent: 7397431. Fractus, 2009.
Infringement Chart—Samsung Instinct M800. Patent: 7528782. Fractus, 2009.
Infringement Chart—Samsung M320. Fractus, 2009.
Infringement Chart—Samsung M320. Patent: 7397431. Fractus, 2009.
Infringement Chart—Samsung M320. Patent: 7015868. Fractus, 2009.
Infringement Chart—Samsung M320. Patent: 7123208. Fractus, 2009.
Infringement Chart—Samsung M320. Patent: 7394432. Fractus, 2009.
Infringement Chart—Samsung M320. Patent: 7528782. Fractus, 2009.
Infringement Chart—Samsung Magnet (SGH-A257). Patent: 7015868. Fractus, 2009.
Infringement Chart—RIM Blackberry 8120. Patent: 7123208. Fractus, 2009.
Infringement Chart—RIM Blackberry 8120. Patent: 7394432. Fractus, 2009.
Infringement Chart—RIM Blackberry 8120. Patent: 7397431. Fractus, 2009.
Infringement Chart—RIM Blackberry 8120. Patent: 7528782. Fractus, 2009.
Infringement Chart—RIM Blackberry 8130. Fractus, 2009.
Infringement Chart—RIM Blackberry 8130. Patent: 7015868. Fractus, 2009.
Infringement Chart—RIM Blackberry 8130. Patent: 7123208. Fractus, 2009.
Infringement Chart—RIM Blackberry 8130. Patent: 7528782. Fractus, 2009.
Infringement Chart—RIM Blackberry 8220. Fractus, 2009.
Infringement Chart—RIM Blackberry 8220. Patent: 7015868. Fractus, 2009.
Infringement Chart—RIM Blackberry 8220. Patent: 7123208. Fractus, 2009.
Infringement Chart—RIM Blackberry 8220. Patent: 7394432. Fractus, 2009.
Infringement Chart—RIM Blackberry 8220. Patent: 7397431. Fractus, 2009.
Infringement Chart—RIM Blackberry 8220. Patent: 7528782. Fractus, 2009.
Infringement Chart—RIM Blackberry 8310. Fractus, 2009.
Infringement Chart—RIM Blackberry 8310. Patent: 7015868. Fractus, 2009.
Infringement Chart—RIM Blackberry 8310. Patent: 7123208. Fractus, 2009.
Infringement Chart—RIM Blackberry 8310. Patent: 7394432. Fractus, 2009.
Infringement Chart—RIM Blackberry 8310. Patent: 7397431. Fractus, 2009.
Infringement Chart—RIM Blackberry 8310. Patent: 7528782. Fractus, 2009.
Infringement Chart—RIM Blackberry 8320. Fractus, 2009.
Infringement Chart—RIM Blackberry 8320. Patent: 7015868. Fractus, 2009.
Infringement Chart—RIM Blackberry 8320. Patent: 7123208. Fractus, 2009.
Infringement Chart—RIM Blackberry 8320. Patent: 7394432. Fractus, 2009.
Infringement Chart—RIM Blackberry 8320. Patent: 7397431. Fractus, 2009.
Infringement Chart—RIM Blackberry 8320. Patent: 7528782. Fractus, 2009.
Infringement Chart—RIM Blackberry 8330. Fractus, 2009.
Infringement Chart—RIM Blackberry 8330. Patent: 7015868. Fractus, 2009.
Infringement Chart—RIM Blackberry 8330. Patent: 7123208. Fractus, 2009.
Infringement Chart—RIM Blackberry 8330. Patent: 7397431. Fractus, 2009.
Infringement Chart—RIM Blackberry 8330. Patent: 7528782. Fractus, 2009.
Infringement Chart—RIM Blackberry 8820. Fractus, 2009.
Infringement Chart—RIM Blackberry 8820. Patent: 7015868. Fractus, 2009.
Infringement Chart—RIM Blackberry 8820. Patent: 7123208. Fractus, 2009.
Infringement Chart—RIM Blackberry 8820. Patent: 7394432. Fractus, 2009.
Infringement Chart—RIM Blackberry 8820. Patent: 7397431. Fractus, 2009.
Infringement Chart—RIM Blackberry 8820. Patent: 7528782. Fractus, 2009.
Infringement Chart—RIM Blackberry 8830. Fractus, 2009.
Infringement Chart—RIM Blackberry 8830. Patent: 7015868. Fractus, 2009.
Infringement Chart—RIM Blackberry 8830. Patent: 7123208. Fractus, 2009.
Infringement Chart—RIM Blackberry 8830. Patent: 7394432. Fractus, 2009.
Infringement Chart—RIM Blackberry 8830. Patent: 7397431. Fractus, 2009.
Infringement Chart—RIM Blackberry 8830. Patent: 7528782. Fractus, 2009.
Infringement Chart—RIM Blackberry 8900. Fractus, 2009.
Infringement Chart—RIM Blackberry 8900. Patent: 7015868. Fractus, 2009.
Infringement Chart—RIM Blackberry 8900. Patent: 7123208. Fractus, 2009.
Infringement Chart—RIM Blackberry 8900. Patent: 7394432. Fractus, 2009.
Infringement Chart—RIM Blackberry 8900. Patent: 7397431. Fractus, 2009.
Infringement Chart—RIM Blackberry 8900. Patent: 7528782. Fractus, 2009.
Infringement Chart—HTC Touch Pro 2. Patent: 7528782. Fractus, 2009.
Infringement Chart—HTC Touch Pro Fuze. Fractus, 2009.
Infringement Chart—HTC Touch Pro Fuze. Patent: 7015868. Fractus, 2009.
Infringement Chart—HTC Touch Pro Fuze. Patent: 7123208. Fractus, 2009.
Infringement Chart—HTC Touch Pro Fuze. Patent: 7394432. Fractus, 2009.
Infringement Chart—HTC Touch Pro Fuze. Patent: 7397431. Fractus, 2009.
Infringement Chart—HTC Touch Pro Fuze. Patent: 7528782. Fractus, 2009.
Infringement Chart—HTC Touch Pro. Fractus, 2009.
Infringement Chart—HTC Touch Pro. Patent: 7015868. Fractus, 2009.
Infringement Chart—HTC Touch Pro. Patent: 7123208. Fractus, 2009.
Infringement Chart—HTC Touch Pro. Patent: 7397431. Fractus, 2009.
Infringement Chart—HTC Touch Pro. Patent: 7528782. Fractus, 2009.
Infringement Chart—HTC Wing. Fractus, 2009.

Infringement Chart—HTC Wing. Patent: 7015868. Fractus, 2009.
Infringement Chart—HTC Wing. Patent: 7123208. Fractus, 2009.
Infringement Chart—HTC Wing. Patent: 7394432. Fractus, 2009.
Infringement Chart—HTC Wing. Patent: 7397431. Fractus, 2009.
Infringement Chart—HTC Wing. Patent: 7528782. Fractus, 2009.
Infringement Chart—Kyocera Jax. Fractus, 2009.
Infringement Chart—Kyocera Jax. Patent: 7015868. Fractus, 2009.
Infringement Chart—Kyocera Jax. Patent: 7123208. Fractus, 2009.
Infringement Chart—Kyocera Jax. Patent: 7394432. Fractus, 2009.
Infringement Chart—Kyocera Jax. Patent: 7397431. Fractus, 2009.
Infringement Chart—Kyocera Jax. Patent: 7528782. Fractus, 2009.
Infringement Chart—Kyocera MARBL. Fractus, 2009.
Infringement Chart—Kyocera MARBL. Patent: 7015868. Fractus, 2009.
Infringement Chart—Kyocera MARBL. Patent: 7123208. Fractus, 2009.
Infringement Chart—Kyocera MARBL. Patent: 7397431. Fractus, 2009.
Infringement Chart—Kyocera MARBL. Patent: 7528782. Fractus, 2009.
Infringement Chart—Kyocera NEO E1100. Fractus, 2009.
Infringement Chart—Kyocera NEO E1100. Patent: 7015868. Fractus, 2009.
Infringement Chart—Kyocera NEO E1100. Patent: 7123208. Fractus, 2009.
Infringement Chart—Kyocera NEO E1100. Patent: 7394432. Fractus, 2009.
Infringement Chart—Kyocera NEO E1100. Patent: 7397431. Fractus, 2009.
Infringement Chart—Kyocera NEO E1100. Patent: 7528782. Fractus, 2009.
Infringement Chart—Kyocera S2400. Fractus, 2009.
Infringement Chart—Kyocera S2400. Patent: 7015868. Fractus, 2009.
Infringement Chart—Kyocera S2400. Patent: 7123208. Fractus, 2009.
Infringement Chart—Kyocera S2400. Patent: 7394432. Fractus, 2009.
Infringement Chart—Kyocera S2400. Patent: 7397431. Fractus, 2009.
Infringement Chart—Kyocera S2400. Patent: 7528782. Fractus, 2009.
Infringement Chart—Kyocera Wildcard M1000. Fractus, 2009.
Infringement Chart—Kyocera Wildcard M1000. Patent: 7015868. Fractus, 2009.
Infringement Chart—Kyocera Wildcard M1000. Patent: 7123208. Fractus, 2009.
Infringement Chart—Kyocera Wildcard M1000. Patent: 7397431. Fractus, 2009.
Infringement Chart—Kyocera Wildcard M1000. Patent: 7528782. Fractus, 2009.
Infringement Chart—LG 300G. Fractus, 2009.
Infringement Chart—LG 300G. Patent: 7015868. Fractus, 2009.
Infringement Chart—LG 300G. Patent: 7123208. Fractus, 2009.
Notice of compliance with motion practice orders, Feb. 14, 2011.
Reply brief in support of Defendant's motion for reconsideration of the court's ruling on the term "at least a portion" in the court's Dec. 17, 2010 claim construction order based on newly-available evidence, dated on Feb. 25, 2011.
Defendants Samsung Electronics Co Ltd (et al) second amended answer and counterclaims to the second amended complaint of plaintiff Fractus SA, dated on Feb. 28, 2011.
Defendants LG Electronics Inc, LG Electronics USA, and LG Electronics Mobilecomm USA Inc's second amended answer and counterclaim to second amended complaint, dated on Feb. 28, 2011.
Declaration of Jeffery D. Baxter—Including Exhibits: J, K, L, M , N ,O, P, Q, R, S, T, U, Z, AA, KK, LL, WW, BBB, EEE, GGG, HHH, III, KKK, MMM, NNN, OOO, PPP, QQQ, TTT, UUU, VVV, WWW, YYY, ZZZ, AAAA, BBBB, dated on Jul. 30, 2010.
Response to office action for U.S. Appl. No. 95/001455 dated on Nov. 19, 2010.
Response to office action for U.S. Appl. No. 95/001455 dated on Nov. 19—Exhibits, 2010.
Defendant Pantech Wireless Inc amended answer, affirmative defenses, and counterclaims to Fractus' second amended complaint, dated on Feb. 28, 2011.
Rebuttal expert report of Dr. Stuart A. Long (redacted version), dated on Feb. 16, 2011.
Rebuttal expert report of Dr. Warren L. Stutzman (redacted version), dated on Feb. 16, 2011.
Rebuttal expert report of Dr. Dwight L. Jaggard (redacted version), dated on Feb. 16, 2011.
Munson, R. E., "Conformal Microstrip Antennas and Microstrip Phased Arrays," IEEE Trans. Antennas Propagat., vol. Ap-22, p. 74, Jan. 1974.
Mushiake, Yasuto, Self-Complementary Antennas: Principle of Self-Complementarity for Constant Impedance, London, Springer-Verlag London Limited, 1996.
Nadan, T. Le, Coupez, J. P., Toutain, S. And Person, C., "Integration of an Antenna/Filter Device, Using a Multi-Layer, Multi-Technology Process," 28th European Microwave Conference, vol. 1, Oct. 1998.
Nagai, Kiyoshi, Mikuni, Yoshihiko and Iwasaki, Hisao, "A Mobile Radio Antenna System Having a Self-Diplexing Function," IEEE Transactions on Vehicular Technology, 28, Nov. 4, 1979.
Nakano and Vichien, "Dual-Frequency Square Patch Antenna with Rectangular Notch," Electronics Letters, vol. 25 No. 16, Aug. 3, 1989.
Nishikawa, T., Ishikawa, Y., Hattori, J. and Wakino, K. "Dielectric Receiving Filter with Sharp Stopband Using an Active Feedback Resonator Method for Cellular Base Stations," IEEE Transactions on Microwave Theory and Techniques, 37, Dec. 12, 1989.
Photos of Nokia 3210 product (1999 or earlier).
Turner and Richard, "Development of an Electrically Small Broadband Antenna," presented at the Eighteenth Symposium on The USAF Antenna Research and Development Program, Oct. 15-17, 1968.
Photos of Nokia 8210 product (1999 or earlier).
Photos of Nokia 8260 product (1999 or earlier).
Photos of Nokia 8265 product (1999 or earlier).
Photos of Nokia 8810 product (1998 or earlier).
Photos of Nokia 8850 product (1999 or earlier).
Photos of Nokia 8860 product (1999 or earlier) and Nokia FCC report reply dated on Jun. 24, 1999.
Omar et al., "A New Broad-band Dual-Frequency Coplanar Waveguide Fed Slot- Antenna," IEEE, 1999.
Ou, J. D. et al., "An Analysis of Annular, Annular Sector, and Circular Sector Microstrip Antennas," 1981 Antenna Applications Symposium, Sep. 23-25, 1981.
Paschen, D.A. & Mayes, P.E., "Structural Stropband Elimination with the Monopole-Slot Antenna," 1982 Antenna Applications Symposium, Sep. 22-24, 1982.
Paschen, D.A., "Broadband Microstrip Matching Techniques," 1983 Antenna Applications Symposium, Sep. 21-23, 1983.
Phelan, H.R., "A Wide-Band Parallel-Connected Balun," The Eighteenth Symposium on the USAF Antenna Research and Development Program, Oct. 15-17, 1968.
Pozar, David M., Microwave Engineering, Reading, MA, Addison-Wesley, 1990.
Rensh, "Broadband Microstrip Antenna," Proceedings of the Moscow International Conference on Antenna Theory and Tech. 1998, vol. 28, pp. 420-423 (Sep. 22, 1998).
The Glen L. Martin Company, "Antennas for USAF B-57 Series Bombers" The Second Symposium on the USAF Antenna Research and Development Program, Oct. 19-23, 1952.
Terman, F. E., Radio Engineering, New York, McGraw-Hill Book Company, 1947.
Rockwell B-1B Lancer <http://home.att.net/~jbaugher2inewb1_2.html> (last visited Feb. 17, 2010).
Rosa, J. et al., "A Wide Angle Circularly Polarized Omnidirectional Array Antenna," The Eighteenth Symposium on the USAF Antenna Research and Development Program, Oct. 15-17, 1968.
Rotman, W., "Problems Encountered in the Design of Flush-Mounted Antennas for High Speed Aircraft," The Second Symposium on the USAF Antenna Research and Development Program, Oct. 19-23, 1952.

Rudge, A. W., Milne, K., Olver, A. D. and Knight P., (eds.), The Handbook of Antenna Design, vols. 1 and 2, London, Peter Peregrinus Ltd., 1986.
Rumsey, Victory H., Frequency Independent Antennas, New York, Academic Press, 1966.
Sandlin, B.S., Terzuoli, A.J., "A Genetic Antenna Design for Improved Radiation Over Earth," Program for 1997 Antenna Applications Symposium (Allerton Conference Proceedings), Sep. 17-18, 1997.
Saunders, Simon R., Antennas and Propagation for Wireless Communication Systems, Chichester, John Wiley & Sons, Ltd., 1999.
Scharfman, W., et al. "Telemetry Antennas for High-Altitude Missiles," The Eighth Symposium on the USAF Antenna Research and Development Program, Oct. 20-24, 1958.
Schaubert, Chang and Wunsch, "Measurement of Phased Array Performance at Arbitrary Scan Angles," presented at the 1994 Antenna Applications Symposium on Sep. 21, 1994.
Seavy, J. et al., "C-Band Paste-On and Floating Ring Reflector Antennas," The Twenty-Third Symposium on the USAF Antenna Research and Development Program, Oct. 10-12, 1973.
Shenoy, A., Chalmers, H., Carpenter, E., Bonetti, R. and Wong, A., "Notebook Satcom Terminal Technology Development," Tenth International Conference on Digital Satellite Communications, May 15-19, 1995.
Shibagaki, N. Sakiyama, K. and Hikita, M., "SAW Antenna Duplexer Module Using SAW-Resonator-Coupled Filter for PCN System," 1998 IEEE Ultrasonics Symposium, 1, Oct. 5-8, 1998.
Shibagaki, N., Sakiyama, K. and Hikita, M. "Miniature SAW Antenna Duplexer Module for 1.9 GHz PCN Systems Using SAW-Resonator-Coupled Filters," 1998 IEEE Ultrasonics Symposium, 2, Jun. 7-12, 1998.
Shimoda, R.Y., "A Variable Impedance Ratio Printed Circuit Balun," 1979 Antenna Applications Symposium, Sep. 26-18, 1979.
Shnitkin, "Analysis of Log-Periodic Folded Dipole Array" (Sep. 1992).
Sinclair, "Theory of Models of Electromagnetic Systems," Proceedings of the IRE, Nov. 1948.
Snow, W. L., et al. "Ku-Band Planar Spiral Antenna," The Nineteenth Symposium on the USAF Antenna Research and Development Program, Oct. 14-16, 1969.
Snow, W. L., "Uhf Crossed-Slot Antenna and Applications," The Thirteenth Symposium on the USAF Antenna Research and Development Program, Oct. 14-18, 1963.
Stang, Abstracts of the 12th Annual Symposium (Oct. 16-19, 1962).
Stang, Paul F., "Balanced Flush Mounted Log-Periodic Antenna for Aerospace Vehicles," Twelfth Annual Symposium on USAF Antenna Research and Development, vol. 1, Oct. 16-19, 1962.
Stutzman, "Antenna Theory and Design," 2nd ed., 1998.
Taga, Tokio and Tsunekawa, Kouichi, "Performance Analysis of a Built-In Planar Inverted F Antenna for 800 MHz Band Portable Radio Units," IEEE Journal on Selected Areas in Communications, vol. SAC-5, No. 5, Jun. 1987.
Tanner, Robert L., et al., "Electronic Counter Measure Antennas for a Modern Electronic Reconnaissance Aircraft," The Fourth Symposium on the USAF Antenna Research and Development Program, Oct. 17-21, 1954.
Teeter, W. L. and Bushore, K. R., "A Variable-Ratio Microwave Power Divider and Multiplexer," IRE Transactions on Microwave Theory and Techniques, 5, Oct. 4, 1957.
Defendant, LG Electronics Mobilecomm USA., Inc.'s Answer and Counterclaim to Fractus' Complaint in the case of *Fractus SA* v. *Samsung Electornics Co. Ltd. et al*. Case No. 6:09-cv-00203 (E.D. Tex.) dated Oct. 1, 2009.
Defendants, LG Electronics Inc., LG Electronics USA, Inc., and LG Electronics Mobilecomm USA Inc. Answer and Counterclaim to Amended Complaint in the case of *Fractus SA* v. *Samsung Electornics Co. Ltd. et al*. Case No. 6:09-cv-00203 (E.D. Tex.) dated Oct. 1, 2009.
Defendants, Research in Motion LTD, and Research in Motion Corporation's Answers, Defenses and Counterclaims to Plaintiff's Amended Complaint in the case of *Fractus SA* v. *Samsung Electornics Co. Ltd*. et al. Case No. 6:09-cv-00203 (E.D. Tex.) dated Oct. 1, 2009.
Defendants, Samsung Electronics Co., Ltd.'s; Samsung Electronics Research Institute's and Samsung Semiconductor Europe GMBH' s Answer; and Samsung Telecommunications America LLC' s Answer and Counterclaim to the Amended Coplaint of Plaintiff in the case of *Fractus SA* v. *Samsung Electornics Co. Ltd*. et al. Case No. 6:09-cv-00203 (E.D. Tex.) dated Oct. 1, 2009.
Defendants, HTC America, Inc's First Amended Answer and Counterclaims to Plaintiff's Amended Complaint in the case of *Fractus SA* v. *Samsung Electornics Co. Ltd*. et al. Case No. 6:09-cv-00203 (E.D. Tex.) dated Oct. 2, 2009.
Love , J. D., Memorandum order and opinion. Court. Dec. 17, 2010.
Defendants, Research in Motion LTD, and Research in Motion Corporation's Amended Answer, Defenses and Counterclaims to Plaintiffs Amended Complaint in the case of *Fractus SA* v. *Samsung Electornics Co. Ltd*. et al. Case No. 6:09-cv-00203 (E.D. Tex.) dated Nov. 24, 2009.
Defendant, Personal Communications Device Holdings, LLC Answer, Affirmative defenses and Counterclaims to the Second Amended Complaint in the case of *Fractus SA* v. *Samsung Electornics Co. Ltd*. et al. Case No. 6:09-cv-00203 (E.D. Tex.) dated Dec. 17, 2009.
Defendant, HTC America, Inc's Answer and Counterclaims to Plaintiff's Second Amended Complaint in the case of *Fractus SA* v. *Samsung Electornics Co. Ltd*. et al. Case No. 6:09-cv-00203 (E.D. Tex.) dated Dec. 21, 2009.
Defendant, HTC Corporation's Answer and Counterclaims to Plaintiff's Second Amended Complaint in the Case of *Fractus SA* v. *Samsung Electornics Co. Ltd*. et al. Case No. 6:09-cv-00203 (E.D. Tex.) dated Dec. 21, 2009.
Defendant, Pantech Wireless, Inc's Answer, Affirmative Defenses and Counterclaims to Plaintiff's Second Amended Complaint in the case of *Fractus SA* v. *Samsung Electornics Co. Ltd*. et al. Case No. 6:09-cv-00203 (E.D. Tex.) dated Dec. 21, 2009.
Defendant, Research in Motion LTD and Research in Motion Corporation's Second Answer, Defenses and Counterclaims to Plaintiff's Second Amended Complaint in the case of *Fractus SA* v. *Samsung Electornics Co. Ltd*. et al. Case No. 6:09-cv-00203 (E.D. Tex.) dated Dec. 21, 2009.
Defendant, Kyocera Communications Inc's Answer, Affirmative Defenses and Counterclaims to Second Amended Complaint in the case of *Fractus SA* v. *Samsung Electornics Co. Ltd*. et al. Case No. 6:09-cv-00203 (E.D. Tex.) dated Dec. 22 ,2009.
Defendant, Kyocera Wireless Corp's Answer, Affirmative Defenses and Counterclaims to Plaintiff's Second Amended Complaint in the case of *Fractus SA* v. *Samsung Electornics Co. Ltd*. et al. Case No. 6:09-cv-00203 (E.D. Tex.) dated Dec. 22, 2009.
Defendant, Palm, Inc's Answer, Affirmative Defenses and Counterclaims to Second Amended Complaint in the case of *Fractus SA* v. *Samsung Electornics Co. Ltd*. et al. Case No. 6:09-cv-00203 (E.D. Tex.) dated Dec. 22, 2009.
Defendant, Sanyo Electric Co. LTD's Answer to Second Amended Complaint for Patent Infringement in the case of *Fractus SA* v. *Samsung Electornics Co. Ltd*. et al. Case No. 6:09-cv-00203 (E.D. Tex.) dated Dec. 22, 2009.
Defendant, Sanyo North America Corporation's Answer to Second Amended Complaint in the case of *Fractus SA* v. *Samsung Electornics Co. Ltd*. et al. Case No. 6:09-cv-00203 (E.D. Tex.) dated Dec. 22, 2009.
Defendant, UTStarcom, Inc's Answer, Affirmative Defenses and Counterclaims to Second Amended Complaint in the case of *Fractus SA* v. *Samsung Electornics Co. Ltd*. et al. Case No. 6:09-cv-00203 (E.D. Tex.) dated Dec. 22, 2009.
Defendants, Samsung Electronics Co., Ltd.'s; Samsung Electronics Research Institute's and Samsung Semiconductor Europe GMBH's Answer; and Samsung Telecommunications America LLC's Answer and Counterclaim to Second Amended Complaint in the case of *Fractus SA* v. *Samsung Electornics Co. Ltd*. et al. Case No. 6:09-cv-00203 (E.D. Tex.) dated Dec. 23, 2009.
Defendants, LG Electronics Inc., LG Electronics USA, Inc., and LG Electronics Mobilecomm USA Inc. Answer and Counterclaim to Second Amended Complaint in the case of *Fractus SA* v. *Samsung Electornics Co. Ltd*. et al. Case No. 6:09-cv-00203 (E.D. Tex.) dated Dec. 28, 2009.

Defendant, Sharp's Answer to Second Amended Complaint in the case of *Fractus SA* v. *Samsung Electornics Co. Ltd.* et al. Case No. 6:09-cv-00203 (E.D. Tex.) dated Dec. 29, 2009.
Defendants, LG Electronics Inc., LG Electronics USA, Inc., and LG Electronics Mobilecomm USA Inc. First Amended Answer and Counterclaim to Second Amended Complaint in the case of *Fractus SA* v. *Samsung Electornics Co. Ltd.* et al. Case No. 6:09-cv-00203 (E.D. Tex.) dated Jan. 24, 2010.
Defendant, HTC America, Inc's Amended Answer and Counterclaim to Plaintiff's Second Amended Complaint in the case of *Fractus SA* v. *Samsung Electornics Co. Ltd.* et al. Case No. 6:09-cv-00203 (E.D. Tex.) dated Feb. 24, 2010.
Defendant, HTC Corporation's Amended Answer and Counterclaim to Plaintiff's Second Amended Complaint in the case of *Fractus SA* v. *Samsung Electornics Co. Ltd.* et al. Case No. 6:09-cv-00203 (E.D. Tex.) dated Feb. 24, 2010.
Defendant, Sharp's Amended Answer to Second Amended Complaint in the case of *Fractus SA* v. *Samsung Electornics Co. Ltd.* et al. Case No. 6:09-cv-00203 (E.D. Tex.) dated Feb. 24, 2010.
Defendants, Samsung Electronics Co., Ltd.'s; Samsung Electronics Research Institute's and Samsung Semiconductor Europe GMBH's First Amended Answer; and Samsung Telecommunications America LLC's First Amended Answer and Counterclaim to the Second Amended Complaint in the case of *Fractus SA* v. *Samsung Electornics Co. Ltd.* et al. Case No. 6:09-cv-00203 (E.D. Tex.) dated Feb. 24, 2010.
Defendant, HTC America, Inc.'s Amended Answer and Counterclaim to Plaintiff's Second Amended Complaint in the case of *Fractus SA* v. *Samsung Electornics Co. Ltd.* et al. Case No. 6:09-cv-00203 (E.D. Tex.) dated Feb. 25, 2010.
Defendant, HTC Corporation's Amended Answer and Counterclaim to Plaintiff's Second Amended Complaint in the case of *Fractus SA* v. *Samsung Electornics Co. Ltd.* et al. Case No. 6:09-cv-00203 (E.D. Tex.) dated Feb. 25, 2010.
Fractus, Civil Cover Sheet in the case of *Fractus SA* v. *Samsung Electornics Co. Ltd.* et al. Case No. 6:09-cv-00203 (E.D. Tex.) dated May 5, 2009.
Fractus, Complaint for Patent Infringement in the case of *Fractus SA* v. *Samsung Electornics Co. Ltd.* et al. Case No. 6:09-cv-00203 (E.D. Tex.) dated May 5, 2009.
Fractus, Amended Complaint for Patent Infringement in the case of *Fractus SA* v. *Samsung Electornics Co. Ltd.* et al. Case No. 6:09-cv-00203 (E.D. Tex.) dated May 6, 2009.
Fractus, Fractus's Answer to Defendant Pantech Wireless, Inc.'s Counterclaims in the case of *Fractus SA* v. *Samsung Electornics Co. Ltd.* et al. Case No. 6:09-cv-00203 (E.D. Tex.) dated Jun. 24, 2009.
Fractus, Answer to Defendant UTStarcom, Inc.'s Counterclaims in the case of *Fractus SA* v. *Samsung Electornics Co. Ltd.* et al. Case No. 6:09-cv-00203 (E.D. Tex.) dated Jun. 29, 2009.
Fractus, Second Amended Complaint for Patent Infringement in the case of *Fractus SA* v. *Samsung Electornics Co. Ltd.* et al. Case No. 6:09-cv-00203 (E.D. Tex.) dated Dec. 2, 2009.
Fractus, Second Amended Complaint for Patent Infringement in the case of *Fractus SA* v. *Samsung Electornics Co. Ltd.* et al. Case No. 6:09-cv-00203 (E.D. Tex.) dated Dec. 8, 2009.
Fractus, Answer to Counterclaims of Defendant Kyocera Communications, Inc's Counterclaims to the Second Amended Complaint in the case of *Fractus SA* v. *Samsung Electornics Co. Ltd.* et al. Case No. 6:09-cv-00203 (E.D. Tex.) dated Jan. 4, 2010.
Fractus, Answer to Counterclaims of Defendant Pantech Wireless, Inc. to the Second Amended Complaint in the case of *Fractus SA* v. *Samsung Electornics Co. Ltd.* et al. Case No. 6:09-cv-00203 (E.D. Tex.) dated Jan. 4, 2010.
Fractus, Answer to Counterclaims of Defendant Samsung Telecommunications America Llc to the Second Amended Complaint in the case of *Fractus SA* v. *Samsung Electornics Co. Ltd.* et al. Case No. 6:09-cv-00203 (E.D. Tex.) dated Jan. 4, 2010.
Fractus, Answer to Counterclaims of Defendants LG Electronics Inc., Electronics USA, Inc., and LG Electronics Mobilecomm USA, Inc. to the Second Amended Complaint in the case of *Fractus SA* v. *Samsung Electornics Co. Ltd.* et al. Case No. 6:09-cv-00203 (E.D. Tex.) dated Jan. 4, 2010.
Fractus, Answer to Defendant Kyocera Wireless Corp's Counterclaims to the Second Amended Complaint in the case of *Fractus SA* v. *Samsung Electornics Co. Ltd.* et al. Case No. 6:09-cv-00203 (E.D. Tex.) dated Jan. 4, 2010.
Fractus, Answer to Defendant Palm, Inc's Counterclaims to the Second Amended Complaint in the case of *Fractus SA* v. *Samsung Electornics Co. Ltd.* et al. Case No. 6:09-cv-00203 (E.D. Tex.) dated Jan. 4, 2010.
Fractus, Answer to Defendant Personal Communications Devices Holdings, LLC's Counterclaims to the Second Amended Complaint in the case of *Fractus SA* v. *Samsung Electornics Co. Ltd.* et al. Case No. 6:09-cv-00203 (E.D. Tex.) dated Jan. 4, 2010.
Fractus, Answer to Defendant UTStarcom, Inc's Counterclaims to the Second Amended Complaint in the case of *Fractus SA* v. *Samsung Electornics Co. Ltd.* et al. Case No. 6:09-cv-00203 (E.D. Tex.) dated Jan. 4, 2010.
Fractus, Answer to the Counterclaims of Defendants Research in Motion Ltd. and Research in Motion Corporation to the Second Amended Complaint in the case of *Fractus SA* v. *Samsung Electornics Co. Ltd.* et al. Case No. 6:09-cv-00203 (E.D. Tex.) dated Jan. 4, 2010.
Fractus, Answer to Counterclaims of Defendants HTC America, Inc to the Second Amended Complaint in the case of *Fractus SA* v. *Samsung Electornics Co. Ltd.* et al. Case No. 6:09-cv-00203 (E.D. Tex.) dated Jan. 14, 2010.
Fractus, Answer to Amended Counterclaims of Defendant HTC America, Inc. to Second Amended Complaint in the case of *Fractus SA* v. *Samsung Electornics Co. Ltd.* et al. Case No. 6:09-cv-00203 (E.D. Tex.) dated Apr. 1, 2010.
Fractus, Answer to Amended Counterclaims of Defendant HTC Corporation to Second Amended Complaint in the case of *Fractus SA* v. *Samsung Electornics Co. Ltd.* et al. Case No. 6:09-cv-00203 (E.D. Tex.) dated Apr. 1, 2010.
Fractus, Answer to Amended Counterclaims of Defendant LG Electronics Inc., LG Electronics USA, Inc., and LG Electronics Mobilecomm USA Inc's to Second Amended Complaint in the case of *Fractus SA* v. *Samsung Electornics Co. Ltd.* et al. Case No. 6:09-cv-00203 (E.D. Tex.) dated Apr. 1, 2010.
Fractus, Answer to Amended Counterclaims of Defendant Samsung Telecommunications america LLC's to Second Amended Complaint in the case of *Fractus SA* v. *Samsung Electornics Co. Ltd.* et al. Case No. 6:09-cv-00203 (E.D. Tex.) dated Apr. 1, 2010.
Campos Escala, O. , Study of multiband and miniature fractal antennas. Final Year Project. UPC. Barcelona, UPC dated Jan. 1, 2007.
Crystal, E. et al. , Hairpin.lin and hybridhairpin.line . Half-wave parallel.coupled line filters. 20,Nov. 11, 1972, IEEE Trans on Micr. dated Nov. 11, 1972.
Kraus, Antennas, John Wiley and Sons dated Jan. 1, 1988 .
Lancaster et al, Superconducting filters using slow wave transmission lines, Advances in superconductivity. New materials, critical current and devices. , Proceedings of the international symposium. New age int, New Delhi, India, 1996. dated Jan. 1, 1996.
Mandelbrot, the fractal geometry of nature, W. H., Freeman and Co. dated Jan. 1, 1982.
Matthaei, G. et al. , Hairpin-comb filters for HTS and other narrow-band applications, IEEE Trans on Mic., 45,Aug. 8, 1997 dated Aug. 1, 1997.
Matthaei, G. et al. , Microwave filters, impedance-matching networks and coupling structures, Artech House, 1980 dated Jan. 1, 1980.
NA, www.fractus.com/main/fractus/corporate/, Fractus dated Oct. 7, 2010.
NA, www.tsc.upc.es/fractalcoms/, UPC dated Oct. 7, 2010.
Parker, E.A. , Convoluted dipole array elements, Electronic Letters dated Feb. 1, 1991.
Rolan, E, 296 International Search Report on Application No. ES99100296, EPO dated Mar. 29, 2001.
Feigel, International Preliminary Report 9089 International Preliminary Examining Authority, EPO dated Mar. 5, 2002.
Feigel, Examination Report 9089 Feb. 7, 2003 Examination Report, EPO dated Feb. 7, 2003.
Lee, B.T. , Office action in U.S. Appl. No. 10/181,790, USPTO dated Aug. 27, 2004.

Sauer, J.M., Response to the Office action in U.S. Appl. No. 10/182,635, Winstead dated Oct. 4, 2004.
Wimer, M., Office action in U.S. Appl. No. 10/182,635, USPTO dated Oct. 4, 2004.
Stiebe, M., Response to the Office action for the EP Patent Application No. 00909089, EPO dated Oct. 28, 2004.
Lee, B.T. , Office action in U.S. Appl. No. 10/181,790, USPTO dated Dec. 10, 2004.
Nguyen, H., Office action for U.S. Appl. No. 10/182,635, USPTO dated Dec. 13, 2004.
Sauer, J.M., Response to the Office action in U.S. Appl. No. 10/182,635, Jones Day dated Dec. 13, 2004.
Lee, B.T. , Office action in U.S. Appl. No. 10/181,790, USPTO dated Mar. 2, 2005.
Sauer, J.M., Response to the Office action in U.S. Appl. No. 10/181,790, Jones Day dated Mar. 2, 2005.
Lee, B.T. , Office action in U.S. Appl. No. 10/181,790, USPTO dated Jun. 2, 2005.
Sauer, J.M., Response to the Office action in U.S. Appl. No. 10/181,790, Jones Day dated Jun. 2, 2005.
Lee, B.T. , Office action in U.S. Appl. No. 10/181,790, USPTO dated Aug. 4, 2005.
Wimer, M., Office action in U.S. Appl. No. 10/422,578, USPTO dated Aug. 24, 2005.
Wimer, M., Office action in U.S. Appl. No. 10/422,578, USPTO dated Jan. 26, 2006.
Office action for the Chinesse Patent Application No. 01823716, CCPIT Patent and Trademark Law Office dated Feb. 16, 2007.
Mitanyi, Response to the office action for the U.S. Appl. No. 11/021,597, Winstead dated Mar. 12, 2007.
Wimer, M., Office action in U.S. Appl. No. 10/422,578, USPTO dated Mar. 12, 2007.
Wimer, M., Office action in U.S. Appl. No. 11/021597, USPTO dated Mar. 12, 2007.
Lee, B.T. , Office action in U.S. Appl. No. 10/797732, USPTO dated Aug. 9, 2007.
Response to the Office action for the Chinesse Patent Application No. 01823716, CCPIT Patent and Trademark Law Office dated Aug. 21, 2007.
Wimer, M., Office action in U.S. Appl. No. 10/422,578, USPTO dated Aug. 23, 2007.
Mitanyi, Response to the office action for the U.S. Appl. No. 11/021,597, Winstead dated Oct. 30, 2007.
Wimer, M., Office action in U.S. Appl. No. 11/021,597, USPTO dated Oct. 30, 2007.
Office action for the Chinesse patent application 01823716, CCPIT Patent and Trademark Law Office dated Dec. 10, 2007.
Notice of Appeal in EP Patent Application No. 05012854, EPO dated Dec. 19, 2007.
Wimer, M., Office action in U.S. Appl. No. 10/422,578, USPTO dated Mar. 26, 2008.
NA, Statement setting out the grounds of appeal for the EP Patent Application No. 05012854, Herrero y Asociados dated Nov. 3, 2008.
Nguyen, H., Office action for U.S. Appl. No. 12/347,462, USPTO dated Oct. 28, 2009.
Defendant, Pantech Wireless, Inc.'s Answer, Affirmative Defenses and Counterclaims to Fractus' Amended Complaint in the case of *Fractus SA* v. *Samsung Electornics Co. Ltd.* et al. Case No. 6:09-cv-00203 (E.D. Tex.) dated Jun. 4, 2009.
Defendant, UTStarcom, Inc.'s Answer, Affirmative Defenses, and Counterclaims to Fractus' Amended Complaint in the case of *Fractus SA* v. *Samsung Electornics Co. Ltd.* et al. Case No. 6:09-cv-00203 (E.D. Tex.) dated Jun. 8, 2009.
Defendant, Personal Communications Devices Holdings, LLC's Answer, Affirmative Defenses and Counterclaims to Fractus' Amended Complaint in the case of *Fractus SA* v. *Samsung Electornics Co. Ltd.* et al. Case No. 6:09-cv-00203 (E.D. Tex.) dated Jul. 20, 2009.
Defendant, Sanyo North America Corporation's Partial Answer to Amended Complaint for Patent Infringement in the case of *Fractus SA* v. *Samsung Electornics Co. Ltd.* et al. Case No. 6:09-cv-00203 (E.D. Tex.) dated Jul. 20, 2009.
Defendant, Kyocera Communications Inc's Answer, Affirmative Defenses and Counterclaims to Plantiffs Amended Complaint in the case of *Fractus SA* v. *Samsung Electornics Co. Ltd.* et al. Case No. 6:09-cv-00203 (E.D. Tex.) dated Jul. 21, 2009.
Defendant, Kyocera Wireless Corp's Answer, Affirmative Defenses and Counterclaims to Plantiffs Amended Complaint in the case of *Fractus SA* v. *Samsung Electornics Co. Ltd.* et al. Case No. 6:09-cv-00203 (E.D. Tex.) dated Jul. 21, 2009.
Defendant, Palm Inc.'s Answer, Affirmative Defenses and Counterclaims to Plaintiffs Amended complaint in the case of *Fractus SA* v. *Samsung Electornics Co. Ltd.* et al. Case No. 6:09-cv-00203 (E.D. Tex.) dated Jul. 21, 2009.
Defendant, HTC America Inc's Answer and Counterclaim to Plaintiffs Amended Complaint in the case of *Fractus SA* v. *Samsung Electornics Co. Ltd.* et al. Case No. 6:09-cv-00203 (E.D. Tex.) dated Sep. 25, 2009.
Defendant, HTC Corporation's Answer and Counterclaim to Plaintiffs Amended Complaint in the case of *Fractus SA* v. *Samsung Electornics Co. Ltd.* et al. Case No. 6:09-cv-00203 (E.D. Tex.) dated Sep. 25, 2009.
Phan , T. Notice of allowance of U.S. Appl. No. 11/179,257 dated Aug. 2, 2007. USPTO, 2007.
Phan , T. Notice of allowance of U.S. Appl. No. 11/179,257 dated Nov. 26, 2007. USPTO, 2007.
Phan , T. Notice of allowance of U.S. Appl. No. 11/780,932 dated Oct. 1, 2008. USPTO, 2008.
Anguera , J. ; Puente , C. ; Borja , C. A procedure to design stacked microstrip patch antennas on a simple network model. Microwave and Optical Technology Letters, 2001.
Bach Andersen , J. et al. On closely coupled dipoles in a random field. IEEE Antennas and Wireless Propagation Letters, 2006.
Lu , Jui Han. Single-feed circularly polarized triangular microstrip antenna with triangular slot for compact operation. Microwave and Optical Technology Letters, 2002.
Shih-Chao , C. Office Action for U.S. Appl. No. 11/796,368 dated on Jun. 25, 2010. USPTO, 2010.
Werner , D. H. ; Werner , R L ; Ferrare , A. J. Frequency independent features of self-similar fractal antennas. AP-S Digest Antennas and Propagation Society International Symposium, 1996.
Werner , D. H. Fractal antenna engineering—The theory and design of fractal antenna arrays. IEEE Antennas and Propagation Magazine, 1999.
Liu , Z. ; Hall , P.S. A novel dual-band antenna for hand-held portable telephone. AP-S. Digest Antennas and Propagation Society International Symposium, 1996.
Ellis , A. R. Airborne UHF antenna pattern improvements. 3rd Symposium on the USAF antenna research and development program, 1953.
Carver , K. R. et al. Microstrip antenna technology. In "Microstrip antennas" to D.M. Pozar; IEEE Antennas and Propagation Society, 1995.
Snow , W. L. UHF crossed-slot antenna and applications. 19th Symsposium on the USAF Antenna Research and Development program, 1963.
Samsung Electronics Co. Ltd. (Defendants). Request for Inter Partes reexamination of US Patent 7123208—CC-A—Claim Chart comparing claims 1, 5, 10-12, 14, 15, 18, 21, 24-26, 28, 29, 33, 37, 40, 43-48, 54, 57-59, and 61 of US7123208 to Yanagisawa. USPTO, 2010.
Samsung Electronics Co. Ltd. (Defendants). Request for Inter Partes reexamination of US Patent 7123208—CC-B—Claim Chart comparing claims 1, 5, 7, 10-12, 14, 15, 18, 21, 24-26, 28, 29, 33, 37, 40, 43-48, 54, 57-59, and 61 of US 7123208 to Cohen. USPTO, 2010.
Samsung Electronics Co. Ltd. (Defendants). Request for Inter Partes reexamination of US Patent 7123208—CC-C—Claim Chart comparing claims 1, 5, 7, 11, 12, 14, 15,18, 21, 25, 26, 28, 29, 33, 37, 40, 44, 45, 47, 48, 54, 58, 59 and 61 of US7123208 to Puente Baliarda Dissertation. USPTO, 2010.
Samsung Electronics Co. Ltd. (Defendants). Request for Inter Partes reexamination of US Patent 7123208—Samsung SCH-R500. USPTO, 2010.

Samsung Electronics Co. Ltd. (Defendants). Request for Inter Partes reexamination of US Patent 7015868—CC-A—Claim Chart comparing claims 1, 3, 6, 12, 14, 23, 26, and 33-35 of US7015868 to Korisch. USPTO, 2010.
Samsung Electronics Co. Ltd. (Defendants). Request for Inter Partes reexamination of US Patent 7015868—Cc-B—Claim Chart comparing claim 12 of US7015868 to Korish in view of Kitchener. USPTO, 2010.
Samsung Electronics Co. Ltd. (Defendants). Request for Inter Partes reexamination of US Patent 7015868—CC-C—Claim Chart comparing claims 1, 3, 6, 12, 23, and 33-35 of US7015868 to Kitchener. USPTO, 2010.
Samsung Electronics Co. Ltd. (Defendants). Request for Inter Partes reexamination of US Patent 7015868—CC-D—Claim Chart comparing claims 14 and 26 of US7015868 to Kitchener in view of Korish. USPTO, 2010.
Samsung Electronics Co. Ltd. (Defendants). Request for Inter Partes reexamination of US Patent 7015868—CC-E—Claim Chart comparing claims 1, 3, 6, 12, 14, 23, and 33-35 of US7015868 to Cohen. USPTO, 2010.
Samsung Electronics Co. Ltd. (Defendants). Request for Inter Partes reexamination of US Patent 7015868—CC-F—Ciam Chart comparing claim 12 of US7015868 to Cohen in view of Kitchener. USPTO, 2010.
Samsung Electronics Co. Ltd. (Defendants). Request for Inter Partes reexamination of US Patent 7015868—CC-G—Claim Chart comparing claims 14 and 26 of US7015868 to Cohen in the view of Korish. USPTO, 2010.
Fractus, S. A. Vs Samsung, Lg, Rim, Pantech, Kyocera, Palm, HTC, Sharp, UTStarcom, and Sanyo. Request for Inter Partes reexamination of US Patent 70115868—Civil Action Case 6:09cv-0203-Second Amended Complaint. USPTO, 2009.
Samsung Electronics Co. Ltd. (Defendants). Request for Inter Partes reexamination of US Patent 70115868—Samsung Instinct M800. USPTO, 2010.
Howison and Arnott. Amendment and response to office action dated Feb. 4, 2008 of the U.S. Appl. No. 11/179,257. USPTO, Feb. 27, 2008.
Howison and Arnott. Amendment and response to office action dated Jan. 15, 2008 of U.S. Appl. No. 11/550,256. USPTO, Feb. 27 2008.
Fractus. Amendment and response to Office Action dated Jan. 23, 2004 of U.S. Appl. No. 10/102,568. USPTO, May 26, 2004.
Howison and Arnott. Amendment and response to Office Action dated Jul. 22, 2008 of U.S. Appl. No. 11/780,932. USPTO, Aug. 6, 2008.
Howison and Arnott. Amendment and response to Office Action dated Jun. 9, 2008 of U.S. Appl. No. 11/550,276. USPTO, Jul. 7, 2008.
Howison and Arnott. Amendment and response to Office Action dated Jun. 15, 2005 of the U.S. Appl. No. 10/963,080. USPTO, Aug. 18, 2005.
Howison and Arnott. Amendment and response to office action dated Sep. 21, 2006 of U.S. Appl. No. 11/179,257. USPTO, 2006.
Phan , T. Notice of allowance of U.S. Appl. No. 10/102,568 dated Jul. 2, 2004. USPTO, 2004.
Phan , T. Notice of allowance of U.S. Appl. No. 10/963,080 dated Sep. 1, 2005. USPTO, 2005.
Phan , T. Notice of allowance of U.S. Appl. No. 11/1023,90 dated Jul. 6, 2006. USPTO, 2006.
Phan , T. Notice of allowance of U.S. Appl. No. 11/179,257 dated Oct. 19, 2006. USPTO, 2006.
Phan , T. Notice of allowance of U.S. Appl. No. 11/550,276 dated Jan. 13, 2009. USPTO, 2008.
Phan , T. Notice of allowance of U.S. Appl. No. 11/550,276 dated Sep. 17, 2008. USPTO, 2009.
Phan , T. Notice of allowance of U.S. Appl. No. 11/550,256 dated Mar. 28, 2008. USPTO, 2008.
Phan , T. Notice of allowance of U.S. Appl. No. 11/780,932 dated Jan. 28, 2009. USPTO, 2009.
Phan , T. Office Action for U.S. Appl. No. 10/102,568 dated on Jan. 23, 2004. USPTO, 2004.
Phan , T. Office Action for U.S. Appl. No. 10/963,080 dated on Jun. 15, 2005. USPTO, 2005.
Phan , T. Office Action for U.S. Appl. No. 11/179,257 dated on Aug. 23, 2006. USPTO, 2006.
Phan , T. Office Action for U.S. Appl. No. 11/179,257 dated on Feb. 4, 2008. USPTO, 2008.
Phan , T. Office Action for U.S. Appl. No. 11/179,257 dated on Sep. 21, 2006. USPTO, 2006.
Phan , T. Office Action for U.S. Appl. No. 11/550,256 dated on Jan. 15, 2008. USPTO, 2008.
Phan , T. Office Action for U.S. Appl. No. 11/550,276 dated on Jun. 9, 2008. USPTO, 2008.
Phan , T. Office Action for U.S. Appl. No. 11/780,932 dated on Jul. 22, 2008. USPTO, 2008.
Howison and Arnott. Response to office action dated Aug. 23, 2006 of U.S. Appl. No. 11/179,257. USPTO, Sep. 12, 2006.
Kopczyk , K. Supplemental Amendment to correct and inadvertent typographical error in the amendment filed in May 24, 2004 of U.S. Appl. No. 10/102,568. USPTO, Jun. 14, 2004.
Phan , T. Notice of allowance of U.S. Appl. No. 11/179,257 dated Apr. 23, 2007. USPTO, 2007.
Phan , T. Notice of allowance of U.S. Appl. No. 11/179,257 dated Jun. 8, 2007. USPTO, 2007.
Burnett, Antenna Installation on Super Constellation Airborne Early Warning and Control Aircraft (1954).
Blackband, W. T., "Coaxial Transmission Lines and Components," in A. W. Rudge, K. Milne, A. D. Olver, and P. Knight (eds.), The Handbook of Antenna Design, vols. 1 and 2, London, Peter Peregrinus Ltd., 1986.
Counter, V.A. Flush re-entrant, impedance phased circularly polarized cavity antenna for missiles . The Second Symposium on the USAF Antenna Research and Development Program, 1952.
Counter and Margerum, Flush Dielectric Disc Antenna for Radar (AllertonConference 1952).
FCC Form 731 filed Apr. 1, 1999.
GSM Technical Specification and related materials, Mar. 1996.
Photos of Hagenuk Global Handy (at least as early as 1996).
Photos of Motorola Advisor Elite (1997).
Photos of Motorola Advisor Gold (1996).
Photos of Motorola Bravo Plus (1995).
Photos of Nokia 3360 (1999).
Photos of RIM950 product (at least as early as 1998).
Photos of Motorola P935 product, (at least as early as 1997).
Photos of Motorola Page Writer 2000X product, (at least as early as 1997).
Felgel-Farnholz, W. Office Action for US patent application EP00909089, dated on Feb. 7, 2003.
Minutes of oral proceedings (including annexes) for EP patent 00909089.5, Jan. 28, 2005.
Summons to Attend Oral Proceedings for EP patent 00909089.5, Oct. 28, 2004.
Written Submissions for EP patent 00909089.5, Dec. 12, 2004.
Response Office Action for CN patent application 00818542.5 dated Nov. 5, 2004; Mar. 31, 2005.
Wimer, Michael C. USPTO Office Action for U.S. Appl. No. 10/422,578; Oct. 4, 2004.
Sauer, Joseph M. Response to the Office Action dated Oct. 4, 2004 for the U.S. Appl. No. 10/422,578; Jan. 6, 2005.
Wimer, Michael C. USPTO Office Action for U.S. Appl. No. 10/422,578; Apr. 7, 2005.
Sauer, Joseph M. Response to the Office Action dated Apr. 7, 2005 for the U.S. Appl. No. 10/422,578; May 31, 2005.
Wimer, Michael C. Advisory action before the filing of an appeal brief for U.S. Appl. No. 10/422,578; Jun. 23, 2005.
Sauer, J. Request for Continued Examination for U.S. Appl. No. 10/422,578; Aug. 8, 2005.
Wimer, M. Office action for US patent application US7312762; Oct. 5, 2006.
Sauer, J. Response to Office action for US patent application 7312762 dated on Dec. 27, 2006; Jan. 4, 2007.
Addison, Paul S. "Fractals and Chaos—An Illustrated Course" (Institute of Physics Publishing, Bristol and Philadelphia; IOP Publishing 1997), pp. 30, 31 & 33.
Balanis, Constantine A. "Antenna Theory" (1982, John Wiley & Sons, Inc.), selected pages.

Berizzi, Fabrizio et a/., "Fractal Analysis of the Signal Scattered from the Sea Surface" (IEEE Transactions on Antennas and Propagation, vol. 47, No. 2, Feb. 1999),pp. 324-338.
Boshoff, Hendrik F'v. "A Fast Box Counting Algorithm for Determining the Fractal Dimension of Sampled Continuous Functions" (1992 IEEE), pp. 43-48.
Carver, Keith R. et a/., "Microstrip Antenna Technology" (IEEE Transactions on Antennas and Propagation, vol. AP-29, No. 1, Jan. 1981), pp. 2-23.
Chen, Susan S. et a/., "On the Calculation of Fractal Features from Images" (IEEE Transactions on Pattern Analysis and Machine Intelligence, vol. 15, No. 10, Oct. 1993), pp. 1087-1090.
Falconer, Kenneth "Fractal Geometry—Mathematical Foundations and Applications" (2nd edition) (John Wiley & Sons. Ltd., 2003) (the first edition is from 1990).
Feng, Jie et al., "Fractional Box-Counting Approach to Fractal Dimension Estimation", (IEEE 1996; Proceedings of ICPR'96), pp. 854-858.
Johnson ,Richard C. (Editor), "Antenna Engineering Handbook" (McGraw Hill Inc.), Chapter "Microstrip Antennas" by Robert E. Munson, selected pages, 1993.
Kobayashi, S. et al., "Estimation of 3D Fractal Dimension of Real Electrical Tree Patterns" (IEEE 1994; Proceedings of the 4th International Conference on Properties and Applications of Dielectric Materials, Jul. 3-8, 1994, Brisbane, Australia), pp. 359-362.
Kraus, John O. "Antennas" (1988, McGraw-Hili, Inc.), preface and list of contents.
Ng, Vincent et al., "Diagnosis of Melanoma with Fractal Dimensions" (IEEE TENCON'93/ Beijing), pp. 514-517.
Peitgen, Heinz-Ottoet al., "Chaos and Fractals—New Frontiers of Science" (1992), pp. 212-216, 387-388.
Penn, Alan I. at a/., "Fractal Dimension of Low-Resolution Medical Images" (18th Annual International Conference of the IEEE Engineering in Medicine and Biology Society, Amsterdam 1996; 4.5.3: Image Pattern Analysis I), pp. 1163-1165.
Pozar, David M. et a/., "Microstrip Antennas—The Analysis and Design of Microstrip Antennas and Arrays" (1995, Institute of Electrical and Electronic Engineers, Inc.), p. ix and 3.
Rouvier, S. et a/., "Fractal Analisis of Bidimensional Profiles and Application to Electromagnetic Scattering from Soils" (1996 IEEE), pp. 2167-2169.
Russell D.A.; Hanson J.D.; Ott E.: 'Dimension of strange attractors' Physical Review Letters vol. 45, No. 14, Oct. 6, 1980, USA, pp. 1175-1178.
Sarkar, Nirupam et a/., "An Efficient Differential Box-Counting Approach to Compute Fractal Dimension of Image" (IEEE Transactions on Systems, Man, and Cybernetics, vol. 24, No. 1, Jan. 1994), pp. 115-120.
So P.; Barreto E.B.; Hunt B.R.: 'Box-counting dimension without boxes: Computing D0 from average expansion rates' Physical Review E vol. 60, No. 1, Jul. 1999, USA, pp. 378-385.
Software to compute box-counting dimension (Internet: http://www.sewanee.edu/physics/PHYSICS123/
BOX%20COUNTINGT%20DIMENSION.html), Oct. 23, 2009.
Tang, Yuan Y. et al., "The Application of Fractal Analysis to Feature Extraction" (1999 IEEE), pp. 875-879.
Vivek Rathi, Girish Kumar and K. P. Ray, "Improved Coupling for Aperture Coupled Microstrip Antennas," IEEE Transactions on Antennas and Propagation, vol. 44, No. 8, pp. 1196-1198, Aug. 1996.
Wen-Shyang Chen, Chun-Kun Wu and Kin-Lu Wong, "Square-Ring Microstrip Antenna with a Cross Strip for Compact Circular Polarization Operation," IEEE Transactions on Antennas and Propagation, vol. 47, No. 10, pp. 1566-1568, Oct. 1999.
Werner, Douglas H., et al., "The Theory and Design of Fractal Antenna Arrays," Frontiers in Electromagnetics, IEEE Press, Chapter 3, pp. 94-95, Oct. 1, 1999.
Wu et al. Dual-frequency microstrip reflectary, AP-S. Digest. Antennas and Propagation Society International Symposium, 1995.
Wu et al. Slot-coupled meandered microstrip antenna for compact dual-frequency operation, Electronic Letters, 1998, vol. 34, No. 11.
X. H. Yang and L. Shafai, "Multifrequency Operation Technique for Aperture Coupled Microstrip Antennas," IEEE, pp. 1198-1201, 1994.
X. Yang, J. Chiochetti, D. Papadopoulos and L. Susman, "Fractal Antenna Elements and Arrays," Applied Microwave & Wireless, Technical Feature, pp. 34-46, May 1, 1999.
Xianming Qing and Y. W. M. Chia, "A Novel Single-Feed Circular Polarized Slotted Loop Antenna," AP-S IEEE, Jul. 1999.
Xu Liang, Michael Yan Wah Chia, "Multiband Characteristics of Two Fractal Antennas," IEEE Microwave and Optical Technology Letters, vol. 33, pp. 242-245, Nov. 1999.
Guo, K. K M. Luk and K. F. Lee, "Dual-Band Slot-Loaded Short-Circuited Patch Antenna," IEEE Electronic Letters, vol. 36, pp. 289-291, Feb. 2000.
Yang et al. Compact dual-frequency operation of rectangular microstrip antennas, IEEE International Symposium 1999. Antennas and Propagation Society, 1999.
Yuko Rikuta and Hiroyuki Arai, "A Self-Diplexing Antenna Using Stacked Patch Antennas," IEEE, 2000.
Z. D. Liu and P. S. Hall, "Dual-Band Antenna for Hand Held Portable Telephones," IEEE Electronic Letters, vol. 32, No. 7, pp. 609-610, Mar. 28, 1996.
Zhang, Dawei et al., "Narrowband Lumped-Element Microstrip Filters Using Capacitively-Loaded Inductors," IEEE MTT-S Microwave Symposium Digest, pp. 379-382, May 16, 1995.
Zhi Ning Chen and Michael Y. W. Chia, "Broadband Rectangular Slotted Plate Antenna," IEEE, 2000.
Zhongxiang Shen, Chen Tat Sze and Choi Look Law, "A Circularly Polarized Microstrip-Fed T-Slot Antenna," School of Electrical and Electronic Engineering, Nanyang Technological University, Singapore, Jul. 16, 2000.
Zi Dong Liu, Peter S. Hall and David Wake, "Dual-Frequency Planar Inverted-F Antenna," IEEE Transactions on Antennas and Propagation, vol. 45, No. 10, pp. 1451-1458, Oct. 1997.
Lu, Jui-Han, "Single-Feed Circularly Polarized Triangular Microstrip Antenna with Triangular Slot for Compact Operation,"Microwave and Optical Technology Letters, vol. 34, No. 4, pp. 263-266, Aug. 20, 2002.
Werner, D.H. et al., "Frequency-independent features of self-similar fractal antennas," Radio Science, vol. 31, No. 6, pp. 1331-1343, Nov.-Dec. 1996.
Infringement Chart—Palm Centro 690. Fractus, 2009.
Infringement Chart—Palm Centro 690. Patent: 7015868. Fractus, 2009.
Infringement Chart—Palm Centro 690. Patent: 7123208. Fractus, 2009.
Infringement Chart—Palm Centro 690. Patent: 7397431. Fractus, 2009.
Infringement Chart—Palm Centro 690. Patent: 7528782. Fractus, 2009.
Infringement Chart—Palm Pre. Fractus, 2009.
Infringement Chart—Palm Pre. Patent: 7015868. Fractus, 2009.
Infringement Chart—Palm Pre. Patent: 7123208. Fractus, 2009.
Infringement Chart—Palm Pre. Patent: 7397431. Fractus, 2009.
Infringement Chart—Palm Pre. Patent: 7528782. Fractus, 2009.
Infringement Chart—Pantech Breeze C520. Fractus, 2009.
Infringement Chart—Pantech Breeze C520. Patent: 7015868. Fractus, 2009.
Infringement Chart—Pantech Breeze C520. Patent: 7123208. Fractus, 2009.
Infringement Chart—Pantech C610. Fractus, 2009.
Infringement Chart—Pantech C610. Patent: 7015868. Fractus, 2009.
Infringement Chart—Pantech C610. Patent: 7123208. Fractus, 2009.
Infringement Chart—Pantech C610. Patent: 7394432. Fractus, 2009.
Infringement Chart—Pantech C610. Patent: 7397431. Fractus, 2009.
Infringement Chart—Pantech C610. Patent: 7528782. Fractus, 2009.
Infringement Chart—Pantech C740. Fractus, 2009.
Infringement Chart—Pantech C740. Patent: 7015868. Fractus, 2009.
Infringement Chart—Pantech C740. Patent: 7123208. Fractus, 2009.
Infringement Chart—Pantech C740. Patent: 7394432. Fractus, 2009.
Infringement Chart—Pantech C740. Patent: 7397431. Fractus, 2009.
Infringement Chart—Pantech C740. Patent: 7528782. Fractus, 2009.
Infringement Chart—Pantech DUO C810. Fractus, 2009.
Infringement Chart—Pantech DUO C810. Patent: 7015868. Fractus, 2009.

Infringement Chart—Pantech DUO C810. Patent: 7123208. Fractus, 2009.
Infringement Chart—Pantech DUO C810. Patent: 7394432. Fractus, 2009.
Infringement Chart—Pantech DUO C810. Patent: 7397431. Fractus, 2009.
Infringement Chart—Pantech DUO C810. Patent: 7528782. Fractus, 2009.
Infringement Chart—Pantech Slate C530. Fractus, 2009.
Infringement Chart—Pantech Slate C530. Patent: 7015868. Fractus, 2009.
Infringement Chart—Pantech Slate C530. Patent: 7123208. Fractus, 2009.
Infringement Chart—Pantech Slate C530. Patent: 7394432. Fractus, 2009.
Infringement Chart—Pantech Slate C530. Patent: 7397431. Fractus, 2009.
Infringement Chart—Pantech Slate C530. Patent: 7528782. Fractus, 2009.
Infringement Chart—RIM Blackberry 8100. Patent: 7015868. Fractus, 2009.
Infringement Chart—RIM Blackberry 8100. Patent: 7394432. Fractus, 2009.
Infringement Chart—RIM Blackberry 8100. Patent: 7397431. Fractus, 2009.
Infringement Chart—RIM Blackberry 8100. Patent: 7528782. Fractus, 2009.
Infringement Chart—RIM Blackberry 8100. Patent:7123208. Fractus, 2009.
Infringement Chart—RIM Blackberry 8110. Fractus, 2009.
Infringement Chart—RIM Blackberry 8110. Patent: 7015868. Fractus, 2009.
Infringement Chart—RIM Blackberry 8110. Patent: 7123208. Fractus, 2009.
Infringement Chart—RIM Blackberry 8110. Patent: 7397431. Fractus, 2009.
Infringement Chart—RIM Blackberry 8110. Patent: 7528782. Fractus, 2009.
Infringement Chart—RIM Blackberry 8120. Fractus, 2009.
Infringement Chart—RIM Blackberry 8120. Patent: 7015868. Fractus, 2009.
Infringement Chart—LG MUZIQ LX570. Patent: 7528782. Fractus, 2009.
Infringement Chart—LG Rumor. Fractus, 2009.
Infringement Chart—LG Rumor 2. Fractus, 2009.
Infringement Chart—LG Rumor 2. Patent: 7015868. Fractus, 2009.
Infringement Chart—LG Rumor 2. Patent: 7123208. Fractus, 2009.
Infringement Chart—LG Rumor 2. Patent: 7394432. Fractus, 2009.
Infringement Chart—LG Rumor 2. Patent: 7397431. Fractus, 2009.
Infringement Chart—LG Rumor 2. Patent: 7528782. Fractus, 2009.
Infringement Chart—LG Rumor. Patent: 7015868. Fractus, 2009.
Infringement Chart—LG Rumor. Patent: 7123208. Fractus, 2009.
Infringement Chart—LG Rumor. Patent: 7397431. Fractus, 2009.
Infringement Chart—LG Rumor. Patent: 7528782. Fractus, 2009.
Infringement Chart—LG Shine CU720. Fractus, 2009.
Infringement Chart—LG Shine CU720. Patent: 7015868. Fractus, 2009.
Infringement Chart—LG Shine CU720. Patent: 7123208. Fractus, 2009.
Infringement Chart—LG Shine CU720. Patent: 7394432. Fractus, 2009.
Infringement Chart—LG Shine CU720. Patent: 7397431. Fractus, 2009.
Infringement Chart—LG Shine CU720. Patent: 7528782. Fractus, 2009.
Infringement Chart—LG UX200. Fractus, 2009.
Infringement Chart—LG UX280. Patent: 7015868. Fractus, 2009.
Infringement Chart—LG UX280. Patent: 7394432. Fractus, 2009.
Infringement Chart—LG UX280. Patent: 7397431. Fractus, 2009.
Infringement Chart—LG UX280. Patent: 7528782. Fractus, 2009.
Infringement Chart—LG UX280. Patent:7123208. Fractus, 2009.
Infringement Chart—LG Versa VX9600. Fractus, 2009.
Infringement Chart—LG Versa VX9600. Patent: 7015868. Fractus, 2009.
Infringement Chart—LG Versa VX9600. Patent: 7123208. Fractus, 2009.
Infringement Chart—LG Versa VX9600. Patent: 7397431. Fractus, 2009.
Infringement Chart—LG Versa VX9600. Patent: 7528782. Fractus, 2009.
Infringement Chart—LG Voyager VX 10000. Patent: 7528782. Fractus, 2009.
Infringement Chart—LG Voyager VX10000. Fractus, 2009.
Infringement Chart—LG Voyager VX10000. Patent: 7015868. Fractus, 2009.
Infringement Chart—LG Voyager VX10000. Patent: 7123208. Fractus, 2009.
Infringement Chart—LG Voyager VX10000. Patent: 7397431. Fractus, 2009.
Infringement Chart—LG VU CU920. Fractus, 2009.
Infringement Chart—LG VU CU920. Patent: 7015868. Fractus, 2009.
Infringement Chart—LG VU CU920. Patent: 7123208. Fractus, 2009.
Infringement Chart—LG VU CU920. Patent: 7394432. Fractus, 2009.
Infringement Chart—LG VU CU920. Patent: 7397431. Fractus, 2009.
Infringement Chart—LG VU CU920. Patent: 7528782. Fractus, 2009.
Infringement Chart—LG VX 8800. Patent: 7397431. Fractus, 2009.
Infringement Chart—LG VX5400. Fractus, 2009.
Infringement Chart—LG VX5400. Patent: 7015868. Fractus, 2009.
Infringement Chart—LG VX5400. Patent: 7123208. Fractus, 2009.
Infringement Chart—LG VX5400. Patent: 7397431. Fractus, 2009.
Infringement Chart—LG VX5400. Patent: 7528782. Fractus, 2009.
Infringement Chart—LG VX5500. Fractus, 2009.
Infringement Chart—LG VX5500. Patent: 7015868. Fractus, 2009.
Infringement Chart—LG VX5500. Patent: 7123208. Fractus, 2009.
Infringement Chart—LG VX5500. Patent: 7397431. Fractus, 2009.
Infringement Chart—LG VX5500. Patent: 7528782. Fractus, 2009.
Infringement Chart—LG VX8350. Fractus, 2009.
Infringement Chart—LG VX8350. Patent: 7015868. Fractus, 2009.
Infringement Chart—LG VX8350. Patent: 7123208. Fractus, 2009.
Infringement Chart—LG VX8350. Patent: 7397431. Fractus, 2009.
Infringement Chart—LG VX8350. Patent: 7528782. Fractus, 2009.
Infringement Chart—LG VX8360.. Fractus, 2009.
Infringement Chart—LG VX8360. Patent: 7015868. Fractus, 2009.
Infringement Chart—LG VX8360. Patent: 7123208. Fractus, 2009.
Infringement Chart—LG VX8360. Patent: 7397431. Fractus, 2009.
Infringement Chart—LG VX8360. Patent: 7528782. Fractus, 2009.
Infringement Chart—LG VX8360. Patent:7394432. Fractus, 2009.
Infringement Chart—LG VX8500. Fractus, 2009.
Infringement Chart—LG VX8500. Patent: 7015868. Fractus, 2009.
Infringement Chart—LG VX8500. Patent: 7123208. Fractus, 2009.
Infringement Chart—LG VX8500. Patent: 7397421. Fractus, 2009.
Infringement Chart—LG VX8500. Patent: 7528782. Fractus, 2009.
Infringement Chart—LG VX8560 Chocolate 3. Fractus, 2009.
Infringement Chart—LG VX8560 Chocolate 3. Patent: 7015868. Fractus, 2009.
Infringement Chart—LG VX8560 Chocolate 3. Patent: 7123208. Fractus, 2009.
Infringement Chart—LG VX8560 Chocolate 3. Patent: 7394432. Fractus, 2009.
Infringement Chart—LG VX8560 Chocolate 3. Patent: 7397431. Fractus, 2009.
Infringement Chart—LG VX8560 Chocolate 3. Patent: 7528782. Fractus, 2009.
Infringement Chart—LG VX8610. Fractus, 2009.
Infringement Chart—LG VX8610. Patent: 7015868. Fractus, 2009.
Infringement Chart—LG VX8610. Patent: 7123208. Fractus, 2009.
Infringement Chart—LG VX8610. Patent: 7397431. Fractus, 2009.
Infringement Chart—LG VX8610. Patent: 7528782. Fractus, 2009.
Infringement Chart—LG VX8800. Fractus, 2009.
Infringement Chart—LG VX8800. Patent: 7015868. Fractus, 2009.

Infringement Chart—LG VX8800. Patent: 7123208. Fractus, 2009.
Infringement Chart—LG VX8800. Patent: 7528782. Fractus, 2009.
Infringement Chart—LG VX9400. Fractus, 2009.
Infringement Chart—LG VX9400. Patent: 7015868. Fractus, 2009.
Infringement Chart—LG VX9400. Patent: 7123208. Fractus, 2009.
Infringement Chart—LG VX9400. Patent: 7394432. Fractus, 2009.
Infringement Chart—LG VX9400. Patent: 7397431. Fractus, 2009.
Infringement Chart—LG VX9400. Patent: 7528782. Fractus, 2009.
Infringement Chart—LG Xenon GR500. Fractus, 2009.
Infringement Chart—LG Xenon GR500. Patent: 7015868. Fractus, 2009.
Infringement Chart—LG Xenon GR500. Patent: 7123208. Fractus, 2009.
Infringement Chart—LG Xenon GR500. Patent: 7394432. Fractus, 2009.
Infringement Chart—LG Xenon GR500. Patent: 7397431. Fractus, 2009.
Infringement Chart—LG Xenon GR500. Patent: 7528782. Fractus, 2009.
Infringement Chart—Palm Centro 685. Fractus, 2009.
Infringement Chart—Palm Centro 685. Patent: 7015868. Fractus, 2009.
Infringement Chart—Palm Centro 685. Patent: 7123208. Fractus, 2009.
Infringement Chart—Palm Centro 685. Patent: 7394432. Fractus, 2009.
Infringement Chart—Palm Centro 685. Patent: 7397431. Fractus, 2009.
Infringement Chart—Palm Centro 685. Patent: 7528782. Fractus, 2009.
Infringement Chart—LG CU515. Patent: 7397431. Fractus, 2009.
Infringement Chart—LG CU515. Patent: 7528782. Fractus, 2009.
Infringement Chart—LG Dare VX9700. Fractus, 2009.
Infringement Chart—LG Dare VX9700. Patent: 7015868. Fractus, 2009.
Infringement Chart—LG Dare VX9700. Patent: 7123208. Fractus, 2009.
Infringement Chart—LG Dare VX9700. Patent: 7397431. Fractus, 2009.
Infringement Chart—LG enV Touch VX1100. Fractus, 2009.
Infringement Chart—LG enV Touch VX1100. Patent: 7015868. Fractus, 2009.
Infringement Chart—LG enV Touch VX1100. Patent: 7123208. Fractus, 2009.
Infringement Chart—LG enV Touch VX1100. Patent: 7394432. Fractus, 2009.
Infringement Chart—LG enV Touch VX1100. Patent: 7397431. Fractus, 2009.
Infringement Chart—LG enV Touch VX1100. Patent: 7528782. Fractus, 2009.
Infringement Chart—LG enV Vx-9900. Patent: 7123208. Fractus, 2009.
Infringement Chart—LG enV Vx-9900. Patent: 7015868. Fractus, 2009.
Infringement Chart—LG enV Vx-9900. Patent: 7397431. Fractus, 2009.
Infringement Chart—LG enV Vx-9900. Patent: 7528782. Fractus, 2009.
Infringement Chart—LG enV Vx-9900. Fractus, 2009.
Infringement Chart—LG EnV2 VX9100. Fractus, 2009.
Infringement Chart—LG EnV2 VX9100. Patent: 7123208. Fractus, 2009.
Infringement Chart—LG EnV2 VX9100. Patent: 7397431. Fractus, 2009.
Infringement Chart—LG EnV2 VX9100. Patent: 7528782. Fractus, 2009.
Infringement Chart—LG EnV2. Patent: 7015868. Fractus, 2009.
Infringement Chart—LG EnV3 VX9200. Fractus, 2009.
Infringement Chart—LG ENV3 VX9200. Patent: 7015868. Fractus, 2009.
Infringement Chart—LG EnV3 VX9200. Patent: 7123208. Fractus, 2009.
Infringement Chart—LG EnV3 VX9200. Patent: 7394432. Fractus, 2009.
Infringement Chart—LG EnV3 VX9200. Patent: 7397431. Fractus, 2009.
Infringement Chart—LG EnV3 VX9200. Patent: 7528782. Fractus, 2009.
Infringement Chart—LG Flare LX165. Fractus, 2009.
Infringement Chart—LG Flare LX165. Patent: 7015868. Fractus, 2009.
Infringement Chart—LG Flare LX165. Patent: 7123208. Fractus, 2009.
Infringement Chart—LG Flare LX165. Patent: 7397431. Fractus, 2009.
Infringement Chart—LG Flare LX165. Patent: 7528782. Fractus, 2009.
Infringement Chart—LG GT365 NEON. Fractus, 2009.
Infringement Chart—LG GT365 NEON. Patent: 7015868. Fractus, 2009.
Infringement Chart—LG GT365 NEON. Patent: 7123208. Fractus, 2009.
Infringement Chart—LG GT365 NEON. Patent: 7394432. Fractus, 2009.
Infringement Chart—LG GT365 NEON. Patent: 7397431. Fractus, 2009.
Infringement Chart—LG GT365 NEON. Patent: 7528782. Fractus, 2009.
Infringement Chart—LG Lotus. Fractus, 2009.
Infringement Chart—LG Lotus. Patent: 7015868. Fractus, 2009.
Infringement Chart—LG Lotus. Patent: 7123208. Fractus, 2009.
Infringement Chart—LG Lotus. Patent: 7397431. Fractus, 2009.
Infringement Chart—LG Lotus. Patent: 7528782. Fractus, 2009.
Infringement Chart—LG MUZIQ LX. Patent: 7015868. Fractus, 2009.
Infringement Chart—LG MUZIQ LX570. Fractus, 2009.
Infringement Chart—LG MUZIQ LX570. Patent: 7123208. Fractus, 2009.
Infringement Chart—LG MUZIQ LX570. Patent: 7394432. Fractus, 2009.
Infringement Chart—LG MUZIQ LX570. Patent: 7397341. Fractus, 2009.
Infringement Chart—LG 300G. Patent: 7528782. Fractus, 2009.
Infringement Chart—LG 300G. Patent:7397431. Fractus, 2009.
Infringement Chart—LG Aloha LX140. Fractus, 2009.
Infringement Chart—LG Aloha LX140. Patent: 7015868. Fractus, 2009.
Infringement Chart—LG Aloha LX140. Patent: 7123208. Fractus, 2009.
Infringement Chart—LG Aloha LX140. Patent: 7397431. Fractus, 2009.
Infringement Chart—LG Aloha LX140. Patent: 7528782. Fractus, 2009.
Infringement Chart—LG AX155. Fractus, 2009.
Infringement Chart—LG AX155. Patent: 7015868. Fractus, 2009.
Infringement Chart—LG AX155. Patent: 7123208. Fractus, 2009.
Infringement Chart—LG AX155. Patent: 7397431. Fractus, 2009.
Infringement Chart—LG AX155. Patent: 7528782. Fractus, 2009.
Infringement Chart—LG AX300. Fractus, 2009.
Infringement Chart—LG AX300. Patent: 7123208. Fractus, 2009.
Infringement Chart—LG AX300. Patent: 7397431. Fractus, 2009.
Infringement Chart—LG AX300. Patent: 7528782. Fractus, 2009.
Infringement Chart—LG AX300. Patent:7015868. Fractus, 2009.
Infringement Chart—LG AX380. Fractus, 2009.
Infringement Chart—LG AX380. Patent: 7015868. Fractus, 2009.
Infringement Chart—LG AX380. Patent: 7123208. Fractus, 2009.
Infringement Chart—LG AX380. Patent: 7394432. Fractus, 2009.
Infringement Chart—LG AX380. Patent: 7397431. Fractus, 2009.
Infringement Chart—LG AX380. Patent: 7528782. Fractus, 2009.
Infringement Chart—LG AX585. Fractus, 2009.
Infringement Chart—LG AX585. Patent: 7015868. Fractus, 2009.
Infringement Chart—LG AX585. Patent: 7394432. Fractus, 2009.
Infringement Chart—LG AX585. Patent: 7397431. Fractus, 2009.
Infringement Chart—LG AX585. Patent: 7528782. Fractus, 2009.
Infringement Chart—LG AX585. Patent: 7123208. Fractus, 2009.

Infringement Chart—LG AX8600. Fractus, 2009.
Infringement Chart—LG AX8600. Patent: 7015868. Fractus, 2009.
Infringement Chart—LG AX8600. Patent: 7123208. Fractus, 2009.
Infringement Chart—LG AX8600. Patent: 7394432. Fractus, 2009.
Infringement Chart—LG AX8600. Patent: 7397431. Fractus, 2009.
Infringement Chart—LG AX8600. Patent: 7528782. Fractus, 2009.
Infringement Chart—LG CF360. Fractus, 2009.
Infringement Chart—LG CF360. Patent: 7015868. Fractus, 2009.
Infringement Chart—LG CF360. Patent: 7123208. Fractus, 2009.
Infringement Chart—LG CF360. Patent: 7394432. Fractus, 2009.
Infringement Chart—LG CF360. Patent: 7397431. Fractus, 2009.
Infringement Chart—LG CF360. Patent: 7528782. Fractus, 2009.
Infringement Chart—LG Chocolate VX8550. Fractus, 2009.
Infringement Chart—LG Chocolate VX8550. Patent: 7015868. Fractus, 2009.
Infringement Chart—LG Chocolate VX8550. Patent: 7123208. Fractus, 2009.
Infringement Chart—LG Chocolate VX8550. Patent: 7528782. Fractus, 2009.
Infringement Chart—LG Chocolate VX8550. Patent: 7397431. Fractus, 2009.
Infringement Chart—LG CU515. Fractus, 2009.
Infringement Chart—LG CU515. Patent: 7015868. Fractus, 2009.
Infringement Chart—LG CU515. Patent: 7123208. Fractus, 2009.
Infringement Chart—LG CU515. Patent: 7394432. Fractus, 2009.
Infringement Chart—HTC Dash. Fractus, 2009.
Infringement Chart—HTC Dash. Patent: 7015868. Fractus, 2009.
Infringement Chart—HTC Dash. Patent: 7123208. Fractus, 2009.
Infringement Chart—HTC Dash. Patent: 7394432. Fractus, 2009.
Infringement Chart—HTC Dash. Patent: 7397431. Fractus, 2009.
Infringement Chart—HTC Dash. Patent: 7528782. Fractus, 2009.
Infringement Chart—HTC Diamond. Fractus, 2009.
Infringement Chart—HTC Diamond. Patent: 7015868. Fractus, 2009.
Infringement Chart—HTC Diamond. Patent: 7123208. Fractus, 2009.
Infringement Chart—HTC Diamond. Patent: 7397431. Fractus, 2009.
Infringement Chart—HTC Diamond. Patent: 7528782. Fractus, 2009.
Infringement Chart—HTC G1 Google. Fractus, 2009.
Infringement Chart—HTC G1 Google. Patent: 7015868. Fractus, 2009.
Infringement Chart—HTC G1 Google. Patent: 7123208. Fractus, 2009.
Infringement Chart—HTC G1 Google. Patent: 7394432. Fractus, 2009.
Infringement Chart—HTC G1 Google. Patent: 7397431. Fractus, 2009.
Infringement Chart—HTC G1 Google. Patent: 7528782. Fractus, 2009.
Infringement Chart—HTC My Touch. Fractus, 2009.
Infringement Chart—HTC My Touch. Patent: 7123208. Fractus, 2009.
Infringement Chart—HTC My Touch. Patent: 7394432. Fractus, 2009.
Infringement Chart—HTC My Touch. Patent: 7397431. Fractus, 2009.
Infringement Chart—HTC My Touch. Patent: 7528782. Fractus, 2009.
Infringement Chart—HTC Ozone. Fractus, 2009.
Infringement Chart—HTC Ozone. Patent: 7015868. Fractus, 2009.
Infringement Chart—HTC Ozone. Patent: 7123208. Fractus, 2009.
Infringement Chart—HTC Ozone. Patent: 7394432. Fractus, 2009.
Infringement Chart—HTC Ozone. Patent: 7397431. Fractus, 2009.
Infringement Chart—HTC Ozone. Patent: 7528782. Fractus, 2009.
Infringement Chart—HTC Pure. Fractus, 2009.
Infringement Chart—HTC Pure. Patent: 7015868. Fractus, 2009.
Infringement Chart—HTC Pure. Patent: 7123208. Fractus, 2009.
Infringement Chart—HTC Pure. Patent: 7394432. Fractus, 2009.
Infringement Chart—HTC Pure. Patent: 7397431. Fractus, 2009.
Infringement Chart—HTC Pure. Patent: 7528782. Fractus, 2009.
Infringement Chart—HTC Snap. Fractus, 2009.
Infringement Chart—HTC Snap. Patent: 7015868. Fractus, 2009.
Infringement Chart—HTC Snap. Patent: 7123208. Fractus, 2009.
Infringement Chart—HTC Snap. Patent: 7397431. Fractus, 2009.
Infringement Chart—HTC Snap. Patent: 7528782. Fractus, 2009.
Infringement Chart—HTC TILT 8925. Fractus, 2009.
Infringement Chart—HTC TILT 8925. Patent: 7015868. Fractus, 2009.
Infringement Chart—HTC TILT 8925. Patent: 7123208. Fractus, 2009.
Infringement Chart—HTC TILT 8925. Patent: 7394432. Fractus, 2009.
Infringement Chart—HTC TILT 8925. Patent: 7397431. Fractus, 2009.
Infringement Chart—HTC TILT 8925. Patent: 7528782. Fractus, 2009.
Infringement Chart—HTC Touch Pro 2. Fractus, 2009.
Infringement Chart—HTC Touch Pro 2. Patent: 7123208. Fractus, 2009.
Infringement Chart—HTC Touch Pro 2. Patent: 7394432. Fractus, 2009.
Infringement Chart—HTC Touch Pro 2. Patent: 7397431. Fractus, 2009.
Hagstrom, P., "Novel Ceramic Antenna Filters for GSM/DECT and GSM/PCN Network Terminals," The 8th IEEE International Symposium on Personal, Indoor, and Mobile Radio Communications, vol. 3, Sep. 1-4, 1997.
Halloran, T.W. et al. "A Dual Channel VHF Telemetry Antenna System for Re-Entry Vehicle Applications," The Eleventh Symposium on the USAF Antenna Research and Development Program, Oct. 16-20, 1961.
Hikata, M., Shibagaki, N., Asai, K., Sakiyama, K. and Sumioka, A., "New Miniature SAW Antenna Duplexer Used in GHz-Band Digital Mobile Cellular Radios," 1995 IEEE Ultrasonics Symposium, 1, Nov. 7-10, 1995.
Hikita, M., Ishida, Y., Tabuchi, T. And Kurosawa, K., "Miniature Saw Antenna Duplexer for 800-MHz Portable Telephone Used in Cellular Radio Systems," IEEE Transactions on Microwave Theory and Techniques, 36, Jun. 6, 1988.
Hill, J.E. et al., "An Integrated Strip-Transmission-Line Antenna System for JBand," The Twenty-Third Symposium on the USAF Antenna Research and Development Program, Oct. 10-12, 1973.
Hofer, D.A., Kesler, O.B., and Loyet, L.L., "A Compact Multi-Polarized Broadband Antenna," Proceedings of the 1989 Antenna Applications Symposium, Sep. 20-22, 1989.
Holtum, A. G., "A Dual Frequency Dual Polarized Microwave Antenna," The Sixteenth Symposium on the USAF Antenna Research and Development Program, Oct. 11-13, 1966.
Holzschuh, D.L., "Hardened Antennas for Atlas and Titan Missile Sitev Communications," The Thirteenth Symposium on the USAF Antenna Research andvDevelopment Program, Oct. 14-18, 1963.
Hong, "Compact microwave elliptic function filter using novel microstrip meander open-loop resonators" (Mar. 14, 1996).
Hong and Lancaster, Recent Advances in Microstrip Filters for Communications and Other Applications, IEEE, pp. 2/1-2/6 (1997).
Huynh, T. and Lee, K.F., "Single-layer single-patch wideband microstrip antenna," Electronics Letters, 31, 16, Aug. 3, 1995.
Hyneman, R.F., et al., "Homing Antennas for Aircraft (450-2500 MC)," the Fifth Symposium on the USAF Antenna Research and Development Program, Oct. 16-20, 1955.
IEEE, IEEE Standard Definitions of Terms for Antennas, IEEE Std. 145-1983, New York, IEEE, 1983.
Ikata, O., Satoh, Y., Uchishiba, H., Taniguchi, H., Hirasawa, N., Hashimoto, K. and Ohmori, H., "Development of Small Antenna Duplexer Using SAW Filters for Handheld Phones," 1993 IEEE Ultrasonics Symposium, 1, Oct. 31-Nov. 3, 1993.
Ingerson, Paul G. and Mayes, Paul E., "Asymmetrical Feeders for Log-Periodic Antennas," the Seventeenth Symposium on the USAF Antenna Research and Development Program (Nov. 14-17, 1967).
Isbell, D.E., "Non-Planar Logarithmically Periodic Antenna Structures," Seventh Annual Symposium on USAF Antenna Research and Development Program, Oct. 21-25, 1957.

Isbell, D.E., "Multiple Terminal Log-Periodic Antennas," Eighth Annual Symposium on the USAF Antenna Research and Development Program, Oct. 20-24, 1958.
Ishikawa, Y., Hattori, J., Andoh, M. and Nishikawa, T., "800 MHz High Power Bandpass Filter Using TM Dual Mode Dielectric Resonators," 21st European Microwave Conference, vol. 2, Sep. 9-12, 1991.
James and Hall, "Handbook of Microstrip Antennas", vol. 1, 1989.
Jones, Howard S., "Conformal and Small Antenna Designs," Proceedings of the 1981 Antenna Applications Symposium, Aug. 1981.
Kraus, John D., Antennas, Second Edition, New York, McGraw-Hill Book Company, 1988.
Kuhlman, E.A., "A Directional Flush Mounted Uhf Communications Antenna for High Performance Jet Aircraft for the 225-400 MC Frequency Range," The Fifth Symposium on the USAF Antenna Research and Development Program, Oct. 16-20, 1955.
Kumar, G. and Gupta, K., "Directly Coupled Multiple Resonator Wide-Band Microstrip Antennas," IEEE Transactions on Antennas and Propagation, AP-29, 1, Jun. 1985, pp. 588-593.
Kumar, "Nonradiating Edges and Four Edges Gap-Coupled Multiple Resonator Broad-Band Microstrip Antenna," IEEE Transactions on Antenna and Propagation, Feb. 1985.
Kuo, Sam, "Frequency-Independent Log-Periodic Antenna Arrays With Increased Directivity and Gain," Twenty-First Annual Symposium on USAF Antenna Research and Development, Oct. 12-14, 1971.
Kurpis, G. P., The New IEEE Standard Dictionary of Electrical and Electronics Terms, Fifth Edition, New York, IEEE, 1993.
Kutter, "Fractal Antenna Design" (Honors Thesis, University of Dayton, 1996).
Lancaster, et al., "Miniature Superconducting Filters" IEEE Transactions on Microwave Theory and Techniques (Jul. 1996).
Lee, J.C., "Analysis of Differential Line Length Diplexers and Long-Stub Filters," The Twenty-First Symposium on the USAF Antenna Research and Development Program, Oct. 12-14, 1971.
Liu, et al., "A Multi-Branch Monopole Antenna for Dual-Band Cellular Applications," IEEE, Sep. 3, 1999.
Lo, Y. T., et al. "Theory and Experiment on Microstrip Antennas," 1978 Antenna Applications Symposium, Sep. 20-22, 1978.
Locus, Stanley S., "Antenna Design for High Performance Missile Environment," The Fifth Symposium on the USAF Antenna Research and Development Program, Oct. 16-20, 1955.
Lu, Jui-Han & Wong, Kin-Lu, Dual-Frequency Rectangular Microstrip Antenna Oct. 21-25, 1957.
Lu et al., "Novel Dual-Frequency and Broad-Band Designs of Slot-Loaded Equilateral Triangular Microstrip Antennas," Microwave and Optical Technology Letters, vol. 48, No. 7 (Jul. 2000, received Jul. 27, 1998).
Maci et al., "Dual-band Slot-loaded patch antenna", IEE Proc.-Microw. Antennas Propag., vol. 142, No. 3, pp. 225-232 (Jun. 1995).
Martin, W.R., "Flush VOR Antenna for C-121C Aircraft," The Second Symposium on the USAF Antenna Research and Development Program, Oct. 19-23, 1952.
Martin, R.W., et al. "An Unfurlable, High-Gain Log-Periodic Antenna for Space Use" The Seventeenth Symposium on the USAF Antenna Research and Development Program, Nov. 14-17, 1967.
May, "Aerial Magic," New Scientist, pp. 28-30 (Jan. 31, 1998).
Mayes, P.E., et al. "Multi-Arm Logarithmic Spiral Antennas," The Tenth Symposium on the USAF Antenna Research and Development Program, Oct. 3-7, 1960.
Mayes, P.E., et al. "High Gain Log-Periodic Antennas," The Tenth Symposium on the USAF Antenna Research and Development Program, Oct. 3-7, 1960.
Mayes, P., et al. "Some Broadband, Low-Profile Antennas," 1985 Antenna Applications Symposium, Sep. 18-20, 1985.
McDowell, E. P., "High Speed Aircraft Antenna Problems and Some Specific Solutions for MX-1554," The Second Symposium on the USAF Antenna Research and Development Program, Oct. 19-23, 1952.
McDowell, E. P., "Flush Mounted X-Band Beacon Antennas for Aircraft," The Third Symposium on the USAF Antenna Research and Development Program, Oct. 18-22, 1953.
McSpadden, J. O., Lu, Fan and Chang, Kai, "Design and Experiments of a High-Conversion-Efficiency 5.8-GHz Rectenna," IEEE Transactions on Microwave Theory and Techniques, 46, 12, part 1, Dec. 1998.
Misra and Chowdhury, "Study of Impedance and Radiation Properties of a Concentric Microstrip Triangular-Ring Antenna and Its Modeling Techniques Using FDTD Method," IEEE Transactions on Antennas and Propagation, vol. 46, No. 4, Apr. 1998.
Misra, Ita et al., "Experimental Investigations on the Impedance and Radiation Properties of a Three-Element Concentric Microstrip Antenna," Microwave and Optical Technology Letters, vol. 11, No. 2, Feb. 5, 1996.
Moheb, H., Robinson, C. And Kijesky, J., "Design & Development of Co-Polarized Ku-Band Ground Terminal System for Very Small Aperture Terminal (VSAT) Application," IEEE International Symposium on Antennas and Propagation Digest, 3, Jul. 11-16, 1999.
Munson, R. et al. "Conformal Microstrip Array for a Parabolic Dish," The Twenty-Third Symposium on the USAF Antenna Research and Development Program, Oct. 10-12, 1973.
Munson, R., "Microstrip Phased Array Antennas," The Twenty-Second Symposium on the USAF Antenna Research and Development Program, Oct. 11-13, 1972.
Borja, C, Antennas Fractales Microstrip (Microstrip Fractal Antennas), E.T.S. d'Enginyeria de Telecomunicacio, Barcelona, Spain (1997), dated Jul. 1, 1997.
Borowski, E. , Dictionary of Mathematics (Collins: 1989) pp. 456-45, Getting Acquainted with Fractals, pp. 50-53 dated Jan. 1, 1989.
Claims for the EP Patent No. 00909089, Excerpts from WO 01/54224 File History dated Jun. 14, 2005.
Collier, C. P. , Geometry for Teachers (2d ed. 1984) pp. 49-57 dated Jan. 1, 1984.
Falconer, K, Fractal Geometry, pp. 38-45 (1990) dated Jan. 1, 1990.
Henderson , B. , The Prentice-Hall Encyclopedia of Mathematics, Prentice-Hall dated Jan. 1, 1982.
IEEE Standard Definitions of Terms for Antennas, IEEE Std. 145-1993 dated Mar. 18, 1993.
Mandelbrot , B. B. , Opinions, Fractals 1(1), 117-123 (1993), dated Jan. 1, 1993.
Mehaute, A. , Fractal Geometrics, pp. 3-35 dated Jan. 1, 1990.
Parker (ed.), McGraw-Hill Dictionary of Scientific and Technical Terms (5th ed. 1994) pp. 1542 dated Jan. 1, 1994.
Rich , B., Review of Elementary Mathematics, 2nd ed. McGraw-Hill dated Jan. 1, 1997.
Sclater , N. , McFraw-Hill Electroncs Dictionary dated Jan. 1, 1997.
Stutzman , W. , Antenna theory and design, 2nd ed. John Wiley and Sons dated Jan. 1, 1998.
The American Heritage College Dictionary (3d ed. 1997) pp. 684 and 1060 dated Jan. 1, 1997.
The American Heritage Dictionary (2d College ed.) pp. 960 dated Jan. 1, 1982.
Theiler, J, Estimating Fractal Dimension, J. Opt. Soc. Am. A, 7(6), pp. 1055-1073—1990 dated Jun. 1, 1990.
West , B.H. et al., The Prentice-Hall Encyclopedia of Mathematics pp. 404-405 dated Jan. 1, 1982.
Walker, B.D., Preliminary Amendment for U.S. Appl. No. 11/110,052 dated Apr. 20, 2005.
Walker, B.D., Response to Office Action for U.S. Appl. No. 11/179,250 dated Jul. 12, 2005.
Moore, S., Office Action in U.S. Appl. No. 11/033,788, USPTO dated Jun. 1, 2006.
Mithani, S., Response to Office Action in U.S. Appl. No. 11/124,768, USPTO dated Aug. 23, 2006.
Walker, B.D., Preliminary Amendment for U.S. Appl. No. 11/780,932 dated Jul. 20, 2007.
Wilmer, M., Notice of Allowance of U.S. Appl. No. 10/822,933 dated Oct. 18, 2007.
Defendants, Kyocera Communications, Inc; Palm Inc. and UTStarcom, Inc. Response to Fractus SA's Opening Claim Construction Brief in the case of *Fractus SA* v. *Samsung Electornics Co. Ltd.* et al. Case No. 6:09-cv-00203 (E.D. Tex.) dated Jul. 30, 2010.
Defendants, RIM, Samsung, HTC, LG and Pantech's Response to Fractus SA's Opening Claim Construction Brief and Chart of Agreed Terms and Disputed Terms in the case of *Fractus SA* v. *Samsung Electornics Co. Ltd*. et al. Case No. 6:09-cv-00203 (E.D. Tex.) dated Jul. 30, 2010.
Defendants RIM, Samsung, HTC, LG and Pantech's Response to plantiff Fractus SA's opening claim construction brief in Case 6:09-cv-00203-LED-JDL—Exhibit 33—Excerpt from Plaintiff's '868 pat. inf. cont. for Samsung SPH M540, Jul. 30, 2010.
Defendants RIM, Samsung, HTC, LG and Pantech's Response to plantiff Fractus SA's opening claim construction brief in Case 6:09-cv-00203-LED-JDL—Exhibit 34—Excerpts from Plaintiffs '431 patent Infringement Contentions of HTC Diamond, Jul. 30, 2010.
Defendants RIM, Samsung, HTC, LG and Pantech's Response to plantiff Fractus SA's opening claim construction brief in Case 6:09-cv-00203-LED-JDL—Exhibit 41—Demonstrative re: counting segments, Jul. 30, 2010.
Defendants RIM, Samsung, HTC, LG and Pantech's Response to plantiff Fractus SA's opening claim construction brief in Case 6:09-cv-00203-LED-JDL—Exhibit 42—Demonstrative showing how straight segments can be fitted over a curved surface.
Defendants RIM, Samsung, HTC, LG and Pantech's Response to plantiff Fractus SA's opening claim construction brief in Case 6:09-cv-00203-LED-JDL—Exhibit 57—Excerpts from Plaintiffs '868 and '762 Pat. Infr. cont. For RIM 8310.
Defendants RIM, Samsung, HTC, LG and Pantech's Response to plantiff Fractus SA's opening claim construction brief in "Case 6:09-cv-00203-LED-JDL"—Exhibit 1—Chart of Agreed Terms and Disputed Terms, Jul. 30, 2010.
Defendants RIM, Samsung, HTC, LG and Pantech's Response to plantiff Fractus SA's opening claim construction brief in "Case 6:09-cv-00203-LED-JDL"—Exhibit 2—Family Tree of Asserted Patents. Jul. 30, 2010.
American Century Dictionary, Oxford University Press, 1995. pp. 376, 448 dated Jan. 1, 1995.
Collins Dictionary, Collins, 1979. pp. 608, dated Jan. 1, 1979.
Graf, R , Modern dictionary of electronics (6th Ed.), Butterworth-Heinemann, pp. 209, 644 dated Jan. 1, 1984.
IEEE Standard dictionary of electrical and electronics terms (6th ed.) IEEE Standard. 1996 pp. 229, 431, 595, 857 dated Jan. 1, 1996.
Johnson, R , Antenna Engineering Handbook, Mc Graw Hill (3rd Ed.) pp. 4-26, 4-33 dated Jan. 1, 1993.
Mandelbrot, B, The fractal geometry of nature, Freeman and Company (1983) pp. 32-35 dated Jan. 1, 1983.
NA, Int'l Electro-Technical Commission IEV No. 712-01-04, dated Apr. 1, 1998.
NA, Webster's New Collegiate Dictionary, G & C Merriam Co., 1981. pp. 60, 237, 746, dated Jan. 1, 1981.
Peitgen & D. Saupe, H, The science of fractal images, Springer-Verlag (1988) pp. 1-3, 24-27, 58-61 dated Jan. 1, 1988.
Peitgen et al, H O, Chaos and fractals : new frontiers of science, Springer-Verlag, 1992. pp. 22-26, 62-66, 94-105, 212-219, 229-243 dated Jan. 1, 1992.
Pozar , D. & E. Newman, Analysis of a Monopole Mounted near or at the Edge of a Half-Plane, IEEE Transactions on Antennas & Propagation, vol. AP-29, No. 3 (May 1981) dated May 1, 1981.
Rademacher , H & O. Toeplitz, The Enjoyment of Math, Princeton Science Library,1957. pp. 164-169, dated Jan. 1, 1957.
Sawaya, K, A simplified Expression of Dyadic Green's Function for a Conduction Half Sheet, IEEE Transactions on Antennas & Propagation, vol. AP-29, No. 5 (Sep. 1981) dated Sep. 1, 1981.
The American Heritage Dictionary, New College ed. (2nd ed. 1982). pp. 311, 1208, dated Jan. 1, 1982.
The Random House Dictionary, Random House, 1984. pp. 1029, 1034, dated Jan. 1, 1984.
Nguyen, H.V., Notice of Allowance for U.S. Appl. No. 10/182,635 dated Apr. 11, 2005.
Nguyen, H.V., Notice of Allowance for U.S. Appl. No. 11/110,052 dated May 30, 2006.
Fractus, Fractus SA's Opening Claim Construction Brief with Parties' Proposed and Agreed Constructions in the case of *Fractus SA* v. *Samsung Electornics Co. Ltd*. et al. Case No. 6:09-cv-00203 (E.D. Tex.) dated Jul. 16, 2010.
Turner, "Broadband Passive Electrically Small Antennas for TV Application," presented at the Proceedings of the 1977 Antenna Applications Symposium on Apr. 27-29, 1977 at Robert Allerton Park at the University of Illinois.
Virga, "Low-Profile Enhanced Bandwidth PIFA Antennas for Wireless Communications Packaging," IEEE Transactions on Microwave Theory and Techniques, vol. 45, No. 10 (Oct. 1997).
Volakis, J., Antenna Engineering Handbook, pp. 39-7 to -15 (4th ed. 2007).
Wall, H. et al. "Communications Antennas for Mercury Space Capsule," The Eleventh Symposium on the USAF Antenna Research and Development Program, Oct. 16-20, 1961.
Watanbe, T., Furutani, K., Nakajima, N. and Mandai, H., "Antenna Switch Duplexer for Dualband Phone (GSM/DCS) Using LTCC Multilayer Technology," IEEE MTT-S International Microwave Symposium Digest, 1, Jun. 13-19, 1999.
Weeks, W. L, Antenna Engineering, New York, McGraw-Hill Book Company, 1968.
Weeks, W. L, Electromagnetic Theory for Engineering Applications, New York John Wiley & Sons, 1964.
Wegner, E. D., B-70 Antenna System, Thirteenth Annual Symposium on USAF Antenna Research and Development, 1963.
Wheeler, H.A., "The Radian Sphere Around a Small Antenna," IEEE Proc., vol. 47, pp. 1325-1331 (Aug. 1959).
Wheeler, H. A., "Fundamental Limitations of Small Antennas," Proceedings of the I.R.E. (Dec. 1947).
Wheeler, H.A., "Small Antennas," The Twenty-Third Symposium on the USAF Antenna Research and Development Program, Oct. 10-12, 1973.
Wong, Kin-Lu and Sze, Jia-Yi, "Dual-Frequency Slotted Rectangular Microstrip Antenna," Electronics Letters, vol. 34, No. 14, Jul. 9, 1998.
Photos of Fractus MSPK product (at least early as 1998).
Photos of Fractus Panel 01 product (at least early as 1998).
Carpintero, Francisco, Response Office Action to European Office for European Patent Application n°00909089; Aug. 14, 2003.
HTC Corp. First amended answer and counterclaim to plaintiffs amended complaint; Oct. 2, 2009.
Bhavsar, Samir A.; correspondence regarding *Fractus, S.A*. v. *Samsung Electronics Co., Ltd*. et al., 6:09-cv-00203 and *Fractus, S.A*. v. *LG Electronics Mobilecomm U.S.A., Inc*. et al., 6-09-cv-00205; dated Oct. 28, 2009.
A. Serrano-Vaello and D. Sanchez-Hernandez, "Printed Antennas for Dual-Band GSM/DCS 1800 Mobile Handsets," IEEE Electronic Letters, vol. 34, No. 2, Jan. 22, 1998.
Alexander Moleiro, Jose' Rosa, Rui Numes and Cuestodio Peixeiro, "Dual Band Microstrip Patch Antenna Element with Parasitic for GSM," IEEE, 2000.
Ali, M. et al., "A Triple-Band Internal Antenna for Mobile Hand-held Terminals," IEEE, pp. 32-35, 1982.
Amjad A. Omar and Y. M. M. Antar, "A New Broad-Band, Dual-Frequency Coplanar Waveguide Fed Slot-Antenna," AP-S IEEE, Jul. 1999.
Anguera, J. et al., "Miniature Wideband Stacked Microstrip Patch Antenna Based on the Sierpinski Fractal Geometry," IEEE Antennas and Propagation Society International Symposium, Salt Lake City, Utah, 2000 Digest Aps., vol. 3 of 4, pp. 1700-1703, Jul. 16, 2000.
Anguera, Jaume, et al., "A Procedure to Design Wide-Band Electromagnetically-Coupled Stacked Microstrip Antennas Based on a Simple Network Model," IEEE Antennas & Propagation, URSI Symposium Meeting, Orlando, Florida, 4 pages, Jul. 1999.
Atsuya Ando, Yasunobu Honma and Kenichi Kagoshima, "A Novel Electromagnetically Coupled Microstrip Antenna with a Rotatable Patch for Personal Handy-Phone System Units," IEEE Transactions on Antennas and Propagation, vol. 46, pp. 794-797, Jun. 1998.
Borja, C., et al., "High Directivity Fractal Boundary Microstrip Patch Antenna," Electronics Letters, IEEE, Stevenage GB, vol. 36, No. 9, pp. 778-779. Apr. 27, 2000.
Borja, C., et al., "Iterative Network Model to Predict the Behavior of a Sierpinski Fractal Network," Electronics Letters, vol. 34, Nov 15, pp. 1443-1445, Jul. 23, 1998.

Borja, C., et al., "Iterative Network Models to Predict the Performance of Sierpinski Fractal Antennas and Networks," IEEE Antennas & Propagation, URSI Symposium Meeting, Orlando, Florida, 3 pages, Jul. 1999.
Breden, R., Multiband printed antenna for vehicles, 1999.
C. Borja and J. Romeu, "Multiband Sierpinski Fractal Patch Antenna," IEEE Antennas and Propagation Society International Symposium 2000, Salt Lake City, Jul. 2000.
C. Borja and J. Romeu, "Parche de Sierpinski Perturbado," XV Simposium Nacional URSI, Zaragoza, Sep. 2000. English Abstract.
C. Borja, C. Puente, A. Medina, J. Romeu and R. Pous, "Traslación de la Propiedad de Autosemejanza de los Fractales al Comportamiento Electromagnético de Parches con Geometría Fractal," XIII Simposium Nacional URSI, vol. I, pp. 437-439, Pamplona, Sep. 1998, English Abstract.
C. Borja, C. Puente, A. Medina, J. Romeu, and R. Pous, "Modelo Sencillo para el Estudio de los Parámetros de Entrada de una Antena Fractal de Sierpinski," XII Simposium Nacional URSI,vol. I, pp. 363-371, Bilbao, Sep. 1997, English Abstract.
C. Borja, C. Puente, J. Anguera, J. Romeu and R. Pous, "Estudio experimental del parche de Sierpinski," XIV Simposium Nacional URSI, pp. 379-380, Santiago de Compostela, Sep. 1999, English Abstract.
C. Borja, J. Romeu, J. Anguera and C. Puente, "Fractal Multiband Patch Antenna," AP2000 Millenium Conference on Antennas and Propagation, Davos, Apr. 2000.
C. Puente and R. Pous, "Deseño Fractal de Agrupaciones de Antenas," IX Simposium Nacional URSI, vol. I, pp. 227-231, Las Palmas, Septembre 1994. English Abstract.
C. Puente, C. C Borja, M. Navarro and J. Romeu, "An Iterative Model for Fractal Antennas, Application to the . Sierpinski Gasket Antenna," IEEE Transactions on Antennas and Propagation, Sep. 2000.
C. Puente, J. J Anguera, J. Romeu, C. Borja, M. Navarro and J. Soler, "Fractal-Shaped Antennas and their . Application to GSM 900/1800," AP2000 Millenium Conference on Antennas and Propagation, Davos, Apr. 2000.
C. Puente, M. Navarro, J. Romeu and R. Pous, "Efecto de la Variación del Vértice de Alimentación en la Antena Fractal de Sierpinski," XII Simposium Nacional URSI, Bilbao, Sep. 1997, English Abstract.
C. Puente, M. Navarro, J. Romeu and R. Pous, "Variations on the Fractal Sierpinski Antenna Flare Angle," IEEE Antennas & Propagation, URSI Symposium Meeting, Atlanta, Jun. 1998.
C. Salvador, L. Borselli, A. Falciani and S. Maci, "Dual Frequency Planar Antenna at S and X Bands," IEEE Electronic Letters, vol. 31, pp. 1706-1707, Sep. 1995.
C. T P. Song, P. S. Hall, H. Ghafouri-Shiraz and D. Wake, "Fractal Stacked Monopole with Very Wide Bandwidth," IEEE Electronic Letters, vol. 35, No. 12, pp. 945-946, Jun. 1999.
C. T. P. Song, P. S. Hall, H. Ghafouri-Shiraz and D. Wake, "Sierpinski Monopole Antenna with Controlled Band Spacing and Input Impedance," vol. 35, No. 13, pp. 1036-1037, IEEE Electronic Letters, Jun. 24, 1999.
C. T. P. Song, P. S. Hall, H. Ghafouri-Shiraz and D. Wake, "Triple Band Planar Inverted F Antennas for Handheld Devices," IEEE Electronic Letters, vol. 36, No. 2, pp. 112-114, Jan. 20, 2000.
Cho, Modified slot-loaded triple-band microstrip patch antenna, Jun. 16, 2002.
Cohen, Nathan, "Fractal Antenna Applications in Wireless Telecommunications," Electronics Industries Forum of New England, 1997. Professional Program Proceedings, Boston Massachusetts, May 6-8, 1997, New York, NY, IEEE, pp. 43-49, May 6, 1997.
Corbett R. Rowell and R. D. Murch, "A Capacitively Loaded Pifa for Compact Mobile Telephone Handsets," IEEE Transactions on Antennas and Propagation, vol. 45, No. 5, pp. 837-842, May 1997.
D. H. H Werner and P. L. Werner, "Frequency-Independent Features of Self-Similar Fractal Antennas," Radio Science, vol. 31, No. 7, pp. 1331-1343, Nov.-Dec. 1996.
D. H. Werner and P. L. Werner, "On the Synthesis of Fractal Radiation Patterns," Radio Science, vol. 30, No. 1, pp. 29-45, Jan.-Feb. 1995.
D. H. Werner, A. Rubio Bretones and B. R. Long, Radiation Characteristics of Thin-Wire Ternary Fractal Trees, IEEE Electronic Letters, vol, 35, No. 8, pp. 609-703, Apr. 15, 1999.
D. Sánchez-Hernández and Ian D. Robertson, "Analysis and Design of a Dual-Band Circularly Polarized Microstrip Patch Antenna," IEEE Transactions on Antennas and Propagation, vol. 43, No. 2, pp. 201-205, Feb. 1995.
D. Sánchez-Hernández and Ian D. Robertson, "Triple Band Microstrip Patch Antenna Using a Spur-Line Filter and a Perturbation Segment Technique," IEEE Electronic Letters, vol. 29, pp. 1565-1566, Aug. 1993.
David Sánchez-Hernández, Georgios Passiopoulos and Ian D. Robertson, "Single-Fed Dual Band Circularly Polarised Microstrip Patch Antennas," 26th EUMC, Prague, Czech Republic, pp. 273-277, Sep. 1996.
Dr. Carles Puente Baliarda; Fractal Antennas; Ph.D Dissertation; May 1997; Cover page-p. 270; Electromagnetics and Photonics Engineering group, Dept of Signal Theory and Communications, Universityat Poltecnica de Catalunya; Barcelona, Spain.
Duixian Liu and Thomas J. Watson, "A Dual-Band Antenna for Cellular Applications," AP-S IEEE, pp. 786-789, Jun. 1998.
E. Bahar and B. S. Lee, "Full Wave Vertically Polarized Bistatic Radar Cross Sections for Random Rough Surfaces-Comparison with Experimental and Numerical Results," IEEE Transactions on Antennas and Propagation, vol. 43, No. 2, Feb. 1995.
European Patent Office Communication from the corresponding European Patent Application dated Aug. 27, 2002, 4 pages.
European Patent Office Communication from the corresponding European Patent Application dated Oct. 22, 2003, 4 pages.
European Patent Office Communication from the corresponding European Patent Application dated Sep. 2, 2004, 4 pages.
Federic Croq and David M. Pozar, "Multifrequency Operation of Microstrip Antenna Using Aperture Coupled Parallel Resonators," vol. 40, No. 11, pp. 1367-1374, Nov. 1992.
G. J. Walker and J. R. James, "Fractal Volume Antennas," IEEE Electronic Letters, vol. 34, No. 16, pp. 1536-1537, Aug. 6, 1998.
G. P. Srivastava, S. Bhattacharya and S. K. Padhi, "Dual Band Tunable Microstrip Patch Antenna," IEEE Electronic Letters, vol. 35, pp. 1397-1399, Aug. 1999.
Gianvittorio, Fractal antenna research at UCLA, UCLA Antenna Lab, Nov. 1999.
Gobien, Andrew T., "Investigation of Low Profile Antenna Designs for Use in Hand-Held Radios," Aug. 1, 1997, Faculty of the Virginia Polytechnic Institute and State University, Blacksburg, Virginia, USA.
Gonzalez, J. M., et al., "Active Zone Self-Similarity of Fractal-Sierpinski Antenna Verified Using Infra-Red Thermograms," Electronics Letters, vol. 35, No. 17, pp. 1393-1394, Aug. 19, 1999.
Gough, C. E., et al., "High Tc Coplanar Resonators for Microwave Applications and Scientific Studies," Physica C, NL, North-Holland Publishing, Amsterdam, vol. 282-287, No. 2001, pp. 395-398, Aug. 1, 1997.
Griffin, Donald W., et al., "Electromagnetic Design Aspects of Packages for Monolithic Microwave Integrated Circuit-Based Arrays with Integrated Antenna Elements," IEEE Transactions on Antennas and Propagation, vol. 43, No. 9, pp. 927-931, Sep. 1995.
Gui-Bin Hsieh and Shan-Cheng Pan, "Dual-Frequency Slotted Triangular Microstrip Antenna With an Inset Microstrip-Line Feed," Microwave and Optical Technology Letters, vol. 27, No. 5, pp. 318-320, Dec. 5, 2000.
M. W. Nurnberger and J. L. Volakis, "A New Planar Feed for Slot Spiral Antennas," IEEE Transactions on Antennas and Propagation, vol. 44, No. 6, pp. 130-131, Jan. 1996.
N. Chiba, T. Amano and H. Iwasaki, "Dual-Frequency Planar Antenna for Handsets," IEEE Electronic Letters, vol. 34, No. 25, pp. 2362-2363, Dec. 10, 1998.
Naftali Herscovici, "New Considerations in the Design of Microstrip Antennas," IEEE Transaction on Antennas and Propagation, vol. 46, No. 6, pp. 807-812, Jun. 6, 1998.
Nathan Cohen, "Fractal and Shaped Dipoles," Communications Quarterly: The Journal of Communications Technology, pp. 25-36, Spring 1995.
Nathan Cohen, "Fractal Antennas, Part 1," Communications Quarterly: The Journal of Communications Technology, pp. 7-22, Summer 1995.

Nathan Cohen, "Fractal Antennas: Part 2—A Discussion of Relevant, But Disparate Qualities," Communications Quarterly: The Journal of Communications Technology, pp. 53-66, Summer 1996.
Navarro Rodero, Monica, "Diverse Modifications Applied to the Sierpinski Antenna, a Multi-Band Fractal Antenna" (Final Degree Project), Oct. 1997, Universitat Politecnica de Catalunya, Barcelona Spain.
Navarro, M., et al., "Self-similar Surface Current Distribution on Fractal Sierpinski Antenna Verified with Infrared Thermograms," IEEE Antennas & Propagation, URSI Symposium Meeting, Orlando, Florida, pp. 1566-1569, Jul. 1999.
Nirun Kumprasert, "Theoretical Study of Dual-Resonant Frequency and Circular Polarization of Elliptical Microstrip Antennas," IEEE, 2000.
Nokia Mobile Phones, "User's guide," 1999, 82 pages, Nokia Mobile Phones, Finland.
P. M. Bafrooei and L. Shafai, "Characteristics of Single- and Double-Layer Microstrip Square-Ring Antennas," IEEE Transactions on Antennas and Propagation, vol. 47, No. 10, pp. 1633-1639, Oct. 1999.
Pan, Single-feed dual-frequency microstrip antenna with two patches, IEEE Antennas and Propagation Society International Symposium, 1999.
Papaolymerou, Ioannis et al., "Micromachined Patch Antennas," IEEE Transactions on Antennas and Propagation, vol. 46, No. 2, pp. 275-283, Feb. 1998.
Parker, et al., "Convoluted Array Elements and Reduced Size Unit Cells for Frequency-Selective Surfaces," Microwaves, Antennas & Propagation, IEEE Proceedings H, vol. 138, No. 1, pp. 19-22, Feb. 1991.
Pribetich, P. et al, "Quasifractal Planar Microstrip Resonators for Microwave Circuits," Microwave and Optical Technology Letters, vol. 21, No. 6, pp. 433-436, Jun. 20, 1999.
Puente Baliarda, Carles, et al., "The Koch Monopole: A Small Fractal Antenna," IEEE Transactions on Antennas and Propagation, New York, vol. 48, No. 11, Nov. 1, 2000, pp. 1773-1781.
Puente, C., et al., "Fractal Multiband Antenna Based on the Sierpinski Gasket," Electronics Letters, vol. 32, No. 1, pp. 1-2, Jan. 4, 1996.
Puente, C., et al., "Multiband Fractal Antennas and Arrays," Fractals in Engineering from Theory to Industrial Applications, Editors: J. L. Vehel, F. Lutton and C. Tricot, Springer, New York, pp. 222-236, 1997.
Puente, C., et al., "Multiband Properties of a Fractal Tree Antenna Generated by Electrochemical Deposition," Electronics Letters, IEEE, Stevenage, GB, vol. 32, No. 25, pp. 2298-2299, Dec. 5, 1996.
Puente, C., et al., "Perturbation of the Sierpinski Antenna to Allocate Operation Bands," Electronics Letters, vol. 32, No. 24, pp. 2186-2187, Nov. 21, 1996.
Puente, C., et al., "Small But Long Koch Fractal Monopole," Electronics Letters, IEEE, Stevenage, GB, vol. 34, No. 1, pp. 9-10, Jan. 8, 1988.
Puente, Carles et al., "Fractal Shaped Antennas," Chapter 2, IEEE Press, pp. 48-50, Jan. 1, 2000.
Puente-Baliarda, Carles, et al., "Fractal Design of Multiband and Low Side-Lobe Arrays," IEEE Transaction on Antennas and Propagation, vol. 44, No. 5, pp. 730-739, May 1996.
Puente-Baliarda, Carles, et al., "On the Behavior of the Sierpinski Multiband Fractal Antenna," IEEE Transactions on Antennas and Propagation, vol. 46, No. 4, pp. 517-524, Apr. 1998.
R. B. Waterhouse, "Printed Antenna Suitable for Mobile Communications Handsets" IEEE Electronic Letters, vol. 33, No. 22, pp. 1831-1832, Oct. 23, 1997.
R. Breden and R. J. Langley, "Printed Fractal Antennas," National Conference on Antennas and Propagation: Mar. 30-Apr. 1, 1999, IEE Conference Publication No. 461, pp. 1-4, 1999.
Romeu, Jordi et al, "A Three Dimensional Hilbert Antenna," IEEE, pp. 550-553, 2002.
Romeu, Jordi et al., Abstract of "Small Fractal Antennas," pp. 35-36, Jun. 1, 1999.
Roscoe, Tunable dipole antennas, Antennas and propagation society international symposium 1993.
Rowell et al. A Compact PIFA Suitable for Dual-Frequency 900/1800-MHz Operation, IEEE Transactions on Antennas and Propagation, 1998, vol. 46, No. 4.
Russian Patent Office Communication (with its English translation) from the corresponding Russian Patent Application, 10 pages Official Action in English., Sep. 2, 1999.
S. A. Bokhari, Jean-Francois Zurcher, Juan R. Mosig and Fred E. Gardiol, "A Small Microstrip Patch Antenna with a Convenient Tuning Option," IEEE Transactions on Antennas and Propagation, vol. 44, No. 11, pp. 1521-1528, Nov. 1996.
S. D. Targonski and D. M. Pozar, "Dual-Band Dual Polarised Printed Antenna Element," IEEE Electronic Letters, vol. 34, pp. 2193-2194, Nov. 1998.
S. K. Palit, A. Hamadi and D. Tan, "Design of a Wideband Dual-Frequency Notched Microstrip Antenna," AP-S IEEE, pp. 2351-2354, Jun. 1998.
S. Maci and G. B. Gentili, "Dual-Frequency Patch Antennas," IEEE Antennas and Propagation Magazine, vol. 39, No. 6, pp. 13-20, Dec. 1997.
S. Maci, G. Biffi Gentili and G. Avitable, "Single-Layer Dual Frequency Patch Antenna," IEEE Electronic Letters, vol. 29,pp. 1441-1443, Aug. 1993.
Samavati, Hirad, et al., "Fractal Capacitors," IEEE Journal of Solid-State Circuits, vol. 33, No. 12, pp. 2035-2041, Dec. 1998.
Sanad, An internal integrated microstrip antenna for PCS/Cellular telephones and other hand-held portable communication equipment, 1998.
Sanad, Compact internal multiband microstrip antennas for portable GPS, PCS, cellular and satellite phones, Microwave Journal, 1999.
Sanad, Mohamed, "A Compact Dual-Broadband Microstrip Antenna Having Both Stacked and Planar Parasitic Elements," IEEE Antennas and Propagation Society International Symposium 1996 Digest, pp. 6-9, Jul. 21-26, 1996.
Sanchez, D., A survey of broadband microstrip Patch Antennas, Microwave Journal, Sep. 1996.
Shan-Cheng Pan and Kin-Lu Wong, "Dual-Frequency Triangular Microstrip Antenna with a Shorting Pin," IEEE Transactions on Antennas and Propagation, vol. 45, pp. 1889-1891, Dec. 1997.
Sheng-Ming Deng, "A T-Strip Loaded Rectangular Microstrip Patch Antenna for Dual-Frequency Operation," 1999 IEEE AP-S International Symposium, National Radio Science Meeting, Jul. 11-16, 1999.
Shun-Shi Zhong and Jun-Hai Cui, "Compact Dual-Frequency Microstrip Antenna," IEEE, 2000.
Soler, J., et al., "Solutions to Tailor the Radiation Patterns of 2D and 3D Multiband Antennas based on the Sierpinski Fractal," 1 page, Jun. 22, 2003.
T. Morioka, S. Araki and K. Hirasawa, "Slot Antenna with Parasitic Element for Dual Band Operation," IEEE Electronic Letters, vol. 24, No. 25, pp. 2093-2094, Dec. 4, 1997.
T. Williams, M. Rahman and M. A. Stuchly, "Dual-Band Meander Antenna for Wireless Telephones," IEEE Microwave and Optical Technology Letters, vol. 24, No. 2, pp. 81-85, Jan. 20, 2000.
Tanidokoro, Hiroaki, et al., "I-Wavelength Loop Type Dielectric Chip Antennas," IEEE, pp. 1950-1953, 1998.
V.A. Volgov, "Parts and Units of Radio Electronic Equipment (Design & Computation)," Energiya, Moscow (with English Translation), 4 pages, 1967. English Summary.
Viratelle, D. Dual band PIFA antenna, 1999.
Adcock, M. D., "New Type Feed for High Speed Conical Scanning," The Second Symposium on the USAF Antenna Research and Development Program, Oct. 19-23, 1952.
Andersen, J. B., "Low- and Medium-Gain Microwave Antennas," in A. W. Rudge, K. Milne, A. D. Olver, and P. Knight (eds.), The Handbook of Antenna Design, vols. 1 and 2, London, Peter Peregrinus Ltd., 1986.
Gupta, Microstrip Antenna Design, Norwood, MA, Artech House 1988.
Azadegan and Sarabandi, Design of Miniature Slot Antennas, IEEE Antennas and Propagation Society International Symposium, 2001 Digest, vol. 4 pp. 565-568 (Jul. 8, 2001).
Balanis, "Antenna Theory: Analysis and Design," John Wiley & Sons: 1997.

Barrick, William, "A Helical Resonator Antenna Diplexer," The Tenth Symposium on the USAF Antenna Research and Development Program, Oct. 3-7, 1960.
Batson, D. et al., "VHF Unfurlable Turnstile Antennas," The Nineteenth Symposium on the USAF Antenna Research and Development Program, Oct. 14-16, 1969.
Besthom, J.W., "1.0-to 21.0-GHz Log-Periodic Dipole Antenna," presented at the Eighteenth Annual Symposium on the USAF Antenna Research and Development Program, Oct. 15-17, 1968.
Gupta, K.C., "Broadbanding Techniques for Microstrip Patch Antennas—A Review," Antenna Applications Symposium, Sep. 21-23, 1988.
"Broadband Passive Electrically Small Antennas for TV Application," presented at the Proceedings of the 1977 Antenna Applications Symposium on Apr. 27-29, 1977 at Robert Allerton Park at the University of Illinois.
Brown, A. R. and Rebeiz, G. M. "A High-Performance Integrated K-Band Diplexer," IEEE Transactions on Microwave Theory and Techniques, 47, Aug. 8, 1999.
Burnett, G. F., "Antenna Installations on Super Constellation Airborne Early Warning and Control Aircraft," The Fourth Symposium on the USAF Antenna Research and Development Program, Oct. 17-21, 1954.
Bushman, F. W. et al., "The Boeing B-52 All Flush Antenna System," The Fifth Symposium on the USAF Antenna Research and Development Program, Oct. 16-20, 1955.
Campi, M., "Design of Microstrip Linear Array Antennas," 1981 Antenna Applications Symposium, Sep. 23-25, 1981.
Carver, Keith R. and Mink, James W., "Microstrip Antenna Technology," IEEE Transactions on Antennas and Propagation, AP-29, 1, Jan. 1981, pp. 2-24.
Chen, "Dual Frequency Microstrip Antenna with Embedded Reactive Loading," Microwave and Optical Technology Letters, vol. 23, No. 3, Nov. 5, 1999.
Chen, M. H., Tung, T. X. and Yodokawa, T. "A Compact EHF/SHF Dual Frequency Antenna," IEEE International Symposium on Antennas and Propagation Digest, 4, May 7-11, 1990.
Cohen, "NEC4 Analysis of a Fractalized Monofilar Helix in an Axial Mode," Conference Proceedings Volume II for the 14th Annual Review of Progress in Applied Computational Electromagnetics at the Naval Postgraduate School in Montery, CA, Mar. 16-20, 1998.
Cohen, Nathan, "Fractal Element Antennas," Journal of Electronic Defense, Jul. 1997.
Cohn, S. B., "Flush Airborne Radar Antennas," The Third Symposium on the USAF Antenna Research and Development Program, Oct. 18-22, 1953.
Collier and Shnitkin, "Summary of the Monopole as a Wideband Array Antenna Element," presented at the 1993 Antenna Applications Symposium on Sep. 23, 1993.
Contreras, "Fractal Miniature Antenna" UPC Baix Llobregat Polytechnic University Project Research (Sep. 1997).
Guo, Y.X. et al., "Double U-slot rectangular patch antenna," Electronics Letters, vol. 34, No. 19, pp. 1805-1806 (Sep. 17, 1998).
Greiser, J. W. and Brown, G. S., "A 500:1 Scale Model of Warla—A Wide Aperture Radio Location Array," presented at The Thirteenth Symposium on the USAF Antenna Research and Development Program on Oct. 14-18, 1963 at the University of Illinois Antenna Laboratory in Urbana, Illinois.
Daniel, Kumar, "Rectangular Microstrip Antennas with stub along the non-radiating edge for Dual Band Operation," IEEE Antennas and Propagation Society International Symposium 1995 Digest, vol. 4, p. 2136-2139.
Deschamps, G. et al., "Microstrip Microwave Antenna," The Third Symposium on the USAF Antenna Research and Development Program, Oct. 18-22, 1953.
Dickstein, Harold D., "Antenna System for a Ground Passive Electronic Reconnaissance Facility," The Eighth Symposium on the USAF Antenna Research and Development Program, Oct. 20-24, 1958.
DuHamel R. H. and Isbell, D. E., "Broadband Logarithmically Periodic Antenna Structures," IRE International Convention Record, 5, Part 1, Mar. 1957, pp. 119-128.
Du Plessis, "Tuning Stubs for Microstrip Patch Antennas," IEEE Antennas and Propagation Magazine, vol. 36, issue 6, pp. 52-56, 1993.
Dyson, J.D., "The Non-Planar Equiangular Spiral Antenna," The Eighth Symposium on the USAF Antenna Research and Development Program, Oct. 20-24, 1958.
Dyson, J.D., "The Equiangular Spiral Antenna," The Fifth Symposium on the USAFAntenna Research and Development Program, Oct. 16-20, 1955.
Ellis, A.R., "Airborne U-H-F Antenna Pattern Improvements," The Third Symposium on the USAF Antenna Research and Development Program, Oct. 18-22, 1953.
Esteban, J. and Rebollar, J. M., "Design and Optimization of a Compact Ka-Band Antenna Diplexer," IEEE International Symposium on Antennas and Propagation Digest, 1, Jun. 18-23, 1995, pp. 148-151.
ETSI, "Global System for Mobile Communications: Digital cellular telecommunications system (Phase 2); Mobile Station (MS) conformance specification; Conformance specification (GSM 11.10-1)," European Telecommunication Standard, Mar. 1996.
ETSI, "Global System for Mobile Communications: Digital cellular telecommunications system (Phase 2+); Abbreviations and acronyms (GSM 01.04)," GSM Technical Specification, Version 5.0.0, Mar. 1996.
ETSI, "Global System for Mobile Communications: Digital cellular telecommunications system (Phase 2); Types of Mobile Stations (MS) (GSM 02.06)," European Telecommunication Standard, 3rd ed., May 1996.
ETSI, "Global System for Mobile Communications: Digital cellular telecommunications system (Phase 2+); Radio transmission and reception (GSM 05.05)," GSM Technical Specification, Version 5.2. 0, Jul. 1996.
ETSI, "Global System for Mobile Communications: Digital cellular telecommunications system (Phase 2); Mobile Station (MS) conformance specification; Part 1: Conformance specification (GSM 11.10-1 version 4.21.1)," European Telecommunication Standard, 8th ed., Aug. 1998.
Fenwick, R., "A New Class of Electrically Small Antennas," Presented at the Fourteenth Annual Symposium on USAF Antenna Research and Development, presented Oct. 6-8, 1964.
Ferris, J. E. et al., "A Status report of an Azimuth and Elevation Direction Finder" The Eighteenth Symposium on the USAF Antenna Research and Development Program, Oct. 15-17, 1968.
Force, R.D., et al. "Synthesis of Multilayer Walls for Radomes of Aerospace Vehicles," The Seventeenth Symposium on the USAF Antenna Research and Development Program, Nov. 14-17, 1967.
Gilbert, R., Structurally-Integrated Optically-Reconfigurable Antenna Array 1995 Antenna Applications Symposium, Sep. 20-22, 1995.
Gillespie, Edmond S., "Glide Slope Antenna in the Nose Radome of the F104A and B," The Seventh Symposium on the USAF Antenna Research and Development Program, Oct. 21-25, 1957.
Gray, "Electronically Steerable Yagi-Uda Microstrip Patch Antenna," IEEE Transactions on Antennas and Propagation, vol. 46, No. 5, May 1998.
Liu, Z. A novel dual-band antenna for hand-held potable telephone. Antennas and Propagation Society International Symposium, 1996.
H. F. Hammad, Y. M. M. Antar and A. P. Freundorfer, "Dual Band Aperture Coupled Antenna Using Spur Line," IEEE Electronic Letters, vol. 33, pp. 2088-2090, Dec. 1997.
H. Iwasaki and Y. Suzuki, "Electromagnetically Coupled Circular-Patch Antenna Consisting of Multilayered Configuraton," IEEE Transactions on Antennas and Propagation, vol. 44, No. 6, pp. 777-780, Jun. 1996.
H. Meinke and F.V. Gundlah, "Radio Engineering Reference" (book), vol. I: Radio components, Circuits with lumped parameters, Transmission lines, Wave-guides, Resonators, Arrays, Radio waves propagation, States Energy Publishing House, Moscow (with English Translation), 4 pages, 1961. English Summary.
Hall, P.S. "System Applications: The Challenge for Active Integrated Antennas," 5 pages Apr. 1, 2000.
Hansen, R. C., "Fundamental Limitations in Antennas," Proceedings of the IEEE, vol. 69, No. 2, pp. 170-182, Feb. 1981.

Hara Prasad, R.V. et al., "Microstrip Fractal Patch Antenna for Multi-Band Communication," Electronics Letters, IEEE, Stevenage, GB, vol. 36, No. 14, pp. 1179-1180, Jul. 6, 2000.
Hart et al. Fractal element antennas, Digital Image Computing and Applications 97 in New Zealand, 1997.
Hoffmeister, M., The dual-frequency inverted f-monopole antenna for mobile communications, 1999.
Hohlfeld, Robert G., et al., "Self-Similarity and the Geometric Requirements for Frequency Independence in Antennae," Fractals, vol. 7, No. 1, pp. 79-84, 1999.
Hooman Tehrani and Kai Chang, "A Multi-Frequency Microstrip-Fed Annular Slot Antenna," AP-S IEEE, pp. 1-4, Jul. 2000.
Kim, Kihong, et al., "Integrated Dipole Antennas on Silicon Substrates for Intra-Chip Communication," IEEE, 4 pages, 1999.
J. Anguera, C. Puente, J. Romeu and C. Borja, "An Optimum Method to Design Probe-Fed Single-Layer Single-Path Wideband Microstrip Antenna," AP2000 Millenium Conference on Antennas and Propagation, Davos, Apr. 2000.
J. Anguera, G. Font, C. Puente, C. Borja and J. Soler, "Multifrequency Microstrip Patch Antenna Using Multiple Stacked Elements," IEEE Microwave and Wireless Components Letters, vol. 13, No. 3, pp. 123-124, Mar. 2003.
J. F. Zorcher, D. Marty, O. Staub and A. Skrivervik, "A Compact Dual-Port, Dual-Frequency SSFIP/PIFA Antenna with High Decoupling," Microwave and Optical Technology Letters, vol. 22, No. 6, pp. 373-378, Sep. 20, 1999.
J. Fuhl, P. Nowak and E. Bonek, "Improved Internal Antenna for Hand-Held Terminals," IEEE Electronic Letters, vol. 30, pp. 1816-1818, Oct. 1994.
J. Ollikainen, M. Fischer and P. Vainikainen, "Thin Dual-Resonant Stacked Shorted Patch Antenna for Mobile Communications," IEEE Electronic Letters, vol. 35, No. 6, pp. 437-438, Mar. 18, 1999.
J. Romeu and Y. Rahmat-Samii, "Dual Band FSS with Fractal Elements," IEEE Electronic Letters, vol. 35, pp. 702-703, Apr. 1999.
J. Soler and C. Puente, "Analysis of the Sierpinski Fractal Multiband Antenna Using the Multiperiodic Traveling Wave V Model," 24th ESTEC Antenna Workshop on Innovative Periodic Antennas, ESTEC, Noordwijk, pp. 53-57, May-Jun. 2000.
J. Soler and J. Romeu, "Antenas de Sierpinski de Modulo-p," Proceedings of the XIII Nacional Symposium of the Scientific International Union of Radio, URSI 2000, Zaragoza, Spain, Sep. 2000. English Abstract.
J. Soler, C. Puente and A. Munduate, "Novel Broadband and Multiband Solutions for Planar Monopole Antenas," IEEE Antennas and Propagation Society International Symposium 2002, San Antonio, Jun. 2002.
J. Soler, C. Puente and J. Anguera, "Results on a New Extended Analytic Model to Understand the Radiation Performance of Mod-P Sierpinski Fractal Multiband Antennas," AP-S, 2003.
J. Soler, D. D Garcia, C. Puente and J. Anguera, "Novel Combined Mod-P Structures, A Complete Set of Multiband Antennas Inspired on Fractal Geometries," AP-S, 2003.
J. Soler, J. Romeu and C. Puente, "Mod-p Sierpinski Fractal Multiband Antenna," AP2000 Millennium Conference on Antennas and Propagation, Davos, Apr. 9-14, 2000.
Jacinto Barreiros, Pedro Cameirão and Custódio Peixeiro, "Microstrip Patch Antenna for GSM 1800 Handsets," AP-S, IEEE, Jul. 1999.
Jacob George, C. K. Aanandan, P. Mohanan and K. G. Nair, "Analysis of a New Compact Microstrip Antenna," IEEE Transactions on Antennas and Propagation, vol. 46, No. 11, pp. 1712-1717, Nov. 1998.
Jaggard, Dwight L., "Fractal Electrodynamics and Modeling," Directions in Electromagnetic Wave Modeling, pp. 435-446, 1991.
Jaume Anguera, Carles Puente, Carmen Borja and Raquel Montero, "Antenna Microstrip Miniatura y de Alta Directividad basada en el fractal de Sierpinski," Proceedings of the XIV National Symposium of the Scientific International Union of Radio, URSI '01, Madrid, Spain, Sep. 2001, English Abstract.
Jaume Anguera, et al., "Diserio de Antenas Impresas de Banda Ancha Alimentadas Mediante Acoplo Capacitivo," Proceedings of the XIII National Symposium of the Scientific International Union of Radio, URSI '00, Zaragoza, Spain, Sep. 2000, English Abstract.
Jia-Yi Sze and Kin-Lu Wong, "Designs of Broadband Microstrip Antennas with Embedded Slots," AP-S, IEEE, Jul. 1999.
John P. Gianvittorio and Yahya Rahmat-Samii, "Fractal Element Antennas: A Compilation of Configurations with Novel Characteristics," IEEE, 4 pages, 2000.
Jordi Romeu and Yahya Rahmat-Samii, "A Fractal Based FSS with Dual Band Characteristics," AP-S IEEE, pp. 1734-1737, Jul. 1999.
Jui-Han Lu, "Single-Feed Circularly Polarized Triangular Microstrip Antennas," AP-S IEEE, Jul. 1999.
Jui-Han Lu, "Single-Feed Dual-Frequency Rectangular Microstrip Antenna," AP-S, IEEE, Jul. 2000.
Jui-Han Lu, "Slot-Loaded Rectangular Microstrip Antenna for Dual-Frequency Operation," IEEE Microwave and Optical Technology Letters, vol. 24, No. 4, pp. 234-237, Feb. 2000.
Jui-Han Lu, Chia-Luan Tang and Kin-Lu Wong, "Single-Feed Slotted Equilateral-Triangular Microstrip Antenna for Circular Polarization," vol. 47, No. 7, pp. 1174-1178, Jul. 1999.
Jungmin Chang and Sangseol Lee, "Hybrid Fractal Cross Antenna," IEEE Microwave and Optical Technology Letters, vol. 25, No. 6, pp. 429-435, Jun. 20, 2000.
K. P. Ray and G. Kumar, "Multi-Frequency and Broadband Hybrid-Coupled Circular Microstrip Antennas," IEEE Electronic Letters, vol. 33, pp. 437-438, Mar. 1997.
Kin-Lu Wong and Jian-Yi Wu, "Single-feed Small Circularly Polarized Square Microstrip Antenna," IEEE Electronic Letters, vol. 33, pp. 1833-1834, Oct. 1997.
Kin-Lu Wong and Kai-Ping Yang, "Modified Planar Inverted F Antenna," IEE Electronics Letters, vol. 34, No. 1, pp. 7-8, Jan. 1998.
Kin-Lu Wong and Kai-Ping Yang, "Small Dual-Frequency Microstrip Antenna with Cross Slot," IEEE Electronic Letters, vol. 33, No. 23, pp. 1916-1917, Nov. 6, 1997.
Kin-Lu Wong and Tzung-Wern Chiou, "Single-Patch Broadband Circularly Polarized Microstrip Antennas," IEEE, 2000.
Kin-Lu Wong and Wen-Hsiu Hsu, "Broadband Triangular Microstrip Antenna with U-Shaped Slot," IEEE Electronic Letters, vol. 33, pp. 2085-2087, Dec. 1997.
Kronberger, R., Multiband planar inverted-F car antenna for mobile phone and GPS, IEEE, 1999.
Kyu-Sung Kim, Taewoo Kim and Jaehoon Choi, "Dual-Frequency Aperture-Coupled Square Patch Antenna with Double Notches," IEEE Microwave and Optical Technology Letters, vol. 24, No. 6, pp. 370-374, Mar. 20, 2000.
Lu et al. Slot-loaded, meandered rectangular microstrip antenna with compact dual-frequency operation. Electronic Letters, May 1998, vol. 34, No. 11.
Lu, Slot-loaded rectangular microstrip antenna for dual-frequency operation, Microwave and Optical Technology Letters, Feb. 2000, vol. 24, No. 4.
M. Navarro, C. Puente, R. Bartolome, A. Medina, J. Romeu and R. Pous, "Modification de la Antena de Sierpinski para el Ajuste de las Bandas Operativas," XII Simposium Nacional URSI, vol. I, pp. 371-373, Bilbao, Sep. 1997, English Abstract.
M. Navarro, et al., "Comprobackón del Comportamiento Autosimilar de la Distribución de Corrientes sobre la Superficie de la Antena Fractal de Sierpinski Mediante Termografias de Infrarojos," XII Simposium Nacional URSI, vol. I, pp. 369-371, Sep. 1998, English Abstract.
M. Rahman, M. A. Stuchly and M. Okoniewski, "Dual-Band Strip-Sleeve Monopole for Handheld Telephones," IEEE Microwave and Optical Technology Letters, vol. 21, No. 2, pp. 79-82, Apr. 1999.
M. Sindou, G. Ablart and C. Sourdois, "Multiband and Wideband Properties of Printed Fractal Branched Antennas," IEEE Electronic Letters, vol. 35, No. 3, pp. 181-182, Feb. 4, 1999.
Buczkowski , Stéphane ; Kyriacos , Soula ; Nekka , Fahima ; Cartilier , Louis , The modified box-countig method: analysis of some characteristic paramenters , Pattern Recognition , Apr. 20, 1998.
Mandelbrot , Benoit , The fractal geometry of nature , H. B. Fenn and Company , Jan. 1, 1977.
Munson , R. E. , Conformal microstrip communication antenna , Symposium on USAF antenna Research and Development, 23th , Oct. 10, 1973.

Song, C. T. P. , Triple-band planar inverted F antenna , Antennas and Propagation Society International Symposium, 1999. IEEE , Jul. 11, 1999.
Nokia 8260—FCC ID GMLNSW-4DX , Nokia , Apr. 1, 1999.
Behncke , M. , Document 876—Fractus's surreply to defendants' Motion for Summary Judgment re publication dates of three references , Susman Godfrey , Apr. 20, 2011.
Bhaysar , S. A. , Document 641—Defendant HTC America, Inc's second amended answer and counterclaim to plaintiffs second amended complaint , Defendants , Feb. 25, 2011.
Bhaysar , S. A. , Document 642—Defendant HTC Corporation's second amended answer and counterclaim to plaintiffs second amended complaint , Defendants , Feb. 25, 2011.
Davis, Leonard , Document 783—Order , Court , Apr. 1, 2011.
Howe , M. , Document 887—Fractus's Response to Defendants' Motion to Clarify Claim Construction , Susman Godfrey , Apr. 25, 2011.
Howe , M. , Document 893—Fractus SA's surreply to defendants motion to clarify claim construction , Susman Godfrey , Apr. 29, 2011.
Howe , M. , Document 902—Fractus SA's objections to defendants' prior art notice , Susman Godfrey , May 2, 2011.
Howe , M. , Document 939—Fractus's response to defendants' motion for reconsideration of and objections to the May 2, 2011, report and recommendations clarifying claim construction , Susman Godfrey , May 10, 2011.
Howe , Micah J. , Document 768—Fractus, S.A.'s objections to the Court's Mar. 9, 2011, Order , Susman Godfrey , Mar. 25, 2011.
Jaggard , D. L. , Expert report of Dwight L. Jaggard (redacted)—expert witness retained by Fractus , Fractus , Feb. 23, 2011.
Jaggard , D. L. , Rebuttal expert report of Dr. Dwight L. Jaggard (redacted version) , Fractus , Feb. 16, 2011.
Jones, Michael E. , Document 780—Defendants' opposition to Fractus SA objections to the Court's Mar. 9, 2011 Order , Defendants—Baker Botts, LLP , Mar. 31, 2011.
Long , S. , Expert report of Stuart Long (redacted)—expert witness retained by Fractus , Fractus , Feb. 23, 2011.
Long , S. A. , Rebuttal expert report of Dr. Stuart A. Long (redacted version) , Fractus , Feb. 16, 2011.
Love , J. , Document 900—Order , Court , Apr. 29, 2011.
Love , J. , Document 901—Report and recommendation of United States Magistrate Judge , Court , May 2, 2011.
Love , J. D. , Document 868—Order , Court , Apr. 19, 2011 Sirola, Neil P. , Document 721—Letter to John D. Love—Permission to file a motion for summary judgment of invalidity.
Sirola, Neil P. , Document 721—Letter to John D. Love—Permission to file a motion for summary judgment of invalidity of the following 7 asserted claims from the MLV, patent family . . . , Defendants—Baker Botts, LLP , Mar. 18, 2011.
Sirota , N. , Document 915—Defendants' response to plaintiffs objections to defendants notice of prior art , Defendants , May 5, 2011.
Stutzman , W. L. , Expert report of Dr. Warren L. Stutzman (redacted)—expert witness retained by Fractus , Fractus , Feb. 23, 2011.
Stutzman , W. L. , Rebuttal expert report of Dr. Warren L. Stutzman (redacted version) , Fractus , Feb. 16, 2011.
Tribble , M. L. , Document 716—Letter to John D. Love—Permission to file a partial summary judgement motion on infringement. , Susman Godfrey , LLP , Mar. 18, 2011.
Tribble, M. L. , Document 715—Letter to John D. Love—Permission to file a summary judgment motion of no indefiniteness on the issues wher the Court's Report and Recommendation already has held that the claim term is not indefinite , Susman Godfrey , Mar. 18, 2011.
Declaration of Jeffery D. Baxter—Including Exhibits: J, K, L, M , N ,O, P, Q, R, S, T, U, Z, AA, KK, LL, WW, BBB, EEE, GGG, HHH, III, KKK, MMM, NNN, OOO, PPP, QQQ, TTT, UUU, VVV, WWW, YYY, ZZZ, AAAA, BBBB , Defendants , Jul. 30, 2010.
Defendant Pantech Wireless Inc amended answer, affirmative defenses, and counterclaims to Fractus' second amended complaint , Defendants , Feb. 28, 2011.
Defendants LG Electronics Inc, LG Electronics USA, and LG Electronics Mobilecomm USA Inc's second amended answer and counterclaim to second amended complaint , Defendants , Feb. 28, 2011.
Defendants Samsung Electronics Co LTD (et al) second amended answer and counterclaims to the second amended complaint of plaintiff Fractus SA , Defendants , Feb. 28, 2011.
Document 645—Reply brief in support of Defendant's motion for reconsideration of the court's ruling on the term "at least a portion" in the court's Dec. 17, 2010 claim construction order based on newly-available evidence , Defendants , Feb. 25, 2011.
Document 666—Fractus's sur-reply to defendants' motion for reconsideration of the court's december 17, 2010 claim construction order based on newly-available evidence , Susman Godfrey , Mar. 8, 2011.
Document 670—Order , Court , Mar. 9, 2011.
Document 678—Plaintiff Fractus SA's answer to second amended counterclaims of defendant HTC Corporation to Fractus's second amended complaint , Fractus , Mar. 14, 2011.
Document 680—Plaintiff Fractus SA's answer to second amended counterclaims of defendant HTC to Fractus's second amended complaint , Fractus , Mar. 14, 2011.
Document 694—Plaintiff Fractus SA's answer to second amended counterclaims of defendant LG Electronics to Fractus's second amended complaint , Susman Godfrey , Mar. 15, 2011.
Document 695—Plaintiff Fractus SA's answer to second amended counterclaims of defendant Samsung to Fractus's second amended complaint , Susman Godfrey , Mar. 15, 2011.
Document 696—Plaintiff Fractus SA's answer to amended counterclaims of defendant Pantech Wireless Inc to Fractus's second amended complaint , Susman Godfrey , Mar. 15, 2011.
Document 841—Stipulation of Dismissal of all Claims and Counterclaims re '850 and '822 , Defendants , Apr. 15, 2011.
Document 843—Joint Motion to Dismiss Claims and Counterclaims re '850 and '822 , Defendants , Apr. 15, 2011.
Document 854—Defendants' Motion to Clarify Claim Construction , Defendants , Apr. 18, 2011.
Document 889—Reply in support of defendants' motion to clarify claim construction , Defendants , Apr. 27, 2011.
Document 933—Defendants' motion for reconsideration of, and objections to, the May 2, 2011 report and recommendation clarifying claim construction , Defendants , May 9, 2011.
Infringement Chart—HTC Touch Pro 2. Patent: 7015868 , Fractus , Nov. 5, 2009.
Druce T. , Request for inter partes reexamination of US patent 7528782—U.S. Appl. No. 95/001,455—Third party requester's comments to patent owner's reply of Feb. 22, 2011 , Novak Druce & Quigg—Samsung , Apr. 28, 2011.
Druce, T. , Request for inter partes reexamination of US patent 7015868—U.S. Appl. No. 95/001,390—Third party requester's comments to patent owner's reply of Apr. 11, 2011 , Novak Druce & Quigg LLP—Samsung , May 2, 2011.
Lee , M. , Corrected patent owner's response to office action of U.S. Appl. No. 951001,455 dated on Nov. 19, 2010 , Sterne Kessler , Apr. 12, 2011.
Lee , M. , Corrected patent owner's response to office action of U.S. Appl. No. 95/001,455 dated on Nov. 19, 2010—Exhibit 1 , Sterne Kessler , Apr. 12, 2011.
Lee , Michael Q. , Corrected response to office action for U.S. Appl. No. 95/001,390 of Aug. 19, 2010 , Sterne Kessler Goldstein & Fox, PLLC ; Fractus , Apr. 11, 2011.
Lee , Michael Q. , Corrected response to office action for U.S. Appl. No. 95/001,390 of Aug. 19, 2010 , Sterne Kessler Goldstein & Fox, PLLC ; Fractus , Apr. 11, 2011.
Menefee , James , Office Action for the U.S. Appl. No. 95/001,389 dated on Aug. 12, 2010 , United States Patent and Trademark Office , Aug. 12, 2010.
Nguyen , L. M. , Office Action in inter partes reexamination for the U.S. Appl. Nos. 95/000,586 , 95/001,482 and 95/001,497 dated on May 13, 2011 , United States Patent and Trademark Office , May 13, 2011.
Nguyen , L. M. , Office action in inter partes reexamination for the U.S. Appl. Nos. 95/000,588 , 95/011,500 and 95/001,483 , United States Patent and Trademark Office , Apr. 7, 2011.

Phan , T. , Office action for the U.S. Appl. No. 12/400,888 dated on Oct. 5, 2010 , USPTO , Oct. 5, 2010.
Phan , T. G. , Notice of allowance for the U.S. Appl. No. 12/400,888 dated on Apr. 18, 2011 , United States Patent and Trademark Office , Apr. 18, 2011.
Phan, T. G. , Notice of allowance of the U.S. Appl. No. 12/400,888 dated on Feb. 7, 2011 , United States Patent and Trademark Office , Feb. 7, 2011.
Phan, T. G. , Office action for the U.S. Appl. No. 12/400,888 dated on Dec. 10, 2010 , United States Patent and Trademark Office , Dec. 12, 2010.
Sterne , R. , Corrected patent owner's response to first office action of U.S. Appl. No. 95/001,389 dated on Aug. 12, 2010 , Sterne, Kessler, Goldstein & Fox , Apr. 11, 2012.
Sterne , R. G. , Response to office action for U.S. Appl. No. 95/001,455 dated on Nov. 19, 2010 , Sterne Kessler , Feb. 22, 2011.
Sterne , R. G. , Response to office action for U.S. Appl. No. 95/001,455 dated on Nov. 19, 2010—Exhibits , Sterne Kessler , Feb. 22, 2011.
Walker , B. , Response to Office Action dated Oct. 5, 2010 of U.S. Appl. No. 12/400,888 , Howison & Arnott , Nov. 2, 2010.
Walker , B. D. , Amendment and response to Office Action for the U.S. Appl. No. 12/400,888 dated on Dec. 10, 2010 , Howison & Arnott, LLP , Dec. 22, 2010.
Corrected response to office action U.S. Appl. No. 95/001,390 of Aug. 19, 2010—Exhibit 1 , Sterne Kessler ; Fractus , Apr. 11, 2011.
Request for inter partes reexamination of US patent 7015868—U.S. Appl. No. 95/001,390—Third party requesters replacement comments to patent owner's reply of Nov. 19, 2010 , Samsung , Mar. 7, 2011.
Request for inter partes reexamination of US patent 7123208—U.S. Appl. No. 95/001,389—Third party requesters comments to patent owner's reply of Apr. 11, 2011 , Samsung , Apr. 29, 2011.
Request for inter partes reexamination of US patent 7123208—U.S. Appl. No. 95/001,389—Third party requesters replacement comments to patent owner's reply of Nov. 12, 2010 , Samsung , Mar. 7, 2011.
Request for inter partes reexamination of US patent 7528782—U.S. Appl. No. 95/001,455—Third party requesters comments to patent owner's reply of Feb. 22, 2011 , Samsung , Mar. 24, 2011.
James, J.R., Handbook of microstrip antennas, Peter Peregrinus, pags 3-4 and 205-207, Jan. 1989.
Dubost, G., Wideband flat dipole and short-circuit microstrip patch elements and arrays. In Handbook of microstrip antennas—Chapter 7, Peter Peregrinus Ltd. James , J. R. ; Hall , P. S. (ed.), 1989.
Stutzman , W. L. ; Thiele , G. A., Antenna theory and design—Chapter 5—Resonant Antennas: Wires and Patches, Wiley, 1998.
Document 971—Order, May 13, 2011.
Document 968—Order, May 13, 2011.
Lu , J. H. ; Wong , K. L, Single-feed dual-frequency equilateral-triangular microstrip antenna with pair of spur lines, Electronic Letters, Jun. 11, 1998.
Request for inter partes reexamination of US patent 7123208, dated on Jul. 1, 2010.
Request for inter partes reexamination of US patent 7202822—95/001414—Third party requester's comments to patent owner's reply dated on Jan. 10, 2011, dated on Feb. 2, 2011.
Notice of allowance for the U.S. Appl. No. 11/179,257, dated on Apr. 15, 2008.
Campos, O., Multiband and miniature fractal antennas study (Estudi d'antenes fractal multibanda i en miniatura), Universitat Politecnica de Catalunya, 1998.
Verdura, O., Miniature fractal antenna (Antena fractal miniatura), Universitat Politecnica de Catalunya, 1997.
Soler, J., Multi-band antennas for wireless communication systems (Antenes multibanda per sistemes de comunicaions inalambriques), Universitat Politecnica de Catalunya, Sep. 1999.
Borja, C., Fractal microstrip antennas (Antenas fractales microstrip), Universitat Politecnica de Catalunya, Jul. 1997.
Request for inter partes reexamination of US patent No. 7528782—US95/001455—Third party requester's comments to patent owner's reply of Feb. 22, 2011, dated on Apr. 28, 2011.
Notice of allowance of U.S. Appl. No. 12/400,888 dated on Jun. 28, 2011.
Document 452—Defendant's reply in support of their motion for summary judgment of invalidity based on indefiniteness and lack of written description for certain terms with exhibits WW, BBB, EEE, GGG, HHH, III, KKK, MMM, NNN, OOO, PPP, Q, dated on Aug. 30, 2010.
Document 429—Declaration of Jeffery D. Baxter—Including Exhibits: J, K, L, M ,N ,O, P, Q, R, S, T, U, Z, AA, KK, LL dated on Jul. 30, 2010.
Document 415—P.R. 4-3 joint claim construction statement, dated on Jun. 14, 2010.
Falconer , K. , Fractal Geometry: Mathematical Foundations and Applications, John Wiley & Sons, 1990, p. 38-44.
Puente, C. , Fractal design of muitiband antenna arrays, University of Illinois at Urbana-Champaign, 1994.
Decision sua sponte to merge reexamination proceedings of US patent 7015868 and reexamination No. 95/001498—95/000589—95/001390 dated on May 23, 2011.
Office action for US patent application 7015868—95/001390 dated on Jul. 1, 2011.
Decision sua sponte to merge reexamination proceedings of US patent 7123208 and reexamination No. 95/001389—95/001501—95/000591 dated on Jun. 1, 2011.
Office action for US patent 7123208—95/001389 dated on Jul. 1, 2011.
Decision sua sponte to merge reexamination proceeding of US patent 7528782 and reexamination No. 95/000595—95/001499—95/001455 dated on May 24, 2011.
Office Action for US patent 7528782—95/001455 dated on Jul. 29, 2011.
Decision sua sponte merging inter partes proceedings of US patent 7397431 and reexamination No. 95/000586—95/001482—95/001497 dated on May 4, 2011.
Response to first office action from May 13, 2011 for US patent 7397431—US95/001482, dated on Aug. 13, 2011.
Exhibits of response to first office action from May 13, 2011 for US patent 7397431—US95/001482.
Decision sua sponte to merge reexamination proceedings of US patent 7394432 and reexamination No. 95/001483—95/000588—95/001500 dated on Mar. 17, 2011.
Response to office action from Apr. 7, 2011 for US7394432—US95/001483, dated on Jul. 7, 2011.
Office action for U.S. Appl. No. 13/044,189 dated on Aug. 8, 2011.
Phan , T. Notice of allowance for the U.S. Appl. No. 13/036,819 dated on Sep. 6, 2011. USPTO.
Walker , B. Amendment and response to office action dated Aug. 8, 2011 for U.S. Appl. No. 13/044,189. Howison & Arnott. Sep. 1, 2011.
The oral and videotaped deposition of Dwight Jaggard. Volume 1, dated on Mar. 8, 2011.
The oral and videotaped deposition of Dwight Jaggard. Volume 2, dated on Mar. 9, 2011.
The oral and videotaped deposition of Dwight Jaggard. Volume 3, dated on Mar. 10, 2011.
Transcript of jury trial before the Honorable Leonard Davis—May 18, 2011—1:00 PM.
Transcript of jury trial before the Honorable Leonard Davis—May 18, 2011—8:45 AM.
Transcript of jury trial before the Honorable Leonard Davis—May 19, 2011—1:00 PM.
Transcript of jury trial before the Honorable Leonard Davis—May 19, 2011— 8:45 AM.
Transcript of jury trial before the Honorable Leonard Davis—May 20, 2011—12:30 PM.
Transcript of jury trial before the Honorable Leonard Davis— May 20, 2011— 8:30 AM.
Transcript of jury trial before the Honorable Leonard Davis—May 23, 2011—8:55 AM.
Transcript of jury trial before the Honorable Leonard Davis US District Judge—May 17, 2011—8:00 AM.
Transcript of jury trial before the Honorable Leonard Davis, US District Judge—May 17, 2011—1:10 PM.

Transcript of pretrial hearing before the Honorable Leonard Davis, US District Judge—May 16, 2011—2:00 PM.
Dr. Stuart Long infringement analysis presented during trial, dated on May 18, 2011.
Demonstratives presented by Dr. Steven Best during trial, dated on May 19, 2011.
Response to office action dated on Jul. 29, 2011 of US patent application 7528782—95/001455 , 95/000595 , 95/001499 , dated on Oct. 31, 2011.
Katsibas , K. D. ; Balanis , C. A. ; Panayiotis , A. T. ; Birtcher , C. R. et al, Folded loop antenna for mobile hand-held units, IEEE Transactions on antennas and propagation, vol. 46, No. 2, Feb. 1998.
Best , S. R. , The fractal loop antenna : understanding the significance of fractal geometry in determining antenna performance, QEX Magazine, Mar. 2002.
Request for inter partes reexamination of US patent 7397431—95/001482—Third party requesters comments to patent owner's reply of Aug. 15, 2011, dated on Sep. 14, 2011.
Request for inter partes reexamination of US patent 7394432—95/001483—Third party requesters comments to patent owner's reply of Jul. 7, 2011 , dated on Aug. 8, 2011.
Patent owner's repsonse to first office action dated on Jul. 1, 2011 of US patent 7015868—95/001390—, dated on Oct. 3, 2011.
Exhibits corresponding to patent owner's response to first office action dated on Jul. 1, 2011 of US patent 7015868—95/001390—, dated on Oct. 3, 2011.
Patent owner's response to first office action dated on Jul. 1, 2011 of US patent 7123208—95/001389—, dated on Oct. 3, 2011.
Notice of allowance of U.S. Appl. No. 13/044,189 dated on Oct. 11, 2011.
The oral and videotaped deposition of Dwight Jaggard. Volume 1, dated on Mar. 8, 2011.
The oral and videotaped deposition of Dwight Jaggard. Volume 2, dated on Mar. 9, 2011.
The oral and videotaped deposition of Dwight Jaggard. Volume 3, dated on Mar. 10, 2011.
Transcript of jury trial before the Honorable Leonard Davis—May 18, 2011—1:00 PM.
Transcript of jury trial before the Honorable Leonard Davis—May 18, 2011—8:45 AM.
Transcript of jury trial before the Honorable Leonard Davis—May 19, 2011—1:00 PM.
Transcript of jury trial before the Honorable Leonard Davis—May 19, 2011—8:45 AM.
Transcript of jury trial before the Honorable Leonard Davis—May 20, 2011—12:30 PM.
Transcript of jury trial before the Honorable Leonard Davis—May 20, 2011—8:30 AM.
Transcript of jury trial before the Honorable Leonard Davis—May 23, 2011—8:55 AM.
Transcript of jury trial before the Honorable Leonard Davis US District Judge—May 17, 2011—8:00 AM.
Transcript of jury trial before the Honorable Leonard Davis, US District Judge— May 17, 2011—1:10 PM.
Transcript of pretrial hearing before the Honorable Leonard Davis, US District Judge—May 16, 2011—2:00 PM.
Dr. Stuart Long infringement analysis presented during trial, dated on May 18, 2011.
Demonstratives presented by Dr. Steven Best during trial, dated on May 19, 2011.
Response to office action dated on Jul. 29, 2011 of US patent application 7528782—95/001455 , 95/000595 , 95/001499 , dated on Oct. 31, 2011.
Katsibas , K. D. ; Balanis , C. A. ; Panayiotis , A. T. ; Birtcher , C. R. et al, Folded loop antenna for mobile hand-held units, IEEE Transactions on antennas and propagation, vol. 46, No. 2, Feb. 1998.
Best , S. R. , The fractal loop antenna : understanding the significance of fractal geometry in determining antenna performance, QEX Magazine, Mar. 2002.
Action closing prosecution for US patent 7397431—95/001482—dated on Dec. 1, 2011.
Action closing prosecution for US patent 7394432—95/001483—dated on Nov. 4, 2011.
Exhibits from Third party requester's comments to patent owner's reply of Jul. 7, 2011 of US patent 7394432 - 951001483, 95/000588, 95/001500, dated on Aug. 8, 2011.
Best, Steven R. , On the significance of self-similar fractal geometry in determining the multiband behaviour of the Sierpinski gasket antenna, IEEE Antennas and wireless propagation letters, dated on 2002.
Durgun , A. C. ; Reese , M. S. ; Balanis , C. A. et al, Flexible bow-tie antennas with reduced metallization, IEEE Radio and Wireless Symposium (RWS), dated on Jan. 16, 2011.
Third party requester's comments to patent owner's reply of Oct. 3, 2011 for US patent 7123208—951001389. Dec. 19, 2011.
Patent owner's response to the Action Closing Prosecution of Dec. 1, 2011 for US patent 7397431—95/001482 , 95/000586. Sterne Kessler, Jan. 3, 2012.
Third party requester's comments to patent owner's reply of Apr. 11, 2011 for US patent 7015868—95/001390. Dec. 19, 2011.
Patent owner's response to the Action Closing Prosecution of Nov. 4, 2011 for US patent 7394432—95/001483 , 951000588. Sterne Kessler. Jan. 4, 2012.
Notice of allowance for U.S. Appl. No. 13/044,189. USPTO. Dec. 28, 2011.
Document 1082—Joint motion to dismiss HTC, dated on Sep. 13, 2011.
Document 1083—Order—Final consent judgement HTC, dated on Sep. 15, 2011.
Document 1088—Samsung's motion to determine intervening rights in view of new Federal Circuit case law or, in the alternative, to stay the case pending the outcome of reexamination, dated on Oct. 19, 2011.
Document 1091—Fractus's response to Samsung's motion to determine intervening rights or to stay the case pending the outcome of reexamination, dated on Nov. 2, 2011.
Document 1092—Samsung's reply in support of its motion to determine intervening rights in view of new Federal Circuit case law or, in the alternative, to stay the case pending the outcome of reexamination, dated on Nov. 14, 2011.
Oral and videotaped deposition of Dr. Stuart Long—vol. 1, dated on Mar. 11, 2011.
Oral and videotaped deposition of Dr. Stuart Long—vol. 2, dated on Mar. 13, 2011.
Oral and videotaped deposition of Dr. Stuart Long—vol. 3, dated on Mar. 14, 2011.
Oral and videotaped deposition of Dr. Warren L. Stutzman—vol. 1, dated on Mar. 3, 2011.
Oral and videotaped deposition of Dr. Warren L. Stutzman—vol. 2, dated on Mar. 4, 2011.
Consent Order, dated on Nov. 15, 2011.
Balanis , C. Antenna theory—Analysis and design—Chapter 1.4—Current distribution on the thin wire antenna. John Wiley & Sons. Jan. 1, 2005.
Luk, K. M. ; Guo , K. F. et al. L-probe proximity fed U-slot patch antenna. Electronic Letters. vol. 34, Num 19, pp. 1806-1807. Sep. 17, 1998.
Third party requester's comments to patent owner's reply of Jan. 3, 2012 pursant to 37 CFR 1947 for US patent 7397431 (US95/001482, US95/001497, US95/000586). Defendants. Feb. 2, 2012.
Third party requester's comments to patent owner's reply of Jan. 4, 2012 pursant to 37 CFR 1947 for US patent 7394432 (US95/001483, US95/001500, US95/000588). Defendants. Feb. 3, 2012.
Third party requester's comments to patent owner's reply of Oct. 31, 2011 pursant to 37 CFR 1947 for US patent 7528782—US95/001455, US95/000595—Exhibits. Defendants. Feb. 1, 2012.
Third party requester's comments to patent owner's reply of Oct. 31, 2011 pursant to 37 CFR 1947 for US patent 7528782—US95/001455, US95/000595—. Defendants. Feb. 1, 2012.

* cited by examiner 2.1

2.2

2.3

2.4

2.5

2.6

2.7

4.1

4.2

4.3

4.4

4.5

4.6

4.7

4.8

4.9

4.10

4.11

4.12

4.13

4.14

4.15

6.1

6.2

6.3

6.4

6.5

6.6

6.7

6.8

6.9

7.1

7.2

7.3

7.4

7.5

7.6

7.7

7.8

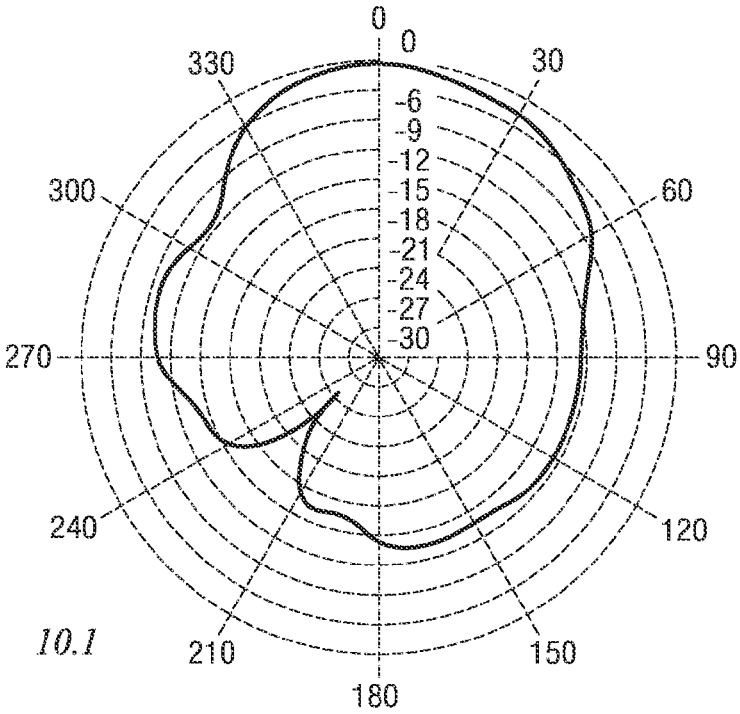
FIG. 10A
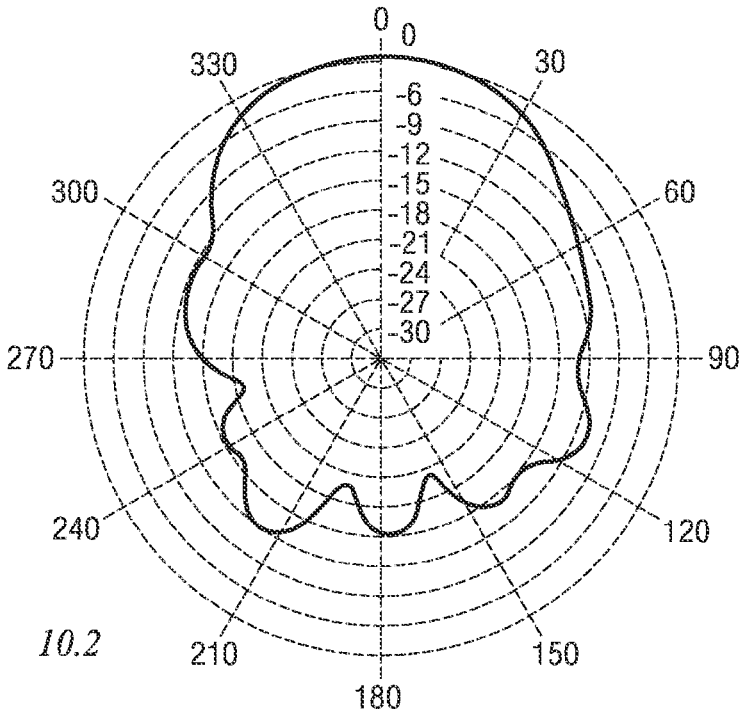

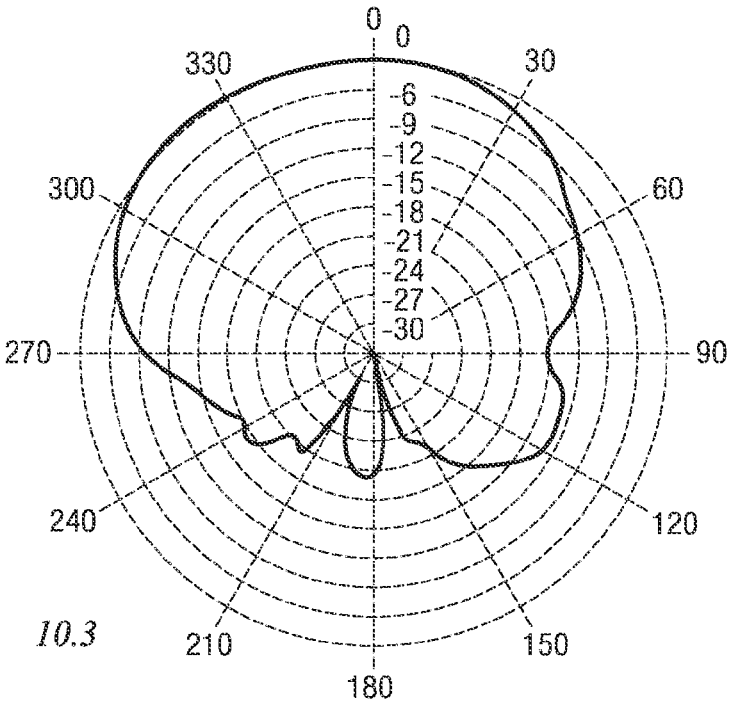
FIG. 10B
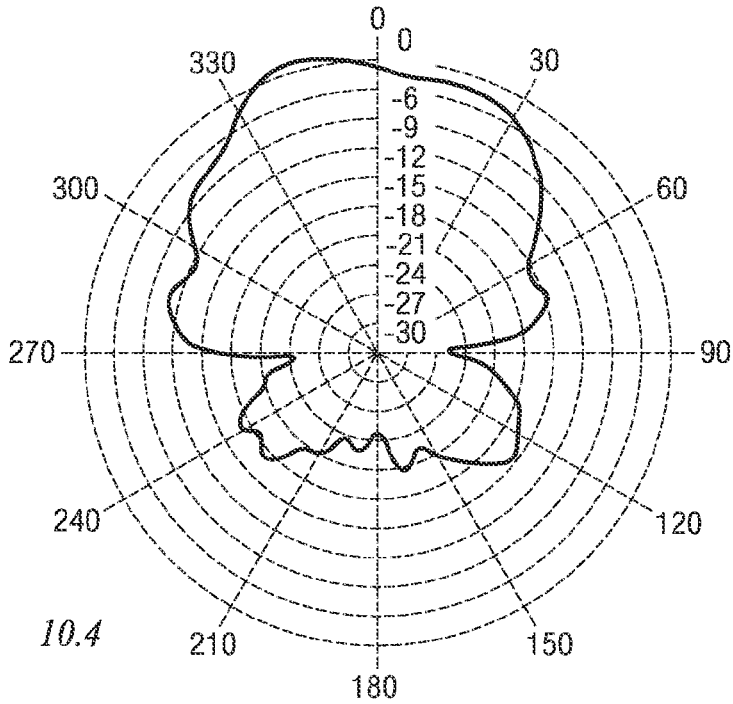

MULTILEVEL ANTENNAE

CROSS-REFERENCE TO RELATED APPLICATIONS

This application is a Continuation Application of U.S. patent application Ser. No. 12/400,888, filed on Mar. 10, 2009, entitled MULTILEVEL ANTENNAE which is a Continuation Application of U.S. patent application Ser. No. 11/780,932, filed on Jul. 20, 2007, entitled MULTILEVEL ANTENNAE, which is a Continuation Application of U.S. patent application Ser. No. 11/179,257, filed on Jul. 12, 2005, entitled MULTILEVEL ANTENNAE, which is a Continuation Application of U.S. Pat. No. 7,123,208, issued on Oct. 17, 2006, entitled: MULTILEVEL ANTENNAE, which is a Continuation Application of U.S. Pat. No. 7,015,868, issued on Mar. 21, 2006, entitled: MULTILEVEL ANTENNAE, which is a Continuation Application of U.S. patent application Ser. No. 10/102,568, filed Mar. 18, 2002, entitled: MULTILEVEL ANTENNAE, now abandoned, which is a Continuation Application of PCT/ES99/00296, filed on Sep. 20, 1999, entitled: MULTILEVEL ANTENNAE, each of which are incorporated herein by reference.

OBJECT OF THE INVENTION

The present invention relates to antennae formed by sets of similar geometrical elements (polygons, polyhedrons electro magnetically coupled and grouped such that in the antenna structure may be distinguished each of the basic elements which form it.

More specifically, it relates to a specific geometrical design of said antennae by which two main advantages are provided: the antenna may operate simultaneously in several frequencies and/or its size can be substantially reduced.

The scope of application of the present invention is mainly within the field of telecommunications, and more specifically in the field of radio-communication.

BACKGROUND AND SUMMARY OF THE INVENTION

Antennae were first developed towards the end of the past century, when James C. Maxwell in 1864 postulated the fundamental laws of electromagnetism. Heinrich Hertz may be attributed in 1886 with the invention of the first antenna by which transmission in air of electromagnetic waves was demonstrated. In the mid forties were shown the fundamental restrictions of antennae as regards the reduction of their size relative to wavelength, and at the start of the sixties the first frequency-independent antennae appeared. At that time helixes, spirals, logoperiodic groupings, cones and structures defined solely by angles were proposed for construction of wide band antennae.

In 1995 were introduced the fractal or multifractal type antennae (U.S. Pat. No. 9,501,019), which due to their geometry presented a multifrequency behavior and in certain cases a small size. Later were introduced multitriangular antennae (U.S. Pat. No. 9,800,954) which operated simultaneously in bands GSM 900 and GSM 1800.

The antennae described in the present patent have their origin in fractal and multitriangular type antennae, but solve several problems of a practical nature which limit the behavior of said antennae and reduce their applicability in real environments.

From a scientific standpoint strictly fractal antennae are impossible, as fractal objects are a mathematical abstraction which include an infinite number of elements. It is possible to generate antennae with a form based on said fractal objects, incorporating a finite number of iterations. The performance of such antennae is limited to the specific geometry of each one. For example, the position of the bands and their relative spacing is related to fractal geometry and it is not always possible, viable or economic to design the antennae maintaining its fractal appearance and at the same time placing the bands at the correct area of the radioelectric spectrum. To begin, truncation implies a clear example of the limitations brought about by using a real fractal type antenna which attempts to approximate the theoretical behavior of an ideal fractal antenna. Said effect breaks the behavior of the ideal fractal structure in the lower band, displacing it from its theoretical position relative to the other bands and in short requiring a too large size for the antenna which hinders practical applications.

In addition to such practical problems, it is not always possible to alter the fractal structure to present the level of impedance of radiation diagram which is suited to the requirements of each application. Due to these reasons, it is often necessary to leave the fractal geometry and resort to other types of geometries which offer a greater flexibility as regards the position of frequency bands of the antennae, adaptation levels and impedances, polarization and radiation diagrams.

Multitriangular structures (U.S. Pat. No. 9,800,954) were an example of non-fractal structures with a geometry designed such that the antennae could be used in base stations of GSM and DCS cellular telephony. Antennae described in said patent consisted of three triangles joined only at their vertices, of a size adequate for use in bands 890 MHz-960 MHz and 1710 MHz-1880 MHz. This was a specific solution for a specific environment which did not provide the flexibility and versatility required to deal with other antennae designs for other environments.

Multilevel antennae solve the operational limitations of fractal and multitriangular antennae. Their geometry is much more flexible, rich and varied, allowing operation of the antenna from two to many more bands, as well as providing a greater versatility as regards diagrams, band positions and impedance levels, to name a few examples. Although they are not fractal, multilevel antennae are characterised in that they comprise a number of elements which may be distinguished in the overall structure. Precisely because they clearly show several levels of detail (that of the overall structure and that of the individual elements which make it up), antennae provide a multiband behavior and/or a small size. The origin of their name also lies in said property.

The present invention consists of an antenna whose radiating element is characterised by its geometrical shape, which basically comprises several polygons or polyhedrons of the same type. That is, it comprises for example triangles, squares, pentagons, hexagons or even circles and ellipses as a limiting case of a polygon with a large number of sides, as well as tetrahedra, hexahedra, prisms, dodecahedra, etc. coupled to each other electrically (either through at least one point of contact o through a small separation providing a capacitive coupling) and grouped in structures of a higher level such that in the body of the antenna can be identified the polygonal or polyhedral elements which it comprises. In turn, structures generated in this manner can be grouped in higher order structures in a manner similar to the basic elements, and so on until reaching as many levels as the antenna designer desires.

Its designation as multilevel antenna is precisely due to the fact that in the body of the antenna can be identified at least two levels of detail: that of the overall structure and that of the majority of the elements (polygons or polyhedrons) which make it up. This is achieved by ensuring that the area of contact or intersection (if it exists) between the majority of the elements forming the antenna is only a fraction of the perimeter or surrounding area of said polygons or polyhedrons.

A particular property of multilevel antennae is that their radioelectric behavior can be similar in several frequency bands. Antenna input parameters (impedance and radiation diagram) remain similar for several frequency bands (that is, the antenna has the same level of adaptation or standing wave relationship in each different band), and often the antenna presents almost identical radiation diagrams at different frequencies. This is due precisely to the multilevel structure of the antenna, that is, to the fact that it remains possible to identify in the antenna the majority of basic elements (same type polygons or polyhedrons) which make it up. The number of frequency bands is proportional to the number of scales or sizes of the polygonal elements or similar sets in which they are grouped contained in the geometry of the main radiating element.

In addition to their multiband behavior, multilevel structure antennae usually have a smaller than usual size as compared to other antennae of a simpler structure. (Such as those consisting of a single polygon or polyhedron). This is because the path followed by the electric current on the multilevel structure is longer and more winding than in a simple geometry, due to the empty spaces between the various polygon or polyhedron elements. Said empty spaces force a 'given path' for the current (which must circumvent said spaces) which travels a greater distance and therefore resonates at a lower frequency. Additionally, its edge-rich and discontinuity-rich structure simplifies the radiation process, relatively increasing the radiation resistance of the antenna and reducing the quality factor Q, i.e. increasing its bandwidth.

Thus, the main characteristic of multilevel antennae are the following: A multilevel geometry comprising polygon or polyhedron of the same class, electromagnetically coupled and grouped to form a larger structure. In multilevel geometry most of these elements are clearly visible as their area of contact, intersection or interconnection (if these exist) with other elements is always less than 50% of their perimeter. The radioelectric behavior resulting from the geometry: multilevel antennae can present a multiband behavior (identical or similar for several frequency bands) and/or operate at a reduced frequency, which allows to reduce their size.

In specialized literature it is already possible to find descriptions of certain antennae designs which allow to cover a few bands. However, in these designs the multiband behavior is achieved by grouping several single band antennae or by incorporating reactive elements in the antennae (concentrated elements as inductors or capacitors or their integrated versions such as posts or notches) which force the apparition of new resonance frequencies. Multilevel antennae on the contrary base their behavior on their particular geometry, offering a greater flexibility to the antenna designer as to the number of bands (proportional to the number of levels of detail), position, relative spacing and width, and thereby offer better and more varied characteristics for the final product.

A multilevel structure can be used in any known antenna configuration. As a nonlimiting example can be cited: dipoles, monopoles, patch or microstrip antennae, coplanar antennae, reflector antennae, wound antennae or even antenna arrays. Manufacturing techniques are also not characteristic of multilevel antennae as the best suited technique may be used for each structure or application. For example: printing on dielectric substrate by photolithography (printed circuit technique); dieing on metal plate, repulsion on dielectric, etc.

Publication WO 97/06578 discloses a fractal antenna, which has nothing to do with a multilevel antenna being both geometries essentially different.

BRIEF DESCRIPTION OF THE DRAWINGS

Further characteristics and advantages of the invention will become apparent in view of the detailed description which follows of a preferred embodiment of the invention given for purposes of illustration only and in no way meant as a definition of the limits of the invention, made with reference to the accompanying drawings, in which:

FIGS. 10*a* and 10*b* show radiation diagrams for the multilevel antenna of FIG. 8: horizontal and vertical planes;

DESCRIPTION OF THE PREFERRED EMBODIMENT OF THE INVENTION

In the detailed description which follows of a preferred embodiment of the present invention permanent reference is made to the figures of the drawings, where the same numerals refer to the identical or similar parts.

The present invention relates to an antenna which includes at least one construction element in a multilevel structure form. A multilevel structure is characterized in that it is formed by gathering several polygon or polyhedron of the same type (for example triangles, parallelepipeds, pentagons, hexagons, etc., even circles or ellipses as special limiting cases of a polygon with a large number of sides, as well as tetrahedra, hexahedra, prisms, dodecahedra, etc. coupled to each other electromagnetically, whether by proximity or by direct contact between elements. A multilevel structure or figure is distinguished from another conventional figure precisely by the interconnection (if it exists) between its component elements (the polygon or polyhedron). In a multilevel structure at least 75% of its component elements have more than 50% of their perimeter (for polygons) not in contact with any of the other elements of the structure. Thus, in a multilevel structure it is easy to identify geometrically and individually distinguish most of its basic component elements, presenting at least two levels of detail: that of the overall structure and that of the polygon or polyhedron elements which form it. Its name is precisely due to this characteristic and from the fact that the polygon or polyhedron can be included in a great variety of sizes. Additionally, several multilevel structures may be grouped and coupled electromagnetically to each other to form higher level structures. In a multilevel structure all the component elements are polygons with the same number of sides or polyhedron with the same number of faces. Naturally, this property is broken when several multilevel structures of different natures are grouped and electromagnetically coupled to form meta-structures of a higher level.

In this manner, in FIGS. 1 to 7 are shown a few specific examples of multilevel structures.

Figure 1:
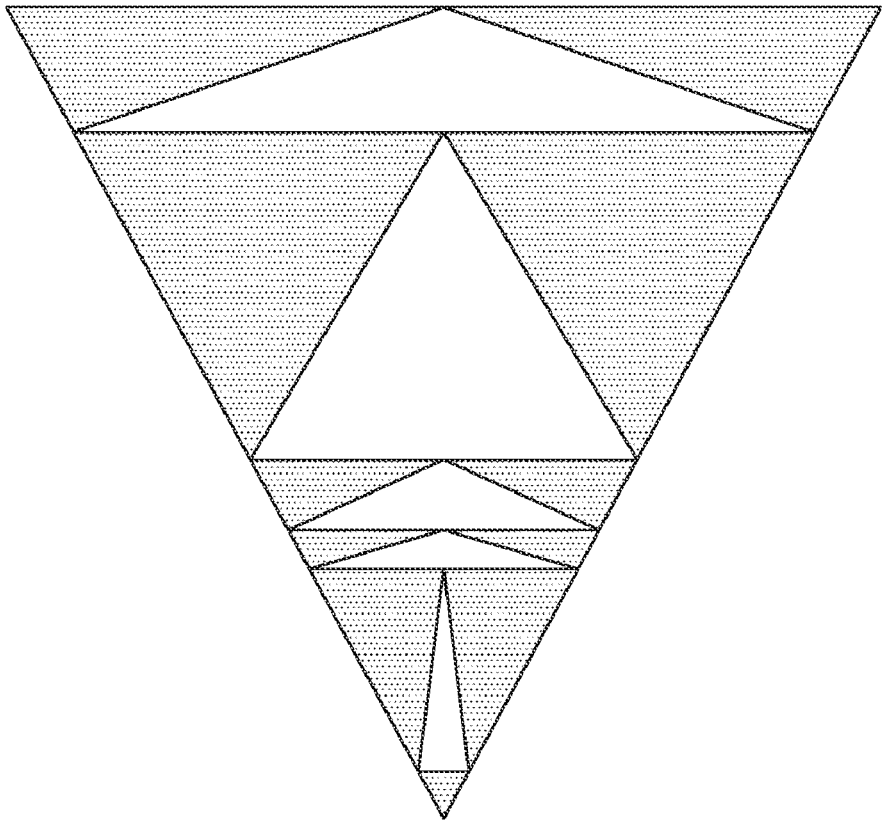
FIG. 1 shows a specific example of a multilevel element comprising only triangular polygons.

FIG. 1 shows a multilevel element exclusively consisting of triangles of various sizes and shapes. Note that in this particular case each and every one of the elements (triangles, in black) can be distinguished, as the triangles only overlap in a small area of their perimeter, in this case at their vertices.

Figure 2:
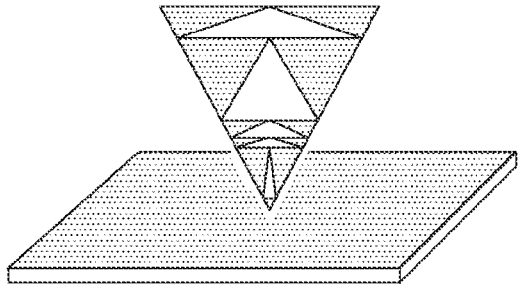
FIG. 2 shows examples of assemblies of multilevel antennae in several configurations: monopole (2.1), dipole (2.2), patch (2.3), coplanar antennae (2.4), horn (2.5-2.6) and array (2.7)
Figure 2:
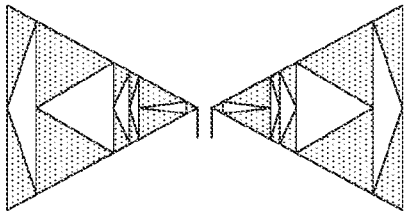
Figure 2:
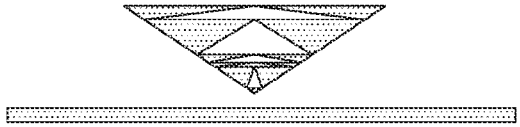
Figure 2:
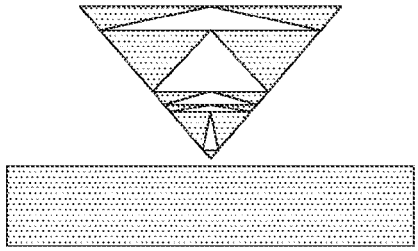
Figure 2:
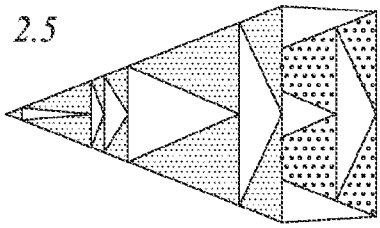
Figure 2:
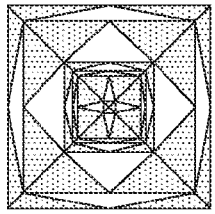
Figure 2:
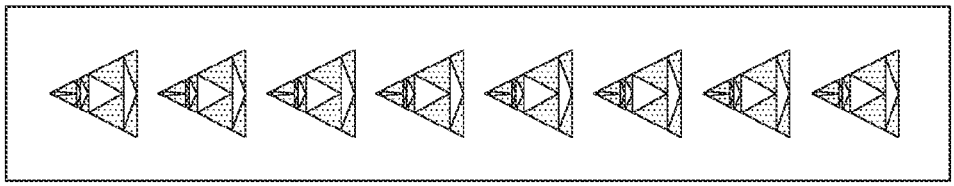

FIG. 2 shows examples of assemblies of multilevel antennae in various configurations: monopole (21), dipole (22), patch (23), coplanar antennae (24), coil in a side view (25) and front view (26) and array (27). With this it should be remarked that regardless of its configuration the multilevel antenna is different from other antennae in the geometry of its characteristic radiant element.

Figure 3:
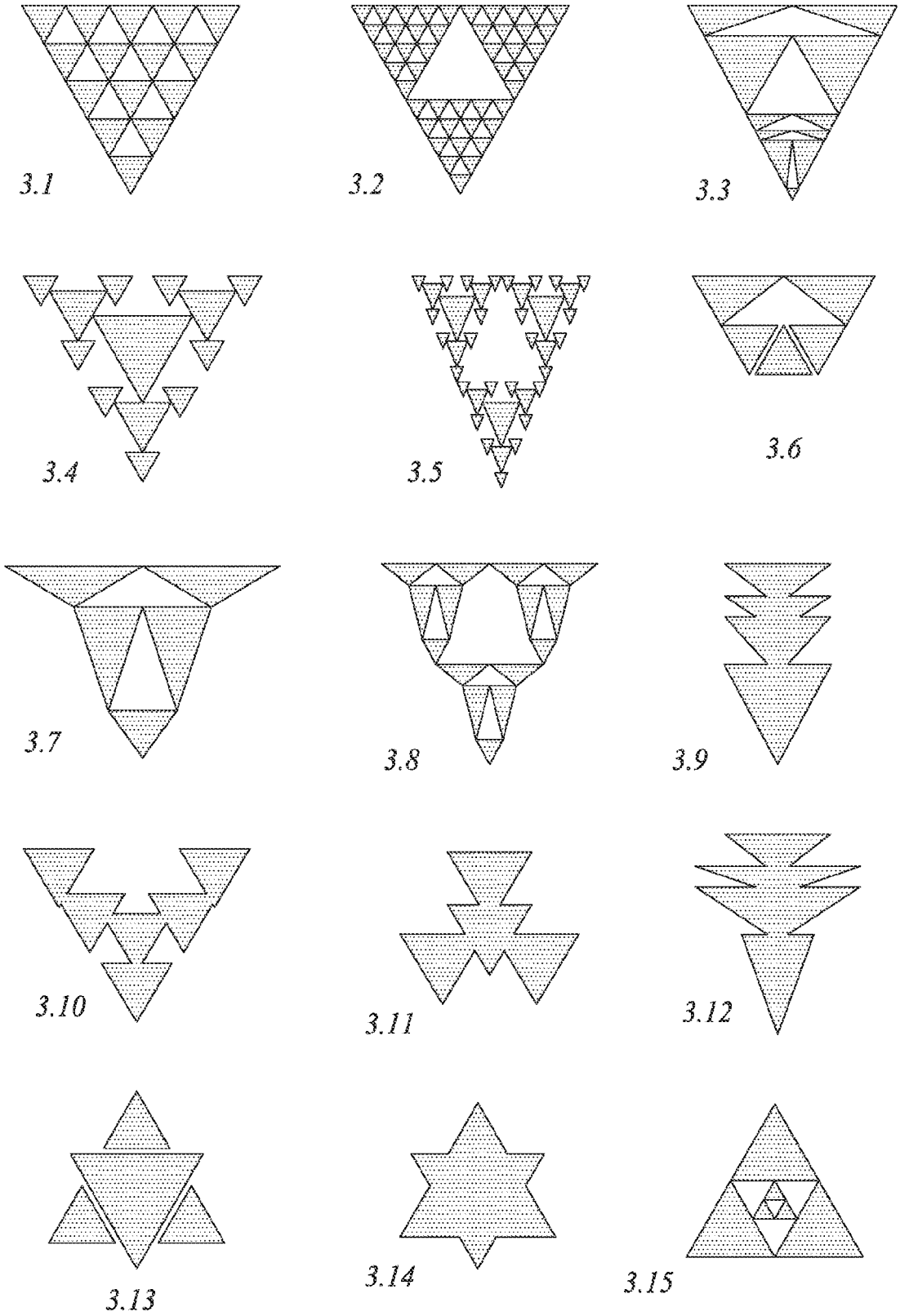
FIG. 3 shows examples of multilevel structures based on triangles.

FIG. 3 shows further examples of multilevel structures (3.1-3.15) with a triangular origin, all comprised of triangles. Note that case (3.14) is an evolution of case (3.13); despite the contact between the 4 triangles, 75% of the elements (three triangles, except the central one) have more than 50% of the perimeter free.

Figure 4:
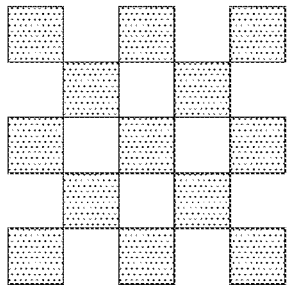
FIG. 4 shows examples of multilevel structures based on parallelepipeds.
Figure 4:
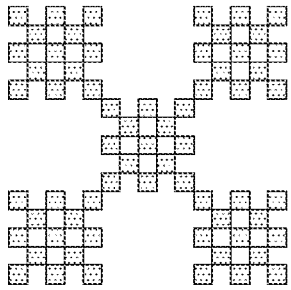
Figure 4:
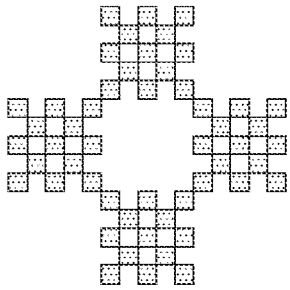
Figure 4:
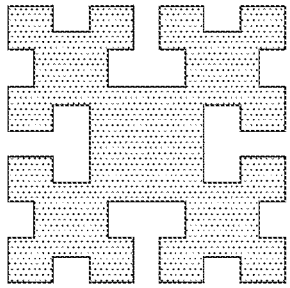
Figure 4:
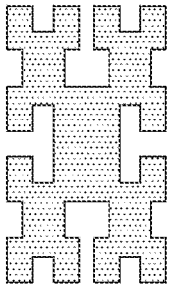
Figure 4:
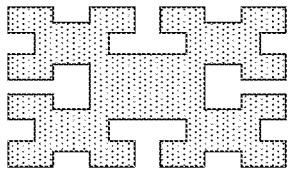
Figure 4:
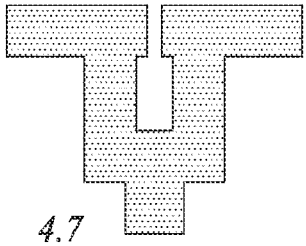
Figure 4:
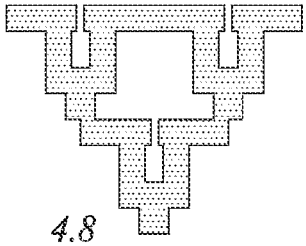
Figure 4:
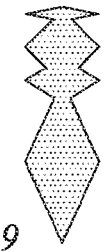
Figure 4:
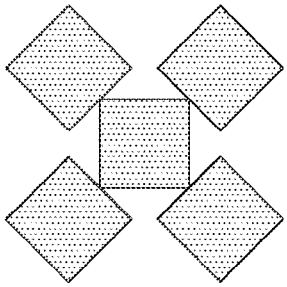
Figure 4:
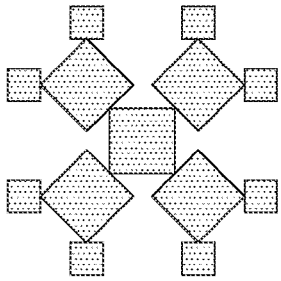
Figure 4:
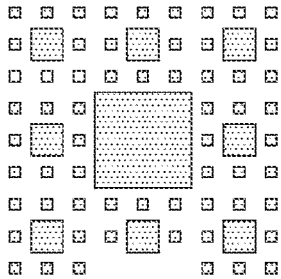
Figure 4:
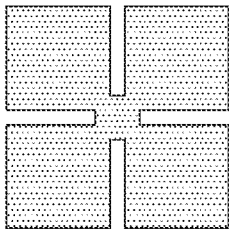
Figure 4:
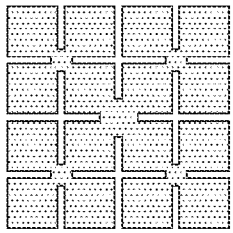
Figure 4:
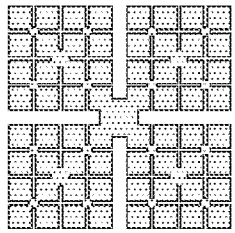

FIG. 4 describes multilevel structures (4.1-4.14) formed by parallelepipeds (squares, rectangles, rhombi . . . ). Note that the component elements are always individually identifiable (at least most of them are). In case (4.12), specifically, said elements have 100% of their perimeter free, without there being any physical connection between them (coupling is achieved by proximity due to the mutual capacitance between elements).

Figure 5:
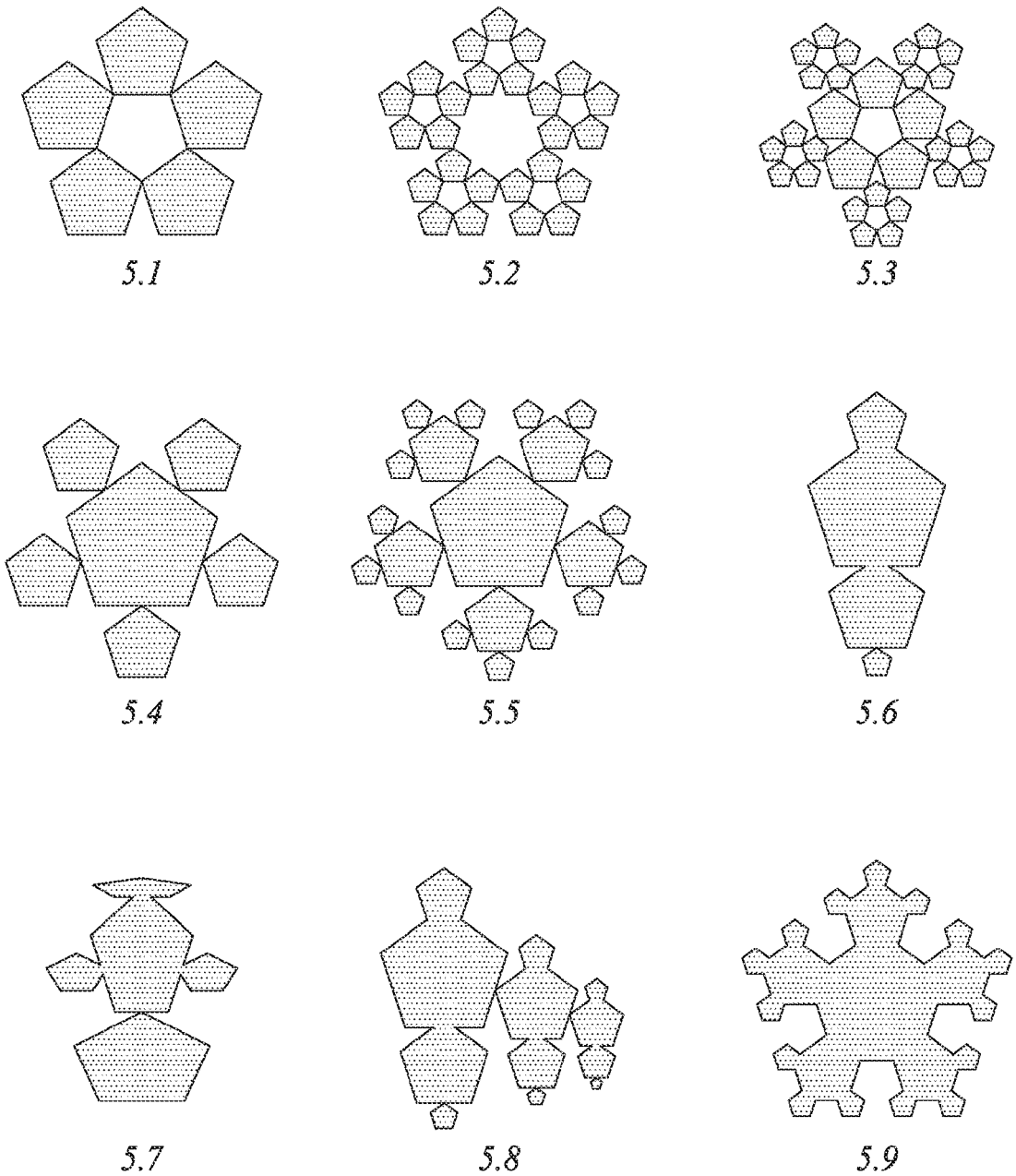
FIG. 5 examples of multilevel structures based on pentagons.
Figure 6:
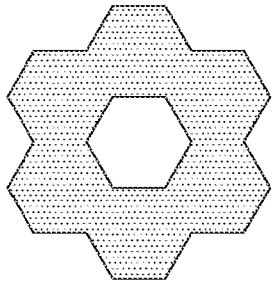
FIG. 6 shows of multilevel structures based on hexagons.
Figure 6:
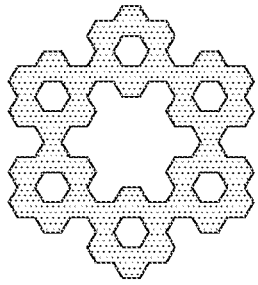
Figure 6:
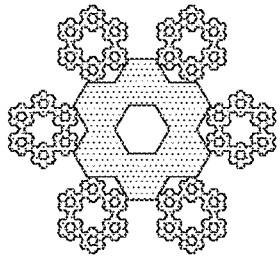
Figure 6:
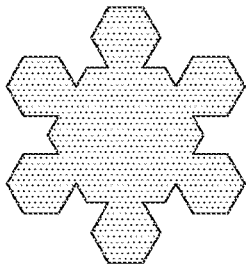
Figure 6:
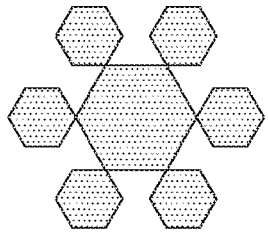
Figure 6:
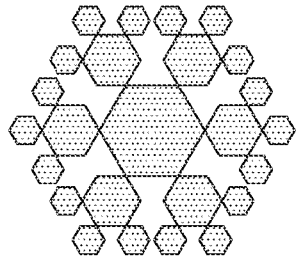
Figure 6:
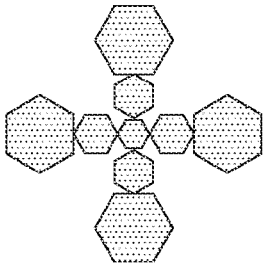
Figure 6:
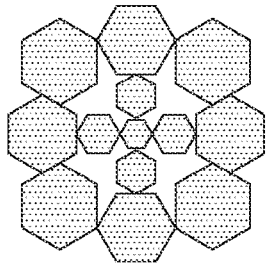
Figure 6:
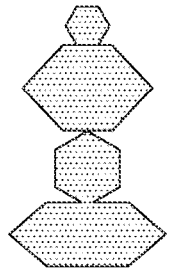
Figure 7:
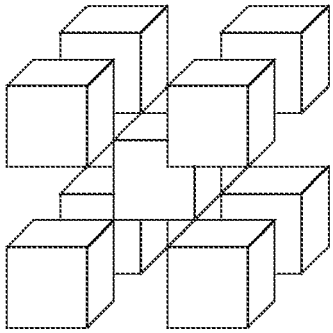
FIG. 7 shows of multilevel structures based on polyhedrons.
Figure 7:
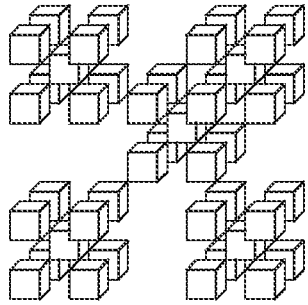
Figure 7:
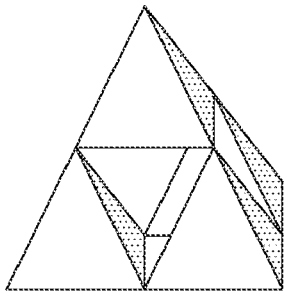
Figure 7:
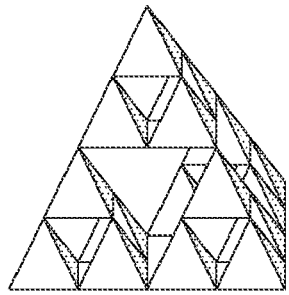
Figure 7:
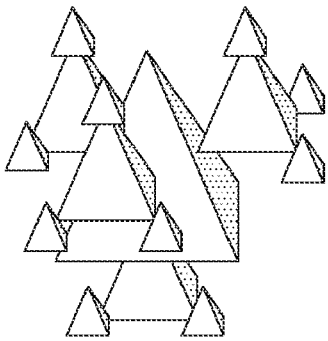
Figure 7:
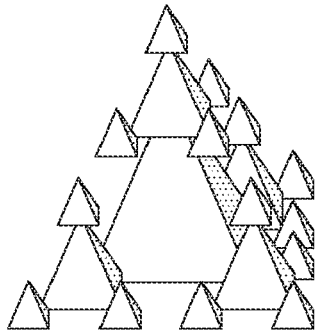
Figure 7:
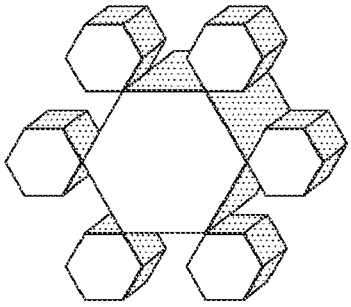
Figure 7:
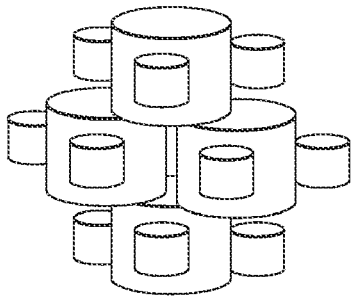

FIGS. 5, 6 and 7 show non limiting examples of other multilevel structures based on pentagons, hexagons and polyhedron respectively.

It should be remarked that the difference between multilevel antennae and other existing antennae lies in the particular geometry, not in their configuration as an antenna or in the materials used for construction. Thus, the multilevel structure may be used with any known antenna configuration, such as for example and in a non limiting manner: dipoles, monopoles, patch or microstrip antennae, coplanar antennae, reflector antennae, wound antennae or even in arrays. In general, the multilevel structure forms part of the radiative element characteristic of said configurations, such as the arm, the mass plane or both in a monopole, an arm or both in a dipole, the patch or printed element in a microstrip, patch or coplanar antenna; the reflector for an reflector antenna, or the conical section or even antenna walls in a horn type antenna. It is even possible to use a spiral type antenna configuration in which the geometry of the loop or loops is the outer perimeter of a multilevel structure. In all, the difference between a multilevel antenna and a conventional one lies in the geometry of the radiative element or one of its components, and not in its specific configuration.

As regards construction materials and technology, the implementation of multilevel antennae is not limited to any of these in particular and any of the existing or future techniques may be employed as considered best suited for each application, as the essence of the invention is found in the geometry used in the multilevel structure and not in the specific configuration. Thus, the multilevel structure may for example be formed by sheets, parts of conducting or superconducting material, by printing in dielectric substrates (rigid or flexible) with a metallic coating as with printed circuits, by imbrications of several dielectric materials which form the multilevel structure, etc. always depending on the specific requirements of each case and application. Once the multilevel structure is formed the implementation of the antenna depends on the chosen configuration (monopole, dipole, patch, horn, reflector . . . ). For monopole, spiral, dipole and patch antennae the multisimilar structure is implemented on a metal support (a simple procedure involves applying a photolithography process to a virgin printed circuit dielectric plate) and the structure is mounted on a standard microwave connector, which for the monopole or patch cases is in turn connected to a mass plane (typically a metal plate or case) as for any conventional antenna. For the dipole case two identical multilevel structures form the two arms of the antenna; in an opening antenna the multilevel geometry may be part of the metal wall of a horn or its cross section, and finally for a reflector the multisimilar element or a set of these may form or cover the reflector.

The most relevant properties of the multilevel antennae are mainly due to their geometry and are as follows: the possibility of simultaneous operation in several frequency bands in a similar manner (similar impedance and radiation diagrams) and the possibility of reducing their size compared to other conventional antennae based exclusively on a single polygon or polyhedron. Such properties are particularly relevant in the field of communication systems. Simultaneous operation in several freq bands allows a single multilevel antenna to integrate several communication systems, instead of assigning an antenna for each system or service as is conventional. Size reduction is particularly useful when the antenna must be concealed due to its visual impact in the urban or rural landscape, or to its unaesthetic or unaerodynamic effect when incorporated on a vehicle or a portable telecommunication device.

An example of the advantages obtained from the use of a multiband antenna in a real environment is the multilevel antenna AM1, described further below, used for GSM and DCS environments. These antennae are designed to meet radioelectric specifications in both cell phone systems. Using a single GSM and DCS multilevel antenna for both bands (900 MHz and 1800 MHz) cell telephony operators can reduce costs and environmental impact of their station networks while increasing the number of users' (customers) supported by the network.

It becomes particularly relevant to differentiate multilevel antennae from fractal antennae. The latter are based on fractal geometry, which is based on abstract mathematical concepts which are difficult to implement in practice. Specialized scientific literature usually defines as fractal those geometrical objects with a non-integral Haussdorf dimension. This means that fractal objects exist only as an abstraction or a concept, but that said geometries are unthinkable (in a strict sense) for a tangible object or drawing, although it is true that antennae based on this geometry have been developed and widely described in the scientific literature, despite their geometry not being strictly fractal in scientific terms. Nevertheless some of these antennae provide a multiband behaviour (their impedance and radiation diagram remains practically constant for several freq bands), they do not on their own offer all of the behaviour required of an antenna for applicability in a practical environment. Thus, Sierpinski's antenna for example has a multiband behaviour with N bands spaced by a factor of 2, and although with this spacing one could conceive its use for communications networks GSM 900 MHz and GSM 1800 MHz (or DCS), its unsuitable radiation diagram and size for these frequencies prevent a practical use in a real environment. In short, to obtain an antenna which in addition to providing a multiband behaviour meets all of the specifications demanded for each specific application it is almost always necessary to abandon the fractal geometry and resort for example to multilevel geometry antennae. As an example, none of the structures described in FIGS. 1, 3, 4, 5 and 6 are fractal. Their Hausdorff dimension is equal to 2 for all, which is the same as their topological dimension. Similarly, none of the multilevel structures of FIG. 7 are fractal, with their Hausdorff dimension equal to 3, as their topological dimension.

In any case multilevel structures should not be confused with arrays of antennae. Although it is true that an array is formed by sets of identical antennae, in these the elements are electromagnetically decoupled, exactly the opposite of what is intended in multilevel antennae. In an array each element is powered independently whether by specific signal transmitters or receivers for each element, or by a signal distribution network, while in a multilevel antenna the structure is excited in a few of its elements and the remaining ones are coupled electromagnetically or by direct contact (in a region which does not exceed 50% of the perimeter or surface of adjacent elements). In an array is sought an increase in the directivity of an individual antenna o forming a diagram for a specific application; in a multilevel antenna the object is to obtain a multiband behaviour or a reduced size of the antenna, which implies a completely different application from arrays.

Below are described, for purposes of illustration only, two non-limiting examples of operational modes for Multilevel Antennae (AM1 and AM2) for specific environments and applications.

Mode AM1

Figure 8:
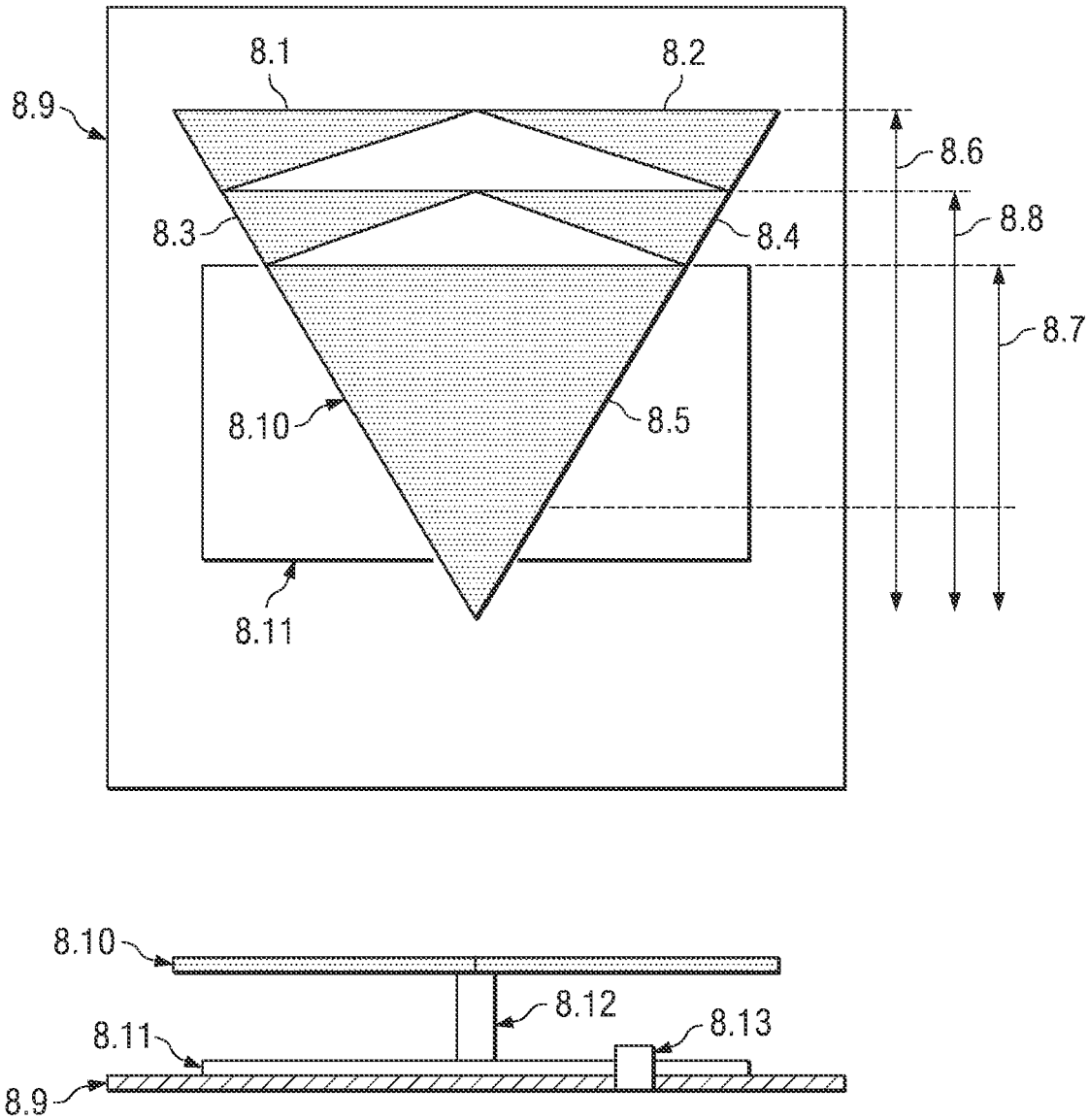
FIG. 8 shows an example of a specific operational mode for a multilevel antenna in a patch configuration for base stations of GSM (900 MHz) and DCS (1800 MHz) cellular telephony.

This model consists of a multilevel patch type antenna, shown in FIG. 8, which operates simultaneously in bands GSM 900 (890 MHz-960 MHz) and GSM 1800 (1710 MHz-1880 MHz) and provides a sector radiation diagram in a horizontal plane. The antenna is conceived mainly (although not limited to) for use in base stations of GSM 900 and 1800 mobile telephony.

The multilevel structure (8.10), or antenna patch, consists of a printed copper sheet on a standard fiberglass printed circuit board. The multilevel geometry consists of 5 triangles (8.1-8.5) joined at their vertices, as shown in FIG. 8, with an external perimeter shaped as an equilateral triangle of height 13.9 cm (8.6). The bottom triangle has a height (8.7) of 8.2 cm and together with the two adjacent triangles form a structure with a triangular perimeter of height 10.7 cm (8.8).

The multilevel patch (8.10) is mounted parallel to an earth plane (8.9) of rectangular aluminum of 22.times.18.5 cm. The separation between the patch and the earth plane is 3.3 cm, which is maintained by a pair of dielectric spacers which act as support (8.12).

Connection to the antenna is at two points of the multilevel structure, one for each operational band (GSM 900 and GSM 1800). Excitation is achieved by a vertical metal post perpendicular to the mass plane and to the multilevel structure, capacitively finished by a metal sheet which is electrically coupled by proximity (capacitive effect) to the patch. This is a standard system in patch configuration antennae, by which the object is to compensate the inductive effect of the post with the capacitive effect of its finish.

At the base of the excitation post is connected the circuit which interconnects the elements and the port of access to the antenna or connector (8.13). Said interconnection circuit may be formed with microstrip, coaxial or strip-line technology to name a few examples, and incorporates conventional adaptation networks which transform the impedance measured at the base of the post to so ohms (with a typical tolerance in the standing wave relation (SWR) usual for these application under 1.5) required at the input/output antenna connector. Said connector is generally of the type N or SMA for microcell base station applications.

In addition to adapting the impedance and providing an interconnection with the radiating element the interconnection network (8.11) may include a diplexor allowing the antenna to be presented in a two connector configuration (one for each band) or in a single connector for both bands.

For a double connector configuration in order to increase the insulation between the GSM 900 and GSM 1800 (DCS) terminals, the base of the DCS and excitation post may be connected to a parallel stub of electrical length equal to half a wavelength, in the central DCS wavelength, and finishing in an open circuit. Similarly, at the base of the GSM 900 lead can be connected a parallel stub ending in an open circuit of electrical length slightly greater than one quarter of the wavelength at the central wavelength of the GSM band. Said stub introduces a capacitance in the base of the connection which may be regulated to compensate the residual inductive effect of the post. Furthermore, said stub presents a very low impedance in the DCS band which aids in the insulation between connectors in said band.

Figure 9:
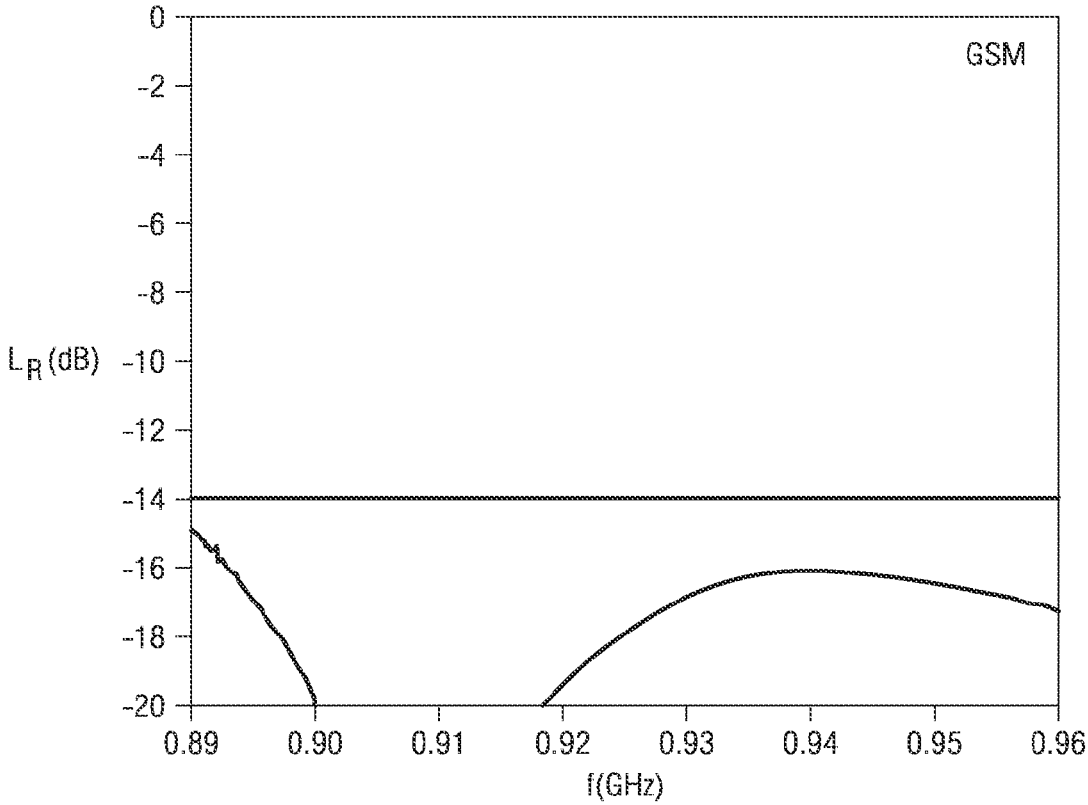
FIG. 9 shows input parameters (return loss on 50 ohms) for the multilevel antenna described in the previous figure.
Figure 9:
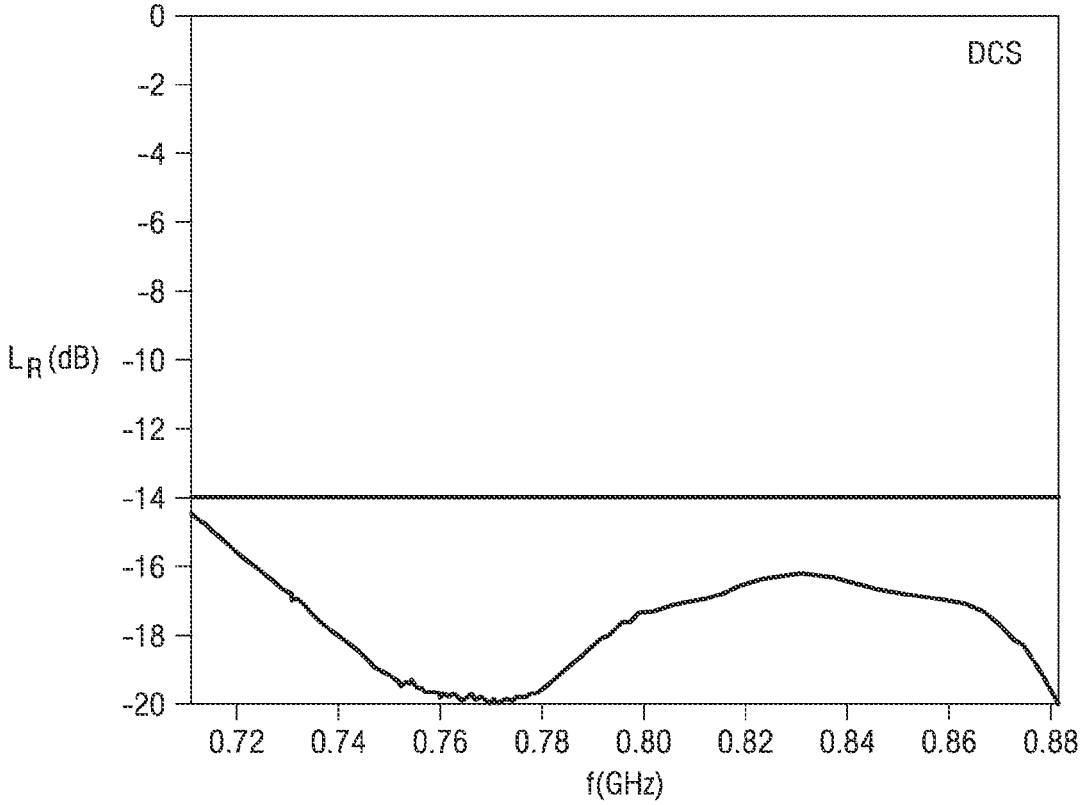

In FIGS. 9, 10*a* and 10*b* are shown the typical radioelectric behavior for this specific embodiment of a dual multilevel antenna.

FIG. 9 shows return losses (L.sub.r) in GSM (9.1) and DCS (9.2), typically under −14 dB (which is equivalent to SWR<1.5), so that the antenna is well adapted in both operation bands (890 MHz-960 MHz and 1710 MHz-1880 MHz).

Radiation diagrams in the vertical (10.1 and 10.3) and the horizontal plane (10.2 and 10.4) for both bands are shown in FIG. 10. It can be seen clearly that both antennae radiate using a main lobe in the direction perpendicular to the antenna (10.1 and 10.3), and that in the horizontal plane (10.2 and 10.4) both diagrams are sectorial with a typical beam width at 3 dB of 65.degree. Typical directivity (d) in both bands is d>7 Db.

Mode AM2

Figure 11:
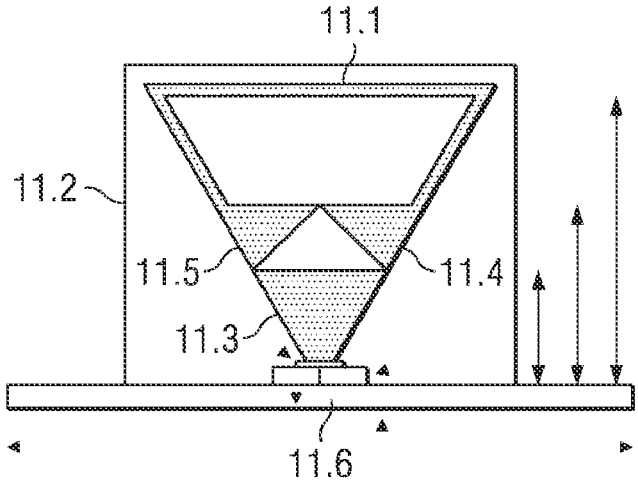
FIG. 11 shows an example of a specific operation mode for a multilevel antenna in a monopole construction for indoors wireless communication systems or in radio-accessed local network environments.

This model consists of a multilevel antenna in a monopole configuration, shown in FIG. 11, for wireless communications systems for indoors or in local access environments using radio.

The antenna operates in a similar manner simultaneously for the bands 1880 MHz-1930 MHz and 3400 MHz-3600 MHz, such as in installations with the system DECT. The multilevel structure is formed by three or five triangles (see FIGS. 11 and 3.6) to which may be added an inductive loop (11.1). The antenna presents an omnidirectional radiation diagram in the horizontal plane and is conceived mainly for (but not limited to) mounting on roof or floor.

The multilevel structure is printed on a Rogers® RO4003 dielectric substrate (11.2) of 5.5 cm width, 4.9 cm height and 0.8 mm thickness, and with a dielectric permittivity equal to 3.38 the multilevel element consists of three triangles (11.3-11.5) joined at the vertex; the bottom triangle (11.3) has a height of 1.82 cm, while the multilevel structure has a total height of 2.72 cm. In order to reduce the total size f the antenna the multilevel element is added an inductive loop (11.1) at its top with a trapezoidal shape in this specific application, so that the total size of the radiating element is 4.5 cm.

The multilevel structure is mounted perpendicularly on a metallic (such as aluminum) earth plane (11.6) with a square or circular shape about 18 cm in length or diameter. The bottom vertex of the element is placed on the center of the mass plane and forms the excitation point for the antenna. At this point is connected the interconnection network which links the radiating element to the input/output connector. Said interconnection network may be implemented as a microstrip, strip-line or coaxial technology to name a few examples. In this specific example the microstrip configuration was used. In addition to the interconnection between radiating element and connector, the network can be used as an impedance transformer, adapting the impedance at the vertex of the multilevel element to the 50 Ohms L.sub.r.rarw.14 dB, SWR<1.5) required at the input/output connector.

Figure 12:
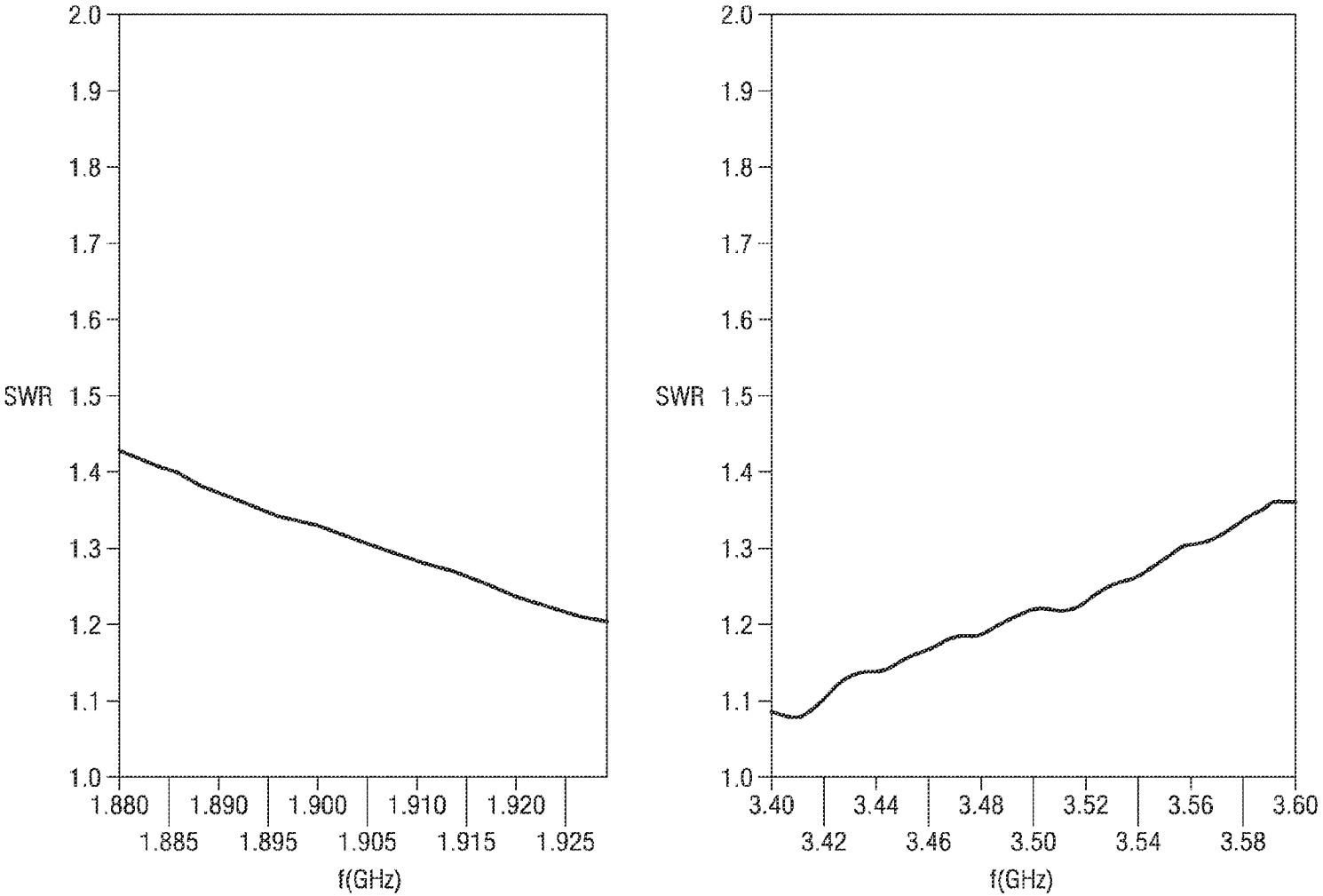
FIG. 12 shows input parameters (return loss on so ohms) for the multilevel antenna of the previous figure.
Figure 13A:
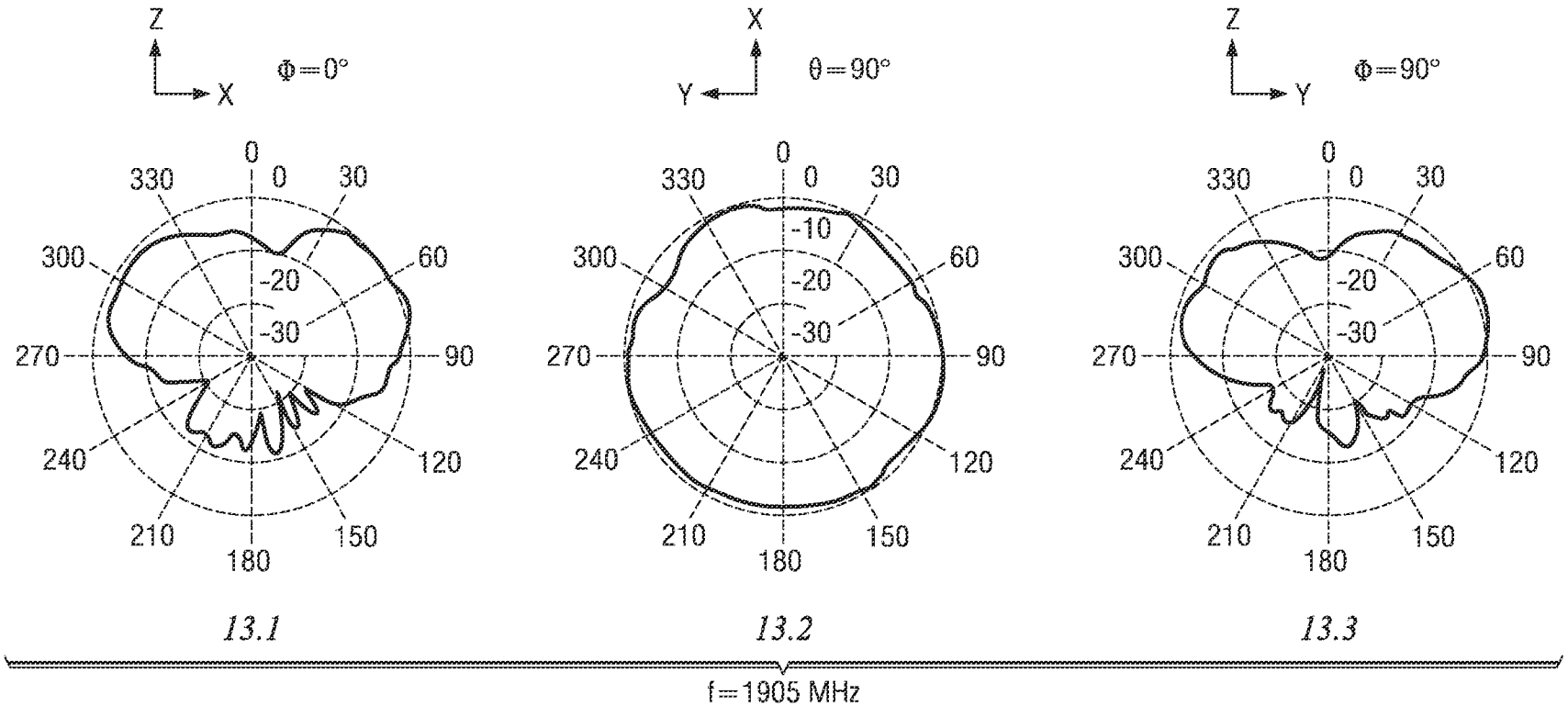
FIGS. 13*a* and 13*b* show radiation diagrams for the multilevel antenna of FIG. 11.
Figure 13B:
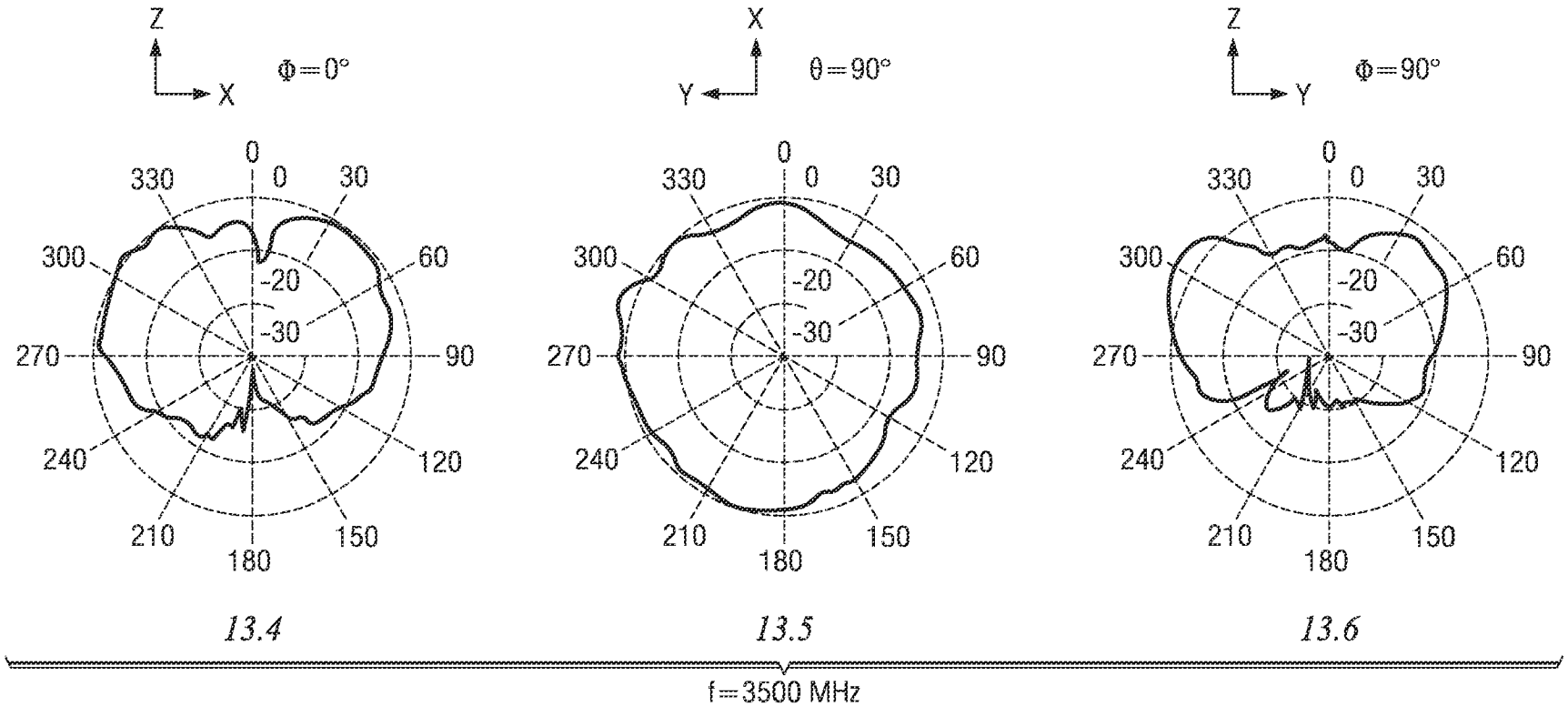

FIGS. 12, 13*a* and 13*b* summarize the radioelectric behavior of antennae in the lower (1300) and higher bands (3500).

FIG. 12 shows the standing wave ratio (SWR) for both bands: FIG. 12.1 for the band between 1880 and 1930 MHz, and FIG. 12.2 for the band between 3400 and 3600 MHz. These show that the antenna is well adapted as return losses are under 14 dB, that is, SWR<1.5 for the entire band of interest.

FIGS. 13*a* and 13*b* show typical radiation diagrams. Diagrams (13.1), (13.2) and (13.3) at 1905 MHz measured in the vertical plane, horizontal plane and antenna plane, respectively, and diagrams (13.4), (13.5) and (13.6) at 3500 MHz measured in the vertical plane, horizontal plane and antenna plane, respectively.

One can observe an omnidirectional behaviour in the horizontal plane and a typical bilobular diagram in the vertical plane with the typical antenna directivity above 4 dBi in the 1900 band and 6 dBi in the 3500 band.

In the antenna behavior it should be remarked that the behavior is quite similar for both bands (both SWR and in the diagram) which makes it a multiband antenna.

Both the AM1 and AM2 antennae will typically be coated in a dielectric radome which is practically transparent to electromagnetic radiation, meant to protect the radiating element and the connection network from external aggression as well as to provide a pleasing external appearance.

It is not considered necessary to extend this description in the understanding that an expert in the field would be capable of understanding its scope and advantages resulting thereof, as well as to reproduce it.

However, as the above description relates only to a preferred embodiment, it should be understood that within this essence may be introduced various variations of detail, also protected, the size and/or materials used in manufacturing the whole or any of its parts.

What is claimed is:

1. An apparatus comprising:

a wireless communications device having an internal antenna system located within the wireless communications device;

wherein said internal antenna system includes a passive antenna set that operates in two or more frequency bands;

wherein said passive antenna set comprises at least one antenna element, a feeding point to said antenna element, and a ground plane;

wherein said at least one antenna element comprises a structure including at least two levels of detail;

a first level of detail for an overall structure defined by a plurality of generally identifiable geometric elements and a second level of detail defined by a subset of the plurality of geometric elements forming said overall structure;

wherein said structure does not define a self-similar fractal structure;

wherein at least one of either a perimeter of contact or an area of overlap between said geometric elements is only a fraction of a total perimeter or a total area of the geometric elements, respectively, for a majority of said geometric elements such that it is possible to generally identify the majority of said plurality of geometric elements within said structure;

wherein said plurality of generally identifiable geometric elements are electromagnetically coupled to each other such that said at least one antenna element is not composed of a plurality of substantially isolated single band antenna elements, each of said single band antenna elements operating in one of said two or more frequency bands;

wherein said feeding point and a point on the ground plane define an input/output port for said passive antenna set and said passive antenna set provides a similar impedance level and radiation pattern at said two or more frequency bands such that the passive antenna set transmits and receives wireless signals on selected channels, the selected channels selectable from a plurality of channels throughout an entire frequency range within each of said two or more frequency bands;

wherein said wireless communications device is a handset;

wherein said internal antenna system includes an interconnection circuit that links the antenna element to the input/output port, and which is used to incorporate adaptation networks for impedances; and wherein said wireless communication device operates at multiple frequency bands, and wherein at least one of said frequency bands is operating within the 800 MHz-3600 MHz frequency range.

2. An apparatus according to claim 1, wherein the internal antenna system operates at three or more frequency bands and the internal antenna system is shared by three or more cellular services.

3. An apparatus according to claim 2, wherein said at least one antenna element is mounted in a monopole configuration.

4. An apparatus according to claim 2, wherein said at least one antenna element is mounted substantially parallel to the ground plane in a patch antenna configuration.

5. An apparatus according to claim 1, wherein the plurality of generally identifiable geometric elements are four-sided geometric elements.

6. An apparatus, as set forth in claim 5 further including at least one dielectric spacer for separating the at least one antenna element from the ground plane, wherein at least a portion of said dielectric spacer overlaps a dielectric substrate layer placed over the ground plane.

7. An apparatus, as set forth in claim 6, wherein said wireless communications device provides at least one cellular service across an entire 1850-1990 MHz frequency range.

8. An apparatus, as set forth in claim 1, wherein the internal antenna system provides at least three frequency bands having similar impedance levels and radiation patterns and further wherein the internal antenna system transmits and receives wireless signals throughout an entire frequency range within each of said at least three frequency bands.

9. An apparatus according to claim 8, wherein said at least one antenna element is mounted in a monopole configuration.

10. An apparatus according to claim 8, wherein said at least one antenna element is mounted substantially parallel to the ground plane in a patch antenna configuration.

11. An apparatus, as set forth in claim 1, wherein the internal antenna system provides at least four frequency bands having similar impedance levels and radiation patterns and further wherein the internal antenna system transmits and receives wireless signals throughout an entire frequency range within each of said at least four frequency bands.

12. An apparatus, as set forth in claim 11, wherein said wireless communications device provides at least one cellular service in across an entire 1850-1990 MHz frequency range.

13. An apparatus according to claim 12, wherein said at least one antenna element is mounted in a monopole configuration.

14. An apparatus according to claim 12, wherein said at least one antenna element is mounted substantially parallel to the ground plane in a patch antenna configuration.

15. An apparatus comprising:

a wireless communications device having an internal antenna system located within the wireless communications device;

wherein said internal antenna system includes a passive antenna set that operates in two or more frequency bands;

wherein said passive antenna set comprises at least one conductive radiating antenna element, a feeding point to said at least one conductive antenna element, and a ground plane;

wherein said feeding point and a point on the ground plane define an input/output port for said passive antenna set;

wherein the at least one conductive radiating antenna element includes at least one structure comprising a plurality of electromagnetically coupled geometric elements grouped into at least a first portion and a second portion in which the second portion is located within the first portion, said first and second portions defining empty spaces in an overall structure of the at least one conductive radiating antenna element to provide at least two current paths through said antenna element, such that the passive antenna set transmits and receives wireless signals on selected channels, the selected channels selectable from a plurality of channels throughout an entire frequency range within each of said two or more frequency bands;

wherein said at least one structure does not define a self-similar fractal structure;

wherein at least one of a perimeter of contact or an area of overlap between each of said geometric elements is only a fraction of a total perimeter or a total area of each of said geometric elements, respectively, for a majority of said plurality of geometric elements such that said internal antenna system is physically smaller than a multi-band antenna operating in said two or more frequency bands obtained by grouping a plurality of substantially isolated single band antenna elements;

wherein said wireless communications device is a handset;

wherein the level of impedance and radiation pattern of said passive antenna set are similar in said two or more frequency bands so that the passive antenna set maintains basically the same radio-electric characteristics and functionality in said two or more bands to allow it to operate simultaneously in said two or more frequency bands and thereby be able to be shared by several communication services; and wherein said wireless communications device provides at least one cellular service across an entire 1850-1990 MHz frequency range.

16. An apparatus, as set forth in claim 15, wherein the internal antenna system further includes a matching network connected to said input/output port.

17. An apparatus according to claim 16, wherein the internal antenna system operates at three or more frequency bands and the internal antenna system is shared by three or more cellular services.

18. An apparatus, as set forth in claim 16, wherein the internal antenna system provides operation over at least three frequency bands having similar impedance levels and radiation patterns and further wherein the internal antenna system transmits and receives wireless signals throughout an entire frequency range within each of said at least three frequency bands.

19. An apparatus, as set forth in claim 15, wherein a number of said plurality of geometric elements is fourteen or more.

20. An apparatus, as set forth in claim 19, wherein the internal antenna system further includes a matching network connected to said input/output port.

21. An apparatus according to claim 20, wherein the internal antenna system operates at three or more frequency bands and the internal antenna system is shared by three or more cellular services.

22. An apparatus, as set forth in claim 15, wherein the internal antenna system provides operation at least four frequency bands having similar impedance levels and radiation patterns and further wherein the internal antenna system transmits and receives wireless signals throughout an entire frequency range within each of said at least four frequency bands.

23. An apparatus, as set forth in claim 22, wherein the internal antenna system further includes a matching network connected to said input/output port.

24. An apparatus, as set forth in claim 22 further including at least one dielectric spacer for separating the at least one conductive radiating antenna element from the ground plane, wherein at least a portion of said dielectric spacer overlaps a dielectric substrate layer placed over the ground plane.

* * * * *